US008383305B2

(12) United States Patent
Sugino et al.

(10) Patent No.: US 8,383,305 B2
(45) Date of Patent: Feb. 26, 2013

(54) IMAGE FORMING APPARATUS

(75) Inventors: Akihiro Sugino, Numazu (JP); Tomoharu Asano, Numazu (JP); Keisuke Shimoyama, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 297 days.

(21) Appl. No.: 12/842,521

(22) Filed: Jul. 23, 2010

(65) Prior Publication Data

US 2011/0020740 A1 Jan. 27, 2011

(30) Foreign Application Priority Data

Jul. 23, 2009 (JP) ..... 2009-171947

(51) Int. Cl.
*G03G 5/147* (2006.01)

(52) U.S. Cl. ..... 430/66; 430/58.05; 430/58.2; 430/58.7; 399/159; 399/346

(58) Field of Classification Search ..... 430/58.05, 430/58.2, 58.7, 66; 399/159, 346
See application file for complete search history.

(56) References Cited

U.S. PATENT DOCUMENTS

| | | | |
|---|---|---|---|
| 6,741,821 | B2 | 5/2004 | Sugino et al. |
| 7,267,916 | B2 | 9/2007 | Sugino et al. |
| 7,314,693 | B2 | 1/2008 | Ikegami et al. |
| 7,486,914 | B2 | 2/2009 | Kabata et al. |
| 7,531,278 | B2 | 5/2009 | Sugino et al. |
| 7,747,197 | B2 | 6/2010 | Shimoyama et al. |
| 2006/0014093 | A1 * | 1/2006 | Li et al. ..... 430/66 |
| 2006/0141378 | A1 | 6/2006 | Takada et al. |
| 2006/0199092 | A1 | 9/2006 | Sugino et al. |
| 2007/0059619 | A1 | 3/2007 | Shimoyama et al. |
| 2007/0117033 | A1 | 5/2007 | Sugino et al. |
| 2007/0248901 | A1 | 10/2007 | Shimoyama et al. |
| 2007/0254224 | A1 | 11/2007 | Sugino |
| 2007/0287083 | A1 | 12/2007 | Gondoh et al. |
| 2008/0112742 | A1 | 5/2008 | Nakamori et al. |
| 2008/0113285 | A1 | 5/2008 | Nakamori et al. |
| 2008/0113286 | A1 | 5/2008 | Shimoyama et al. |
| 2008/0280221 | A1 | 11/2008 | Shimoyama et al. |
| 2008/0318142 | A1 | 12/2008 | Kawasaki et al. |

FOREIGN PATENT DOCUMENTS

| | | | |
|---|---|---|---|
| DE | 29 17 151 | A1 | 11/1979 |
| EP | 2078988 | * | 1/2009 |
| EP | 2 078 988 | A2 | 7/2009 |
| JP | 2000-162881 | | 6/2000 |

(Continued)

OTHER PUBLICATIONS

Extended European Search Report issued Nov. 15, 2010, in Application No. / Patent No. 10170533.3-1217.

*Primary Examiner* — Peter Vajda
(74) *Attorney, Agent, or Firm* — Oblon, Spivak, McClelland, Maier & Neustadt, L.L.P.

(57) ABSTRACT

An image forming apparatus including a latent image bearing member, a charging device, a latent electrostatic image formation device, a development device, a transfer device, and a lubricant supplying device, the latent image bearing member satisfying (I), (II) and (III):

$$|(A1-B1)-(A2-B2)| \leqq 5.0 \quad \text{(I)}$$

$$B1 \geqq 1 \text{ (atomic \%)} \quad \text{(II)}$$

$$1 \text{ (nm)} \leqq X \leqq 30 \text{ (nm)} \quad \text{(III)},$$

where, by XPS analysis, A1 and B1 represent oxygen and silicon atom content ratio in a cross-linked surface layer, respectively, A2 represents oxygen atom content ratio in a surface dug through a cross-linked surface layer along a direction perpendicular to the latent image bearing member surface, to an electroconductive substrate at depth point X where B1 decreases to not greater than B1×0.5, and B2 represents the silicone atom content ratio in the surface at X.

15 Claims, 8 Drawing Sheets

FOREIGN PATENT DOCUMENTS

| | | |
|---|---|---|
| JP | 3164426 | 3/2001 |
| JP | 2002-229241 | 8/2002 |
| JP | 2003-241570 | 8/2003 |
| JP | 3540056 | 4/2004 |
| JP | 2007-156081 | 6/2007 |
| JP | 2008-139804 | 6/2008 |

* cited by examiner

IMAGE FORMING APPARATUS

BACKGROUND OF THE INVENTION

1. Field of the Invention

The present invention relates to an image forming apparatus.

2. Discussion of the Background

Electrophotographic images are formed, for example, through processes of charging, irradiation, development and transfer conducted around a photoreceptor functioning as a latent image bearing member in an electrophotographic image forming apparatus.

In such image formation, corona products produced in the charging process and un-transferred residual toner may remain on the image bearing member after the transfer process. Therefore, the image bearing member is subject to a cleaning process after the transfer process to remove such corona products and residual toner.

Cleaning blade systems using a rubber blade are known and typically used as the cleaning system for use in such a cleaning process since the rubber blade is inexpensive, simple and of good cleaning property.

However, the rubber blade is pressed against the surface of the image bearing member to remove the residuals thereon, which causes substantial friction stress between the surface of the image bearing member and the cleaning rubber blade. Therefore, the rubber blade and the surface layer of the image bearing member, particularly in the case of an organic photoconductor, are abraded, which shortens the actual working life of the rubber blade and the organic photoconductor.

In addition, toner having a small particle diameter has come to be widely used for image formation to respond to the demand for improvement in image quality. In an image forming apparatus using a toner having a small particle diameter, the proportion of un-transferred residual toner that slips through the cleaning blade significantly increases, particularly when the dimensional accuracy and assembly accuracy of the cleaning blade are low, and/or when the cleaning blade partially vibrates, thereby degrading the image quality. Therefore, improvement of the cleaning property by reducing the deterioration of members due to abrasion is required to make the actual working life of an organic photoconductor longer, and output quality images for an extended period of time.

Friction between the blade and the photoconductor is typically reduced by supplying and applying a lubricant to the surface of the organic photoconductor followed by even application of the supplied lubricant to the surface with the cleaning blade or brush to form a lubricant film. Refer to unexamined published Japanese patent application publication No. (hereinafter referred to as JP-A) 2000-162881-A, etc.

Although successful, with this approach it is necessary to determine in advance the precise amount of lubricant to be applied. An excessively small amount of the lubricant leaves such problems unsolved that the organic photoconductor is not protected from abrasion or damage, or the blade is still easily degraded. By contrast, when an excessively large amount of the lubricant is supplied, excess lubricant accumulates on the surface of the organic photoconductor, which leads to image flow, or mixes with a development agent, resulting in degradation of the performance of the development agent On the other hand, in a typical method of improving the cleaning property, a lubricant is externally added to the toner for use in development and supplied to the latent image bearing member only when developing an image with the toner.

JP 2002-229241-A describes a method in which friction between the latent electrostatic image and the cleaning blade is reduced by the supply of a lubricant and the cleaning ability for the residual toner is secured. However, as described in JP 2002-229241-A, when a lubricant is externally added to a toner, the lubricant is applied only to the toner image formed portion on the surface of a latent image bearing member. When a large quantity of data of, for example, an estimate, or a project protocol having an image portion clearly distinct from a non-image portion in a single image, or data having large image density differences depending on which portion of one image are printed on recording media such as sheets, the lubricant is not supplied to the portion where no toner image is formed on the latent image bearing member. That is, lubricant application is localized.

Consequently, the latent image bearing member tends to be locally abraded and the cleaning blade easily vibrates at the border between the portion where the lubricant is applied and the portion where the lubricant is not applied. In addition, this leads to problems such as poor cleaning performance and squeaky noise disturbance.

Furthermore, the amount of the lubricant, which is externally added to toner (for use in a development agent), applied to a latent image bearing member varies depending on the image density. As a result, the amount of lubricant applied decreases with regard to a portion having a thin image density so that abrasion or damage on the latent image bearing member or deterioration of the cleaning blade is not sufficiently prevented. When the image density is thick or the proportion of the lubricant externally added to toner is too high, the amount of the lubricant applied to the latent image bearing member easily increases to a degree that excessive lubricant thereon causes image blur due to image flow on the end portion of the image portion, or lubricant transfers to the charging roller, resulting in variation of the resistance of the charging roller, which leads to a problem of insufficient charging, depending on the image formation conditions. Therefore, the lubricant applied to a latent image bearing member is required to keep an optimal amount.

As the method of using toner to which a lubricant is externally added as described in JP 2002-229241-A, for example, JP 2003-241570-A describes a method in which a solid toner image is formed on the entire surface of a latent image bearing member before image formation starts so as to supply lubricant.

Although lubricant is supplied to the entire surface of a latent image bearing member by using the method described in JP 2003-241570-A, a great amount of the development agent is used, thereby increasing the amount of toner waste, which is a heavy burden on the environment.

In addition, outputting a solid image is not limited to the timing before image formation starts. Such a solid image is periodically output over time in order to prevent local uneven abrasion of the latent image bearing member.

As described above, a great amount of toner waste is typically discharged in exchange for prevention of uneven local abrasion of a latent image bearing member.

In addition, abrasion and image blur can be caused not just by too much lubricant or too little, but also by the interaction between the lubricant and the latent image bearing member onto which the lubricant is applied. For example, a lubricant such as metal soap covers all over the surface of a latent image bearing member, meaning that the lubricant has a function of protecting the surface from the discharging energy of a charging device. However, protecting the surface of a latent image bearing member from the discharging energy means that the lubricant absorbs the energy, thereby degrading the lubricant film.

JP 2008-139804-A attempts to solve this problem, and describes a method in which a lubricant functions as the protection film by regulating the application amount of the lubricant while reducing unwanted side effects. However, when degraded lubricant is left on the surface of a latent image bearing member under high-temperature, high-humidity conditions, significant image blur tends to occur particularly immediately below the charging device. This image blur is particularly noticeable when a latent image bearing member having a cross-linked surface structured by cross-linking a radical polymerizable compound is used.

Although the mechanism of this phenomenon is not clear, one possible reason is that degraded lubricant, moisture in the atmosphere, and corona products produced by a charging device bond together, thereby reducing the resistance of the surface, resulting in image flow of a latent electrostatic image.

In addition, another possible reason why this phenomenon occurs particularly to a latent image bearing member having a cross-linked surface structured by cross-linking a radical polymerizable compound is that degraded lubricant is hardly removed from the surface, and so is hardly replaced with fresh lubricant.

It is possible to increase the amount of the lubricant supplied. However, fresh lubricant is just applied onto the degraded lubricant attached to the surface of the latent image bearing member. Therefore, increasing the amount of lubricant does not contribute to replacement of the degraded lubricant and is actually not effective to solve the image flow problem.

On the other hand, when the amount of lubricant applied to the surface of a latent image bearing member is reduced, the lubricant on the surface is slightly easier to remove, although at the cost of increased abrasion of the surface of the latent image bearing member.

When the cross-linked surface layer of a latent image bearing member has a high content ratio of oxygen atom, the oxygen easily becomes an active spot of a radical, etc. due to discharging in the electrophotographic process. Therefore, deterioration of the surface due to discharging is aggravated, or corona products such as ozone and nitrogen oxides are easily attached to the surface, thereby degrading the cleaning property or image quality.

To deal with this issue, for example, JP 2007-156081-A describes a method of abrading a portion of the surface having a high content ratio of oxygen atoms or curing the surface layer in an inert gas atmosphere. However, in an image forming apparatus having a lubricant application mechanism, which has come to be widely used in recent years, not only the surface of a latent image bearing member but also the lubricant applied thereto are possibly degraded by discharging.

In addition, different from a latent image bearing member vulnerable to abrasion, the degraded lubricant is hardly removed together with the surface of a latent image bearing member having a cross-liked surface layer because of its extremely strong abrasion resistance. Therefore, unless the lubricant is smoothly replaced with fresh lubricant, image blur tends to occur in high-temperature, high-humidity environments.

As described above, when a highly durable latent image bearing member because of its cross-linked surface layer formed by cross-linking a radical polymerizable compound is used in an image forming apparatus having a lubricant applicator, the image blur in under high-temperature, high-humidity conditions and the abrasion of the latent image bearing member are inversely related.

Furthermore, when an image forming apparatus employs a counter-blade cleaning system having a urethane rubber blade, in which the urethane rubber blade is brought into contact with the latent image bearing member against the rotation direction thereof to remove un-transferred residual toner, a lubrication material such as silicone oil is added to the surface of the latent image bearing member to reduce the initial torque. Such a lubrication material tends to ooze to the surface, which blocks cross-linking of a radical polymerizable compound. Therefore, replacement of the lubricant applied to the surface on which silicone oil is present in large amounts tends to be hindered, which leads to frequent occurrence of image blur.

SUMMARY OF THE INVENTION

Because of these reasons, the present inventors recognize that a need exists for an image forming apparatus having a lubricant applicator that stably produces quality images without image blur for an extended period of time even in a high temperature and high moisture environment by using a latent image bearing member having a high durability because of its cross-linked surface layer formed by cross-linking a radical polymerizable compound.

Accordingly, an object of the present invention is to provide an image forming apparatus having a lubricant applicator that stably produces quality images without image blur for an extended period of time even in a high temperature and moisture environment by using a latent image bearing member having a high durability because of its cross-linked surface layer formed by cross-linking a radical polymerizable compound.

Briefly this object and other objects of the present invention as hereinafter described will become more readily apparent and can be attained, either individually or in combination thereof, by an image forming apparatus including a latent image bearing member that bears a latent electrostatic image, having a photosensitive layer on an electroconductive substrate, the photosensitive layer having a surface containing a silicone-based compound and being a cross-linked surface layer formed by curing a polymerizable compound having a charge transport structure; a charging device that charges a surface of the latent image bearing member; a latent electrostatic image formation device that forms a latent electrostatic image on a surface of the latent image bearing member; a development device that develops the latent electrostatic image with a toner or a development agent to obtain a developed image, disposed a downstream side of the charging device relative to a rotation direction of the latent image bearing member; a transfer device that transfers the developed image formed on the surface of the latent image bearing member to a transfer medium; and a lubricant supplying device that supplies a lubricant to the surface of the latent image bearing member, disposed downstream side of the transfer device and on an upstream side of the charging device relative to the rotation direction of the latent image bearing member, the latent image bearing member satisfying the following relationships of Relationship (I), Relationship (II) and Relationship (III):

$$|(A1-B1)-(A2-B2)| \leqq 5.0 \quad \text{Relationship (I)}$$

$$B1 \geqq 1 \text{ (atomic \%)} \quad \text{Relationship (II)}$$

$$1 \text{ (nm)} \leqq X \leqq 30 \text{ (nm)} \quad \text{Relationship (III)},$$

where, according to XPS analysis, A1 represents an oxygen atom content ratio in the cross-linked surface layer, B1 represents a silicon atom content ratio therein, A2 represents an oxygen atom content ratio in a surface obtained by digging through the cross-linked surface layer along a direction perpendicular to the surface of the latent image bearing member to the electroconductive substrate to a depth point X where the silicon atom content ratio of B1 decreases to not greater than B1×0.5, and B2 represents the silicone atom content ratio in the surface at the depth point X.

It is preferred that, in the image forming apparatus, the cross-linked surface is formed by curing a radical polymerizable monomer having three or more functional groups without a charge transport structure, and a radical polymerizable compound having one functional group with a charge transport structure.

It is still further preferred that, in the image forming apparatus, the silicone based compound is a polysiloxane-based compound.

It is still further preferred that, in the image forming apparatus, the functional groups of the radical polymerizable monomer having three or more functional groups without a charge transport structure are at least one of an acryloyloxy group and a methacryloyloxy group.

It is still further preferred that, in the image forming apparatus, the ratio (molecular weight/number of functional groups) of the molecular weight to the number of functional groups of the radical polymerizable monomer having three or more functional groups without a charge transport structure is 250 or less.

It is still further preferred that, in the image forming apparatus, the functional group of the radical polymerizable compound having one functional group with a charge transport structure is an acryloyloxy group or a methacryloyloxy group.

It is still further preferred that, in the image forming apparatus, the charge transport structure of the radical polymerizable compound having one functional group with a charge transport structure is a triaryl amine structure.

It is still further preferred that, in the image forming apparatus, the radical polymerizable compound having one functional group with a charge transport structure comprises a compound represented by a Chemical Structure 1 or 2;

Chemical Structure 1

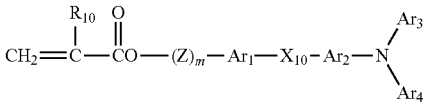

Chemical Structure 2

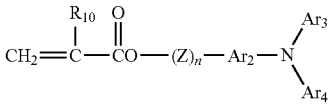

where $R_{10}$ represents hydrogen atom, a halogen atom, a substituted or non-substituted alkyl group, a substituted or non-substituted aralky group, a substituted or non-substituted aryl group, a cyano group, a nitro group, an alkoxy group, —$COOR_{11}$ (where $R_{11}$ represents hydrogen atom, a halogen atom, a substituted or non-substituted alkyl group, a substituted or non-substituted aralkyl group or a substituted or non-substituted aryl group), a halogenated carbonyl group or $CONR_{12}R_{13}$, (where $R_{12}$ and $R_{13}$ independently represent hydrogen atom, a halogen atom, a substituted or non-substituted alkyl group, a substituted or non-substituted aralkyl group or a substituted or non-substituted aryl group, $Ar_1$ and $Ar_2$ independently represent a substituted or non-substituted arylene group, $Ar_3$ and $Ar_4$ independently represent a substituted or non-substituted aryl group, X represents a single bond, a substituted or non-substituted alkylene group, a substituted or non-substituted cycloalkylene group, a substituted or non-substituted alkylene ether group, oxygen atom, sulfur atom, or vinylene group, Z represents a substituted or non-substituted alkylene group, a substituted or non-substituted alkylene ether group or an alkyleneoxy carbonyl group, and m, and n represent an integer of from 0 to 3.

It is still further preferred that, in the image forming apparatus, the radical polymerizable compound having one functional group with a charge transport structure includes a compound represented by the following Chemical Structure 3:

Chemical Structure 3

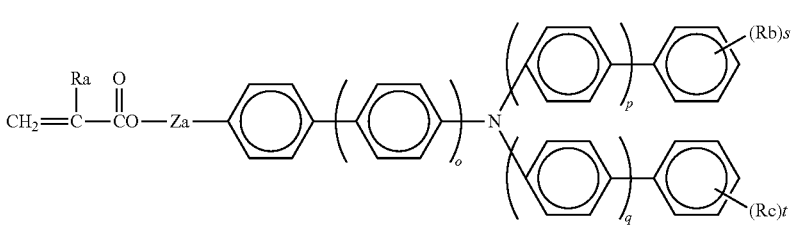

where o, p, q, each, independently, represent 0 or 1, and t each, independently, represent 0 or an integer of from 1 to 3, Ra represents hydrogen atom or methyl group, Rb and Rc, each, independently, represent an alkyl group (excluding hydrogen atom) having 1 to 6 carbon atoms, and Za represents a single bond, methylene group, ethylene group, —$CH_2CH_2O$—, —$CHCH_3CH_2O$—, or —$C_6H_5CH_2CH_2$—.

It is still further preferred that, in the image forming apparatus, the aliphatic metal salt is formed by at least one aliphatic acid selected from the group consisting of stearic acid, palmitic acid, milistic acid, and oleic acid, and at least one metal selected from the group consisting of zinc, aluminum, calcium, magnesium, iron, and lithium.

It is still further preferred that, in the image forming apparatus, the aliphatic metal salt is a solidified solid aliphatic metal salt installed on the lubricant supplying device.

It is still further preferred that, in the image forming apparatus, multiple color toner images are sequentially overlapped to form a color image.

It is still further preferred that the image forming apparatus having a tandem system in which multiple image formation elements are provided each of which integrates the latent image bearing member, the latent electrostatic image formation device, the development device, and the transfer device in a single unit.

It is still further preferred that the image forming apparatus further includes an intermediate transfer body to which the developed image formed on the latent image bearing member is primarily transferred, and a secondary transfer device that secondarily transfer the development image borne on the intermediate transfer body onto the transfer medium, wherein multiple developed images of multiple colors are sequentially overlapped on the intermediate transfer body to form a color image, which is secondarily transferred to the transfer medium all at once.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
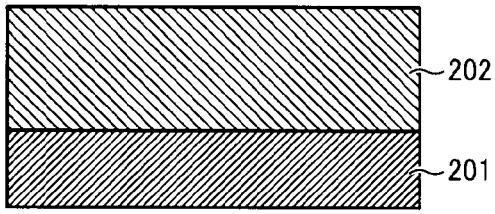
FIG. 1 is a diagram illustrating an example of a layer structure of the latent image bearing member of the present invention.

The present invention is described in detail with reference to accompanying drawings.

Latent Image Bearing Member (Photoreceptor)

The latent image bearing member (photoreceptor) of the present invention is described first.

The latent image bearing member for use in the present invention includes a photosensitive layer on an electroconductive substrate. The surface layer of the photosensitive layer contains at least a silicone-based compound and is a cross-linked surface layer formed by curing a polymerizable compound having a charge transport structure. The image forming apparatus satisfies the following relationships Relationship (I), Relationship (II) and Relationship (III):

$$|(A1-B1)-(A2-B2)| \leqq 5.0 \quad \text{Relationship (I)}$$

$$B1 \geqq 1 \text{ (atomic \%)} \quad \text{Relationship (II)}$$

$$1 \text{ (nm)} \leqq X \leqq 30 \text{ (nm)} \quad \text{Relationship (III)},$$

where, according to XPS analysis, A1 represents an oxygen atom content ratio in the cross-linked surface layer, B1 represents a silicon atom content ratio therein, A2 represents an oxygen atom content ratio in a surface obtained by digging through the cross-linked surface layer along a direction perpendicular to the surface of the latent image bearing member to the electroconductive substrate to a depth point X where the silicon atom content ratio of B1 decreases to not greater than B1×0.5, and B2 represents the silicone atom content ratio in the surface at the depth point X.

A1, A2, B1 and B2 obtained according to XPS analysis in the present invention are the values obtained by the following process.

Cut a square having a side of 10 mm from the sample latent image bearing member, measure the square with XPS narrow spectrum (detection elements: C, N, O, Si) under the following conditions; and calculate the oxygen atom content ratio (A1) of the uppermost surface layer and silicon atom content ratio (B1).

Then, dig the surface 1 nm by 1 nm in depth along a perpendicular direction from the surface to the substrate and measure it as described above with narrow spectrum under the depth profile conditions using fullerene C60 to obtain the oxygen content ratio A2 and the silicon content ratio B2 of the surface at the depth X where the silicon atom content ratio is B1×0.5.

XPS Analysis Condition

Measuring device: QUANTERA SXM (manufactured by Ul-Vac Phi, Inc.)

Measuring light source: Al (monochrometer)

Beam diameter: 100 μm

Spectrum: narrow mode

Measuring element: C, N, O, Si

Path energy: 140 eV

Step size: 0.25 eV

Depth profile measuring condition (fullerene C60)

Sputtering time: 0.1 min.

Sputtering depth: 1 nm/one time

In a first embodiment of the latent image bearing member, a single-layer structured photosensitive layer is provided on a substrate with optional layers such as a protection layer, and an intermediate layer.

In a second embodiment of the latent image bearing member, a laminate structured photosensitive layer having at least a charge generation layer and a charge transport layer is provided on a substrate in that order, with optional layers such as a protection layer, and an intermediate layer.

In the second embodiment, the charge generation layer and the charge transport layer can be reversely provided.

In the single layer structured photosensitive layer, the photosensitive layer or the protection layer formed thereon corresponds to the cross-linked surface layer.

In the laminate structured photosensitive layer, the charge transport layer or the protection layer formed thereon corresponds to the cross-linked surface layer.

Figure 2:
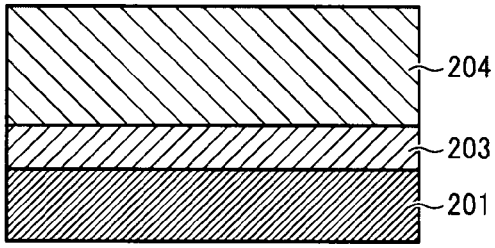
FIG. 2 is a diagram illustrating another example of a layer structure of the latent image bearing member of the present invention.
Figure 3:
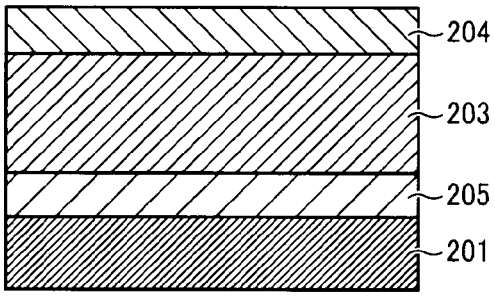
FIG. 3 is a diagram illustrating another example of a layer structure of the latent image bearing member of the present invention.
Figure 4:
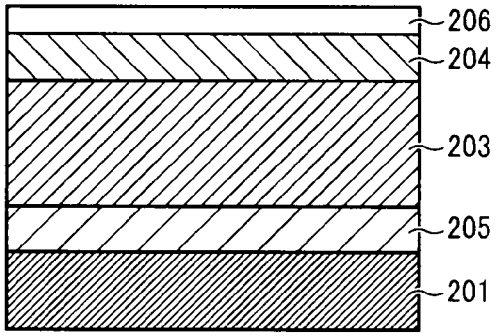
FIG. 4 is a diagram illustrating another example of a layer structure of the latent image bearing member of the present invention.

FIG. 1 is a schematic cross section illustrating an latent image bearing member of the present invention having a structure of a substrate 201 and a photosensitive layer 202 provided thereon. In addition, FIGS. 2, 3, and 4 illustrate other layer structure examples of the latent image bearing member of the present invention. FIG. 2 is diagram illustrating a function separated type of photosensitive layer formed of a charge generation layer (CGL) 203 and a charge transport layer (CTL) 204.

FIG. 3 is a diagram of a structure formed of the substrate 201, and the function separated photosensitive layer having the charge generation layer (CGL) 203 and the charge transport layer (CTL) 204 with an undercoating layer 205 between the substrate 201 and the photosensitive layer.

FIG. 4 is a diagram of a structure having a protection layer 206 provided on the charge transport layer 204.

Any combination of the latent image bearing member having the photosensitive layer 202 (single layered or laminate) on the substrate 201 with optional other layers can be employed.

Cross-linked Surface Layer

With regard to the latent image bearing member for use in the present invention, the surface layer of the photosensitive layer contains at least a silicone based compound and is a cross-linked surface layer formed by curing a polymerizable compound having a charge transport structure. The image forming apparatus satisfies the following relationships Relationship (I), Relationship (II) and Relationship (III):

$$|(A1-B1)-(A2-B2)|\leqq 5.0 \quad \text{Relationship (I)}$$

$$B1\geqq 1 \text{ (atomic \%)} \quad \text{Relationship (II)}$$

$$1 \text{ (nm)}\leqq X\leqq 30 \text{ (nm)} \quad \text{Relationship (III)},$$

where, according to XPS analysis, A1 represents an oxygen atom content ratio in the cross-linked surface layer, B1 represents a silicon atom content ratio therein, A2 represents an oxygen atom content ratio in a surface obtained by digging through the cross-linked surface layer along a direction perpendicular to the surface of the latent image bearing member to the electroconductive substrate to a depth point X where the silicon atom content ratio of B1 decreases to not greater than B1×0.5, and B2 represents the silicone atom content ratio in the surface at the depth point X. Thus, the latent image bearing member has a good durability and the lubricant applied to the surface is smoothly replaced (removed and re-applied). As a result, the image forming apparatus produces quality images without image blur caused by image flow even left in a high temperature and high moisture environment for an extended period of time.

With regard to the latent image bearing member of the present invention, the surface layer contains at least a silicone-based compound, and is a cross-linked surface layer formed by curing a polymerizable compound having a charge transport structure.

Specific examples of the polymerizable compound having a charge transport structure include, but are not limited to, a charge transport material having a cross-linkable functional group such as a hydroxyl group and a charge transport structure in one molecule that is polymerizable with an isocyanate compound or a silanol compound, and UV curable acrylic compounds having a polymerizable functional group such as acrylic group, and methacrylic group and a charge transport structure in one molecule. Of these two compounds, the UV curable acrylic compounds are more preferable because the UV curable acrylic compounds have a cross-linked layer having a relatively strong mechanical strength.

The compound mentioned above that has two or more functional groups independently can form a cross-linked surface layer. However, a cross-linked layer formed by curing a radical polymerizable compound having one functional group with a charge transport structure and a radical polymerizable monomer having three or more functional groups without a charge transport structure is more preferable in terms of the mechanical strength and the electrostatic characteristics. The mechanism is not clear but is possibly caused by the following.

That is, by using a radical polymerizable monomer having three or more functional groups without a charge transport structure, the molecule can employ flexible conformation, there by developing a three dimensional network structure. Therefore, the cross-linking density is extremely high so that the obtained cross-linked surface layer is extremely hard, meaning that a high abrasion resistance is obtained. In contrast, when only radical polymerizable monomers having one or two functional groups are used, the cross-linking bonding in the cross-linked surface layer is weak. Therefore, drastic improvement of the abrasion resistance of the latent image bearing member is hardly obtained.

When a polymer material is contained in the cross-linked surface layer, development of the three dimensional network structure is inhibited, which may lead to a decrease in the cross-linking degree.

Furthermore, since the contained polymer material has bad compatibility with cured products produced by reaction of the radical polymerizable component (radical polymerizable monomer or compound having a charge transport structure), there is a concern that phase separation occurs, which causes local abrasion, resulting in scar on the surface.

In addition, in the case of a combination of a radical polymerizable compound having one functional group with a charge transport structure and a radical polymerizable monomer having three or more functional groups without a charge transport structure, the radical polymerizable compound having one functional group with a charge transport structure is entrapped in the cross-linking during the curing reaction.

To the contrary, when a small molecular weight charge transport material having no functional group is contained in a cross-linked surface layer, the small molecular weight charge transport material tends to precipitate, white crowd phenomenon occurs, and the mechanical strength of the cross-linked surface layer deteriorates.

When a charge transport compound having two or more functional groups is used as the main component, the charge transport compound is fixed in the cross-linking structure by multiple bondings. However, since the charge transport structure is excessively bulky, distortion occurs in the cured resin. Therefore, the internal stress in the cross-linked surface layer increases so that cracking or scar may repeatedly occur due to attachment of carriers, etc.

Therefore, a radical polymerizable compound having one functional group with a charge transport structure is preferably used and fixed among the cross-linking bondings pendulously because the radical polymerizable compound has excellent electric characteristics, which contributes to production of quality images for an extended period of time.

As described above, the charge transport material having no functional group precipitates and causes white turbidity, which causes deterioration of the sensitivity, rise in the residual voltage, etc. resulting from repetitive use.

Since a radical polymerizable compound having two or more functional groups with a charge transport structure is used as the main component and fixed in the cross linking structure with multiple bondings, the intermediate structure (cation radical) during charge transport is not sustained stable, resulting in deterioration of the sensitivity due to charge trap, and rise in the residual voltage. This deterioration of the electric characteristics leads to decreased in image density, production of an image having thinned characters, etc.

In addition, with regard to the latent image bearing member for use in the present invention, the image forming apparatus satisfies the following relationships Relationship (I), Relationship (II) and Relationship (III):

$$|(A1-B1)-(A2-B2)|\leqq 5.0 \quad \text{Relationship (I)}$$

$$B1\geqq 1 \text{ (atomic \%)} \quad \text{Relationship (II)}$$

$$1 \text{ (nm)}\leqq X\leqq 30 \text{ (nm)} \quad \text{Relationship (III)},$$

where, according to XPS analysis, A1 represents an oxygen atom content ratio in the cross-linked surface layer, B1 represents a silicon atom content ratio therein, A2 represents an oxygen atom content ratio in a surface obtained by digging through the cross-linked surface layer along a direction perpendicular to the surface of the latent image bearing member to the electroconductive substrate to a depth point X where the silicon atom content ratio of B1 decreases to not greater than B1×0.5, and B2 represents the silicone atom content ratio in the surface at the depth point X. Thus, the latent image bearing member has a good durability and the lubricant applied to the surface is smoothly replaced (removed and re-applied). As a result, the image forming apparatus produces quality images without image blur caused by image flow even left in a high temperature and moisture environment for an extended period of time.

The mechanism of the phenomenon referred to as the image blur is considered as follows. Upon application of irradiation of the discharging energy from a charging device on a lubricant (represented by metal soap), the lubricant is degraded. Then, ion products produced by degradation and dissembling of the lubricant, moisture in the high temperature and humid environment, and corona products produced by the charging unit are bonded to decrease the surface resistance so that the image flow occurs, which causes image blur.

Furthermore, as a result of an intensive study by the inventors whether the image blur occurs in the cross-linked layer in which the radical polymerizable compound is cross-linked, it was found that the oxygen atom content ratio and the silicon atom content ratio according to XPS analysis in the cross-linked layer, and the oxygen atom content ratio at a depth of about 30 nm from the surface where the silicon atom content ratio drastically decreases are closely related to the occurrence of the image blur.

The mechanism is not clear but is possibly as follows.

In general, when a radical polymerizable compound is cross-linked under the condition that oxygen is present in the reaction field, the cross-linking reaction is inhibited by oxygen inhibition.

Therefore, it is known that UV or electron beam irradiation is conducted in nitrogen atmosphere to reduce the oxygen inhibition.

However, when a slight amount of oxygen remains, or oxygen in a solvent or fogged air during spray application is taken in a wet film before curing, the cross-linking may be slightly inhibited although certainly relatively slightly in comparison with the cross-linking reaction in the air.

In addition, as a detailed study by the inventors, such slight inhibition mostly occurs only to the surface or a portion extremely close thereto and thus is hardly detected by the electrostatic characteristics, or surface hardness measuring such as universal hardness, and the elastic power.

The oxygen atom that causes the cross-linking inhibition at the portion extremely close to the surface is exposed to the surface of the cross-linked film as the end of the functional group. This is mutually reactive with a lubricant and thus hardly removed from the surface.

That is, since the lubricant directly in contact with the surface of a latent image bearing member is difficult to remove and thus is present on the surface for an extended period of time, the lubricant receives the discharging energy from a charging device for an extended period of time, which causes degradation and decomposition of the lubricant.

The lubricant refreshingly applied is applied and present on the degraded lubricant. Therefore, the refreshingly applied lubricant is replaceable but the degraded lubricant directly on the surface of the latent image bearing member is difficult to replace.

Therefore, moisture in the atmosphere in a high temperature humidity environment, and corona products produced by a charging device while left for a long period of time are bonded with the degraded lubricant that remains on the surface of the latent image bearing member, which may cause image blur.

In addition, a cross-linked surface layer in which a radical polymerizable compound is cross-linked is known to have an extremely high abrasion resistance. Therefore, the degraded lubricant and the cross-linked surface are hardly together removed by the abrasive function of members brought into contact with the latent image bearing member. Therefore, the image blur easily occurs.

A leveling agent, etc., is added to the photosensitive layer of the latent image bearing member to form a smooth film surface.

In the present invention, a silicone based compound, a polysiloxane based leveling agent in particular, is added. This photosensitive layer is suitably used in an image forming apparatus using particularly a blade cleaning system in which a urethane rubber blade is provided in contact with the latent image bearing member in the direction against the rotation direction thereof to remove un-transferred residual toner thereon.

Since the silicone-based compound, particularly polysiloxane based compound, uses a characteristic of oozing to the surface, the cross-linking of a radical polymerizable compound around the surface may be inhibited.

Silicone atom and oxygen atom are contained in a polysiloxane skeleton in a ratio of 1 to 1.

That is, the oxygen atom content ratio of the surface containing such a compound according to XPS analysis, is mainly the total of the oxygen atom contained in the radical polymerizable compound molecules, the oxygen atom contained in the siloxane structure, and the oxygen atom deriving from the functional group at the end caused by cross-linking inhibition. Among these, as the oxygen atom deriving from the functional group at the end caused by cross-linking inhibition decreases, the image blur tends not to occur.

The inventors have found that the oxygen atom content ratio ascribable to the functional group at an end due to the cross-linking inhibition is represented by left-hand members of Relationship (I), and by regulating the relationship between the oxygen atom content ratio present extremely close to the surface where the silicone-based compound oozes to the surface, and the oxygen atom content ratio at a depth where the amount of the silicone compound is less than having an adverse impact on the cross-linking inhibition, a latent image bearing member hardly affected by the cross-linking inhibition by the silicone-based compound can be manufactured to reduce the occurrence of the image blur.

However, when the addition amount of the silicone based compound, polysiloxane based leveling agent in particular, is too small, the surface lubrication function tends to decrease so that the lubrication property of the latent image bearing member is in sufficient until the lubricant is sufficiently applied. Therefore, in an image forming apparatus using a blade cleaning system in which a urethane rubber blade is provided in contact with the latent image bearing member in the direction against the rotation direction thereof to remove un-transferred residual toner thereon, the cleaning blade may have a problem such that it turns inward or outward.

To make the surface of the latent image bearing member to have a sufficient lubrication property before the applied amount of the lubricant which prevents the problem of the cleaning blade reaches the sufficient level, the silicon atom content ratio B1 at the surface satisfies Relationship (II) mentioned above.

Methods for satisfying Relationship (II) are, for example, increasing the content of the silicone-based compound, and increasing the time left undone between the application of the surface layer and the cross-linking reaction.

The silicone-based compound contained in the surface exists at a certain depth along the perpendicular direction from the surface to the substrate. Therefore, there is a concern that a functional group having an oxygen atom at its end due to the cross-linking inhibition ascribable to the presence of the silicone-based compound is also present at the certain depth.

Therefore, it is preferable that the surface disappears soon by abrasion with members directly in contact with the latent image bearing member until the depth where the silicon atom content ratio decreases.

However, since the surface that has a cross-linking structure formed by a radical polymerizable compound has an extremely high abrasion resistance, when the functional group having an oxygen atom at its end present at a deep point is exposed to the surface, the functional group having an oxygen atom at its end mutually reacts with the lubricant. Therefore, the image blur problem is left unsolved.

That is, when the silicone-based compound is present at a deep point, it takes a long time to abrade the surface to the deep point. Thus, the surface that easily causes the image blur is exposed for that length of time.

Therefore, with regard to the depth, the point (depth) X where the silicon atom content ratio at the surface decreases to not greater than ½ is required to satisfy Relationship (III). When the depth is greater than 30 nm, it takes a long time to remove the functional group having an oxygen atom at its end, meaning that the latent image bearing member is kept in a state where the image blur easily occurs.

To satisfy Relationship (III), methods of easily oozing of the silicone-based compound to the surface are suitable such as a method of increasing the time left undone between the application of the surface layer, and the cross-linking reaction and increasing the amount of residual organic solvent when the surface layer is formed by reducing the proportion of the solid portion in a liquid application for the surface layer.

Next, the composition of forming the cross-linked surface layer of the present invention is described.

The radical polymerizable monomer having three or more functional groups without a charge transport structure represents a monomer having three or more radical polymerizable functional groups without a positive hole transport structure such as triaryl amine, hydrazone, pyrazoline, or carbazole, or an electron transport structure such as condensed polycyclic quinone, diphenoquinone or an electron absorbing aromatic ring having a cyano group or a nitro group. The radical polymerizable functional group is any radical polymerizable functional group which has a carbon-carbon double bond.

For example, 1-substituted ethylene functional groups and 1,1-substituted ethylene functional groups are suitably used as the radical polymerizable functional group.

(1) A specific example of 1,1-substituted ethylene functional groups is the functional group represented by the following chemical formula 1.

$$CH_x{=}CH{-}X_1{-} \qquad \text{Chemical formula 1}$$

In the chemical formula 1, $X_1$ represents a substituted or non-substituted phenylene group, an arylene group such as a naphthylene group, a substituted or non-substituted alkenylene group, —CO—, —COO—, —CON($R_1$) (wherein, $R_1$ represents hydrogen, an alkyl group such as methyl group and ethylene group, an aralkyl group such as benzyl group, naphthyl methyl group, and phenethyl group, and an aryl group such as phenyl group and naphthyl group), or —S—.

Specific examples of such functional groups include, but are nor limited to, vinyl group, styryl group, 2-methyl-1,3-butadienyl group, vinyl carbonyl group, acryloyloxy group, acryloyl amide group, and vinylthio ether group.

(2) A specific example of 1,1-substituted ethylene functional groups is the functional group represented by the following chemical formula 2.

$$CH_x{=}C(Y){-}X_2{-} \qquad \text{Chemical formula 2}$$

In the chemical formula 2, Y represents a substituted or non-substituted alkyl group, a substituted or non-substituted aralkyl group, an aryl group such as a substituted or non-substituted phenyl group and naphtylene group, a halogen atom, cyano group, nitro group, an alokoxy group such as methoxy group and ethoxy group, —$COOR_2$ ($R_2$ represents hydrogen atom, an alkyl group such as a substituted or non-substituted methyl group and ethyl group, an aralkyl group such as a substituted or non-substituted benzyl group, naphthylmethyl group, and phenethyl group, an aryl group such as substituted or non-substituted phenyl group and naphtyl group or —$CONR_3R_4$ ($R_3$ and $R_4$ independently represent a hydrogen atom, an alkyl group such as a substituted or non-substituted methyl group and ethyl group, an aralkyl group such as a substituted or non-substituted benzyl group, naphthyl methyl group, and phenethyl group, or an aryl group such as substituted or non-substituted phenyl group and naphtyl group).

$X_2$ represents a single bond, the same substitution group as $X_1$, or an alkylene group.

At least one of Y and $X_2$ is an oxycarbonyl group, cyano group, an alkenylene group and an aromatic ring.

Specific examples of these functional groups include, but are not limited to, α-acryloyloxy chloride group, methacryloyloxy group, α-cyanoethylene group, α-cyanoacryloyloxy group, α-cyanophenylene group and methacryloyl amino group.

Specific examples of substitution groups further substituted to the substitution groups of $X_1$, $X_2$ and Y include, but are not limited to, a halogen atom, nitro group, cyano group, an alkyl group such as methyl group and ethyl group, an alkoxy group such as methoxy group and ethoxy group, aryloxy group such as phenoxy group, aryl group such as phenyl group and naphtyl group, and an aralkyl group such as benzyl group and phenetyl group.

Among these radical polymerizable functional groups, acryloyloxy group, and methacyloyloxy group are particularly suitable. A compound having at least three acryloyloxy groups is obtained by performing ester reaction or ester conversion reaction using, for example, a compound having at least three hydroxyl groups therein and an acrylic acid (salt), a halide acrylate and an ester of acrylate. A compound having at least three methacryloyloxy groups is obtained in the same manner. In addition, the radical polymerizable functional groups in a monomer having at least three radical polymerizable functional groups can be the same or different from each other.

The radical polymerizable monomer having at least three functional groups without having a charge transport structure include the following compounds, but are not limited thereto.

Specific examples of the radical polymerizable monomers mentioned above for use in the present invention include, but are not limited to, trimethylol propane triacrylate (TMPTA), trimethylol propane trimethacrylate, HPA modified trimethylol propane triacrylate, EO modified trimethylol propane triacrylate, PO modified trimethylol propane triacrylate, caprolactone modified trimethylol propane triacrylate, HPA modified trimethylol propane triacrylate, pentaerythritol triacrylate, pentaerythritol tetra acrylate (PETTA), glycerol triacrylate, ECH modified glycerol triacrylate, EO modified glycerol triacrylate, PO modified glycerol triacrylate, tris (acryloxyrthyl) isocyanulate, dipenta erythritol hexacrylate (DPHA), caprolactone modified dipenta erythritol hexacrylate, dipenta erythritol hydroxyl dipenta acrylate, alkylized dipenta erythritol tetracrylate, alkylized dipenta erythritol triacrylate, dimethylol propane tetracrylate (DTMPTA), penta erythritol ethoxy tetracrylate, EO modified phosphoric acid triacrylate, and 2,2,5,5-tetrahydroxy methyl cyclopentanone tetracrylate. These can be used alone or in combination.

In addition, in the radical polymerizable monomer having at least three functional groups without having a charge transport structure, the proportion of the molecular weight to the number of the functional groups is preferably 50 or less to form dense cross-linking bonds in the cross-linked surface layer.

When the ratio is too great, the cross-linked surface layer tends to be soft and thus the abrasion resistance slightly deteriorates. Therefore, among the monomers specified above, it is not preferred to singly use a monomer having an extremely long modified group such as HPA, EO, and PO.

In addition, the content ratio of the radical polymerizable monomer having three functional groups without having a charge transport structure for use in the cross-linked surface layer is from 20 to 80% by weight and preferably from 35 to 65% by weight based on the total weight of a cross-linked surface layer.

When the monomer content ratio is too small, the density of three-dimensional cross-linking bonding in a cross-linked surface layer tends to be small. Therefore, the abrasion resistance thereof is not drastically improved in comparison with a case in which a typical thermal plastic binder resin is used.

When the monomer content ratio is too large, the content of a charge transport compound decreases, which may cause deterioration of the electric characteristics.

Desired electric characteristics and abrasion resistance vary depending on the process used. Therefore, it is difficult to jump to any conclusion but considering the balance of the combination, the range of from 35 to 65% by weight is most preferred.

The radical polymerizable compound (monomer) having a charge transport structure represents a compound having a radical polymerizable functional group, and a positive hole structure such as triaryl amine, hydrazone, pyrazoline, or carbazole, or an electron transport structure such as condensed polycyclic quinone, diphenoquinone or an electron absorbing aromatic ring having a cyano group or a nitro group.

As the radical polymerizable functional group, the radical polymerizable functional groups specified in the radical polymerizable monomer mentioned above can be suitably used. Among these, acryloyloxy group and methacryloyloxy group are particularly suitable. In addition, a triaryl amine structure is highly effective as the charge transport structure.

Among these, when a compound having the structure represented by the following chemical structure (1) and (2) is used, the electric characteristics such as sensitivity and residual voltage are preferably sustained during repetitive use.

Chemical Structure 1

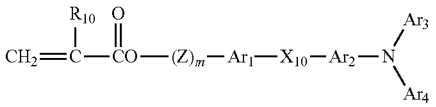

Chemical Structure 2

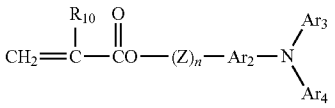

In the chemical structures 1 and 2, $R_{10}$ represents hydrogen atom, a halogen atom, a substituted or non-substituted alkyl group, a substituted or non-substituted aralky group, a substituted or non-substituted aryl group, a cyano group, a nitro group, an alkoxy group, —$COOR_{11}$ (where $R_{11}$ represents hydrogen atom, a halogen atom, a substituted or non-substituted alkyl group, a substituted or non-substituted aralkyl group or a substituted or non-substituted aryl group), a halogenated carbonyl group or $CONR_{12}R_{13}$, (where $R_{12}$ and $R_{13}$ independently represent hydrogen atom, a halogen atom, a substituted or non-substituted alkyl group, a substituted or non-substituted aralkyl group or a substituted or non-substituted aryl group, and $Ar_1$ and $Ar_2$ independently represent a substituted or non-substituted arylene group.

$Ar_3$ and $Ar_4$ independently represent a substituted or non-substituted aryl group. X represents a single bond, a substituted or non-substituted alkylene group, a substituted or non-substituted cycloalkylene group, a substituted or non-substituted alkylene ether group, oxygen atom, sulfur atom, or vinylene group. Z represents a substituted or non-substituted alkylene group, a substituted or non-substituted alkylene ether group or an alkyleneoxy carbonyl group. m and n represent an integer of from 0 to 3.

Specific examples of substitution group of the chemical structure 1 and 2 are as follows.

In the Chemical structures 1 and 2, as the substitution groups of $R_{10}$, specific examples of the alkyl groups of $R_{10}$ include, but are not limited to, methyl group, ethyl group, propyl group, and butyl group. Specific examples of the aryl groups of $R_{10}$ include, but are not limited to, phenyl group and naphtyl group. Specific examples of the aralkyl groups of $R_{10}$ include, but are not limited to, benzyl group, phenthyl group, naphtyl methyl group. The alkoxy group $R_{10}$ include, but are not limited to, methoxy group, ethoxy group and propoxy group. These can be substituted by a halogen atom, nitro group, cyano group, an alkyl group such as methyl group and ethyl group, an alkoxy group such as methoxy group and ethoxy group, an aryloxy group such as phenoxy group, an aryl group such as phenyl group and naphtyl group and an aralkyl group such as benzyl group and phenthyl group.

Among these substitution groups for $R_{10}$, hydrogen atom and methyl group are particularly preferable. $Ar_3$ and $Ar_4$ represent a substituted or non-substituted aryl group. Specific examples thereof include, but are not limited to, condensed polycyclic hydrocarbon groups, non-condensed ring hydrocarbon groups and heterocyclic groups.

Specific examples of the condensed polycyclic hydrocarbon groups include, but are not limited to, a group in which the number of carbons forming a ring is not greater than 18 such as pentanyl group, indenyl group, naphtyl group, azulenyl group, heptalenyl group, biphenylenyl group, as-indacenyl group, s-indacenyl group, fluorenyl group, acenaphtylenyl group, pleiadenyl group, acenaphtenyl group, phenalenyl group, phenanthryl group, anthryl group, fluorantenyl group, acephenantrirenyl group, aceantrirenyl group, triphenylene group, pyrenyl group, chrysenyl group, and naphthacenyl group.

Specific examples of the non-condensed ring hydrocarbon groups include, but are not limited to, a single-valent group of monocyclic hydrocarbon compounds such as benzene, diphenyl ether, polyethylene diphenyl ether, diphenylthio ether and phenylsulfon, a single-valent group of non-condensed polycyclic hydrocarbon compounds such as biphenyl, polyphenyl, diphenyl alkane, diphenyl alkene, diphenyl alkyne, triphenyl methane, distyryl benzene, 1,1-diphenyl cycloalkane, polyphenyl alkane and polyphenyl alkene or a single-valent group of ring aggregated hydrocarbon compounds such as 9,9-diphenyl fluorene.

Specific examples of the heterocyclic groups include, but are not limited to, a single-valent group such as carbazol, dibenzofuran, dibenzothiophene, oxadiazole, and thiadiazole.

The aryl groups represented by $Ar^3$ and $Ar^4$ can have a substitution group. Specific examples thereof are as follows:

(1) Halogen Atom, Cyano Group, and Nitro Group;

(2) Alkyl Group

Preferably a straight chained or side chained alkyl group having 1 to 12, more preferably 1 to 8 and furthermore preferably from 1 to 4 carbons. These alkyl groups can have a fluorine atom, a hydroxyl group, an alkoxy group having 1 to 4 carbon atoms, a phenyl group or a phenyl group substituted by a halogen atom, an alkyl group having 1 to 4 carbon atoms or an alkoxy group having 1 to 4 carbon atoms.

Specific examples thereof include, but are not limited to, methyl group, ethyl group, n-butyl group, 1-propyl group, t-butyl group, s-butyl group, n-propyl group, trifluoromethyl group, 2-hydroxy ethyl group, 2-ethoxyethyl group, 2-cyanoethyl group, 2-methoxyethyl group, benzyl group, 4-chlorobenzyl group, 4-methyl benzyl group and 4-phenyl benzyl group;

(3) Alkoxy Group (—$OR_{14}$)

$R_{14}$ is the alkyl group represented in (2).

Specific examples thereof include, but are not limited to, methoxy group, ethoxy group, n-propoxy group, i-propoxy group, t-butoxy group, n-butoxy group, s-butoxy group, i-butoxy group, 2-hydroxy ethoxy group, benzyl oxy group, and trifluoromethoxy group;

(4) Aryloxy Group

Specific examples of the aryl group of the aryloxy group include, but are not limited to, phenyl group, and naphtyl group.

These can contain an alkoxy group having 1 to 4 carbon atoms, an alkyl group having a 1 to 4 carbon atoms, or a halogen atom as a substitution group.

Specific examples include, but are not limited to, phenoxy group, 1-naphtyloxy group, 2-naphtyloxy group, 4-methoxyphenoxy group, and 4-methylphenoxy group;

(5) Alkyl Mercapto Group or Aryl Mercapto Group

Specific examples thereof include, but are not limited to, methylthio group, ethylthio group, phenylthio group, and p-methylphenylthio group;

(6)

Chemical formula 3

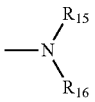

In Chemical formula 3, $R_{15}$ and $R_{16}$ independently represent hydrogen atom, the alkyl group defined in (2), or an aryl group. Specific examples of the aryl groups include, but are not limited to, phenyl group, biphenyl group, or naphtyl group. These can contain an alkoxy group having 1 to 4 carbon atoms, an alkyl group having 1 to 4 carbon atoms or a halogen atom as a substitution group. $R_{15}$ and $R_{16}$ can share a linkage to form a ring.

Specific examples thereof include, but are not limited to, amino group, diethyl amino group, N-methyl-N-phenyl amino group, N,N-diphenyl amino group, N,N-di(tolyl) amino group, dibenzyl amino group, piperidino group, morpholino group, and pyrrolidino group;

(7) Alkylene Dioxy Group or Alkylene Dithio Group such as Methylene Dioxy Group and Methylene Dithio Group; and (8) Substituted or Non-substituted Styryl Group, Substituted or Non-substituted β-phenyl Styryl Group, Diphenyl Aminophenyl Group, Ditolyl Aminophenyl Group, etc.

The arylene groups represented by $Ar_1$ and $Ar_2$ specified above are divalent groups derived from the aryl group represented by $Ar_3$ and $Ar_4$ mentioned above.

$X_{10}$ represents a single bond, a substituted or non-substituted alkylene group, a substituted or non-substituted cycloalkylene group, a substituted or non-substituted alkylene ether group, oxygen atom, sulfur atom, or vinylene group.

A straight chained or side chained alkyl group having 1 to 12, more preferably 1 to 8 and furthermore preferably from 1 to 4 carbons is preferably specified. These alkyl groups can have a fluorine atom, a hydroxyl group, an alkoxy group having 1 to 4 carbon atoms, a phenyl group or a phenyl group substituted by a halogen atom, an alkyl group having 1 to 4 carbon atoms or an alkoxy group having 1 to 4 carbon atoms.

Specific examples thereof include, but are not limited to, methylene group, ethylene group, n-butylene group, i-propylene group, t-butylene group, s-butylene group, n-propylene group, trifluoromethylene group, 2-hydroxy ethylene group, 2-ethoxyethylene group, 2-cyanoethylene group, 2-methoxyethylene group, benzylidene group, phenyl ethylene group, 4-chlorophenyl ethylene group, 4-methylpheny ethylene group, and 4-biphenyl ethylene group.

Specific examples of the substituted or non-substituted cycloalkylene groups include, but are not limited to, cyclic alkylene group having 5 to 7 carbon atoms. These cyclic alkylene groups can have a fluorine atom, a hydroxyl group, an alkyl group having 1 to 4 carbon atoms, and an alkoxy group having 1 to 4 carbon atoms.

Specific examples thereof include, but are not limited to, cyclohexylidene group, cyclohexylene group, and 3,3-dimethyl cyclohexylidene group.

Specific examples of the substituted or non-substituted alkylene ether groups include, but are not limited to, —$CH_2CH_2O$—, —$CH_2CH_2CH_2O$—, —$(OCH_2CH_2)$h-O—, and —$(OCH_2CH_2CH_2)$i-O—.

In these alkylene ether groups, h and i independently represent an integer of from 1 to 4.

These alkylene ether groups can have a substitution group such as hydroxyl group, methyl group or ethyl group.

The vinylene group is represented by the following chemical formula 4 or 5.

Chemical formula 4

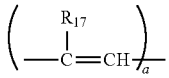

Chemical formula 5

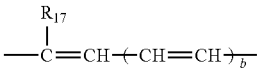

In the chemical formula 4 or 5, $R_{17}$ represents hydrogen or an alkyl group (the same as the alkylene groups defined in (2)), a represents 1 or 2 and b is an integer of from 1 to 3.

The Z represents a substituted or non-substituted alkylene group, a substituted or non-substituted alkylene ether group or an alkyleneoxy carbonyl group.

Specific examples of the substituted or non-substituted alkylene groups include the same as those mentioned for the X mentioned above.

Specific examples of the substituted or non-substituted alkylene ether groups include the same as those mentioned for the X mentioned above.

A specific example of the alkyleneoxy carbonyl group includes a caprolactone modified group.

The compound represented by the following chemical structure 3 is a further suitably preferable radical polymerizable compound having one functional group with a charge transport structure.

Chemical structure 3

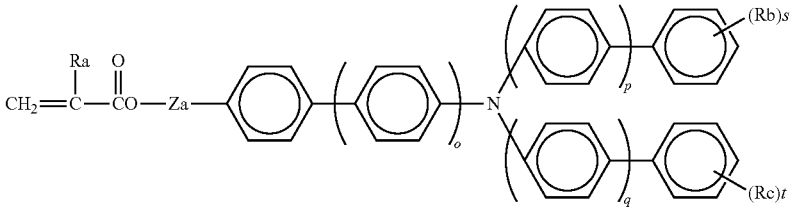

In the chemical structure 3, "o", "p", "q", each, independently, represent 0 or 1, s and t each, independently, represent 0 or an integer of from 1 to 3, Ra represents hydrogen atom or methyl group, Rb and Rc, each, independently, represent an alkyl group (excluding hydrogen atom) having 1 to 6 carbon atoms. Za represents a single bond, methylene group, ethylene group, —$CH_2CH_2O$—, —$CHCH_3CH_2O$—, or —$C_6H_5CH_2CH_2$—.

Among the compounds represented by the chemical structure 3 illustrated above, the compounds having a methyl group or an ethyl group as a substitution group of Rb and Rc are particularly preferred.

The cross-linked surface layer formed in the present invention is free from cracking and has excellent electric characteristics. The reason is that the radical polymerizable compound (monomer) having one functional group with a charge transport structure for use in the present invention represented by the chemical structures 1, 2, or particularly 3, is polymerized in a manner that both sides of the carbon-carbon double bond are open. Therefore, the radical polymerizable compound does not constitute an end of the structure but is set in a chained polymer. The polymerizable compound having one functional group is present in the main chain of a polymer in which cross-linking is formed by polymerization with a radical polymerizable monomer having at least three functional groups or a cross-linking chain between main chains. There are two kinds of the cross-linking chains. One is the cross-linking chain between a polymer and another polymer, and the other is the cross-linking chain formed by cross-linking a portion in the main chain present in a folded state in a polymer with a moiety deriving from a monomer polymerized away from the portion. Regardless of whether or not the radical polymerizable compound having a functional group with a charge transport structure is present in the main chain or in the cross-linking chain, the triaryl amine structure suspends from the chain portion. The triaryl amine structure has at least three aryl groups disposed in the radial directions relative to the nitrogen atom therein. Such a triaryl amine structure is bulky but does not directly joint with the chain portion and suspends from the chain portion via the carbonyl group, etc. That is, the triaryl amine structure is stereoscopically fixed in a flexible state. Therefore, these triaryl amine structures can be adjacent to each other with a moderate space in the polymer. Therefore, the structural distortion in the molecule is slight. In addition, the surface layer of a photoreceptor having such a structure is deduced to have an internal molecular structure with relatively few disconnections in the charge transport route.

Specific examples of the radical polymerizable monomer having one functional group with a charge transport structure include, but are not limited to, the following compounds, but are not limited thereto.

No. 1

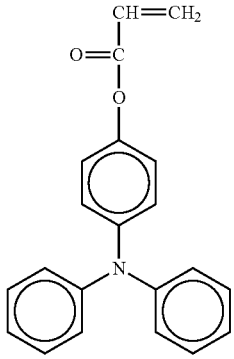

No. 2

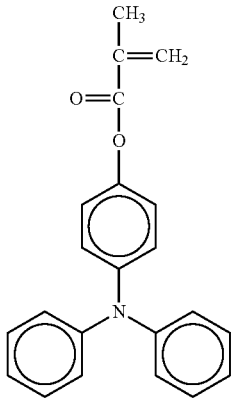

-continued
No. 3
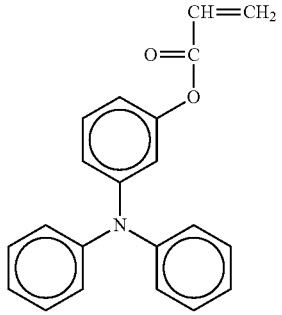
No. 4
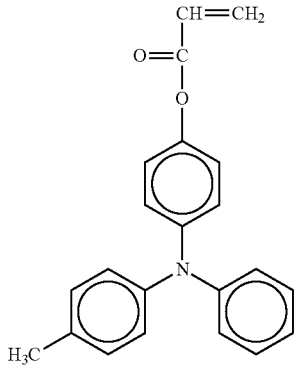
No. 5
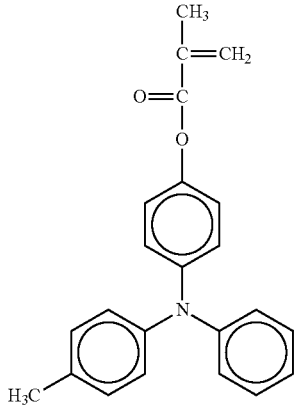
No. 6
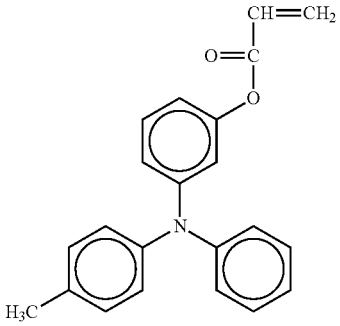

-continued
No. 7
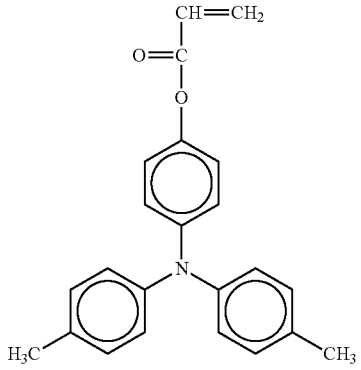
No. 8
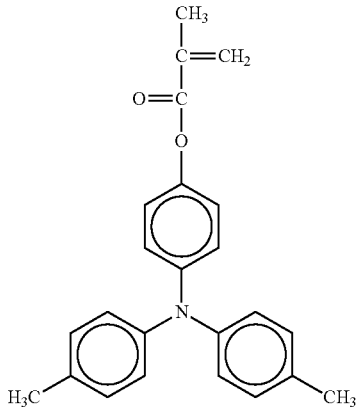
No. 9
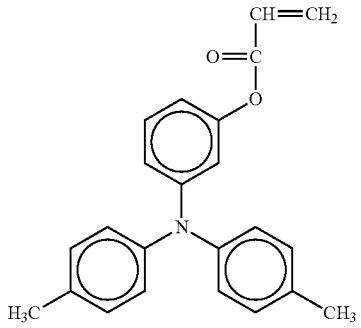
No. 10
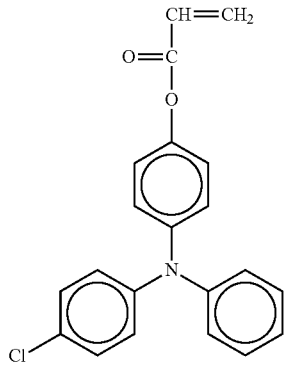

-continued
No. 11
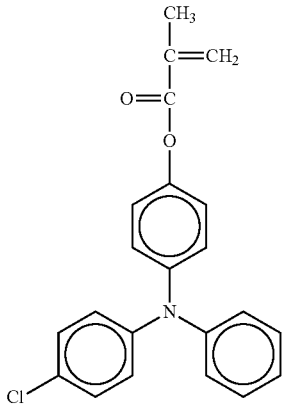
No. 12
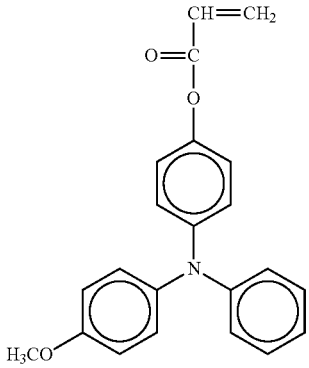
No. 13
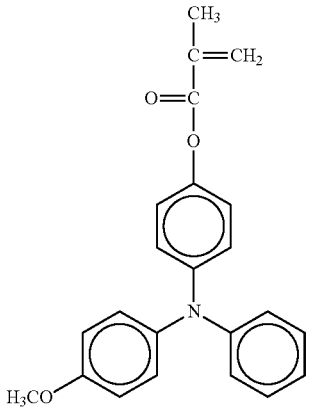
No. 14
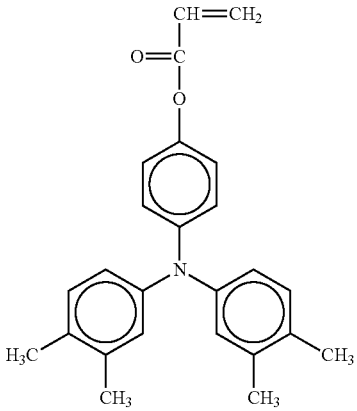

-continued
No. 15
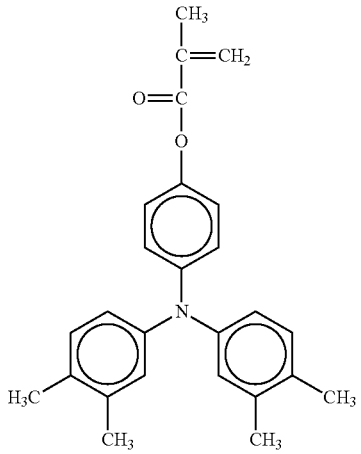
No. 16
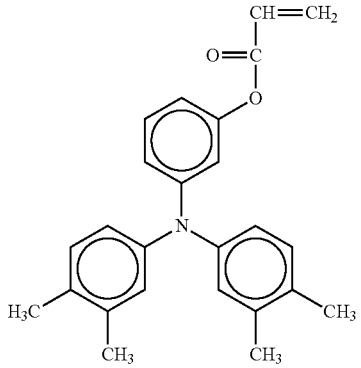
No. 17
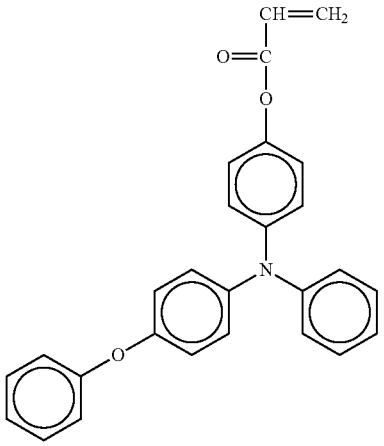
No. 18
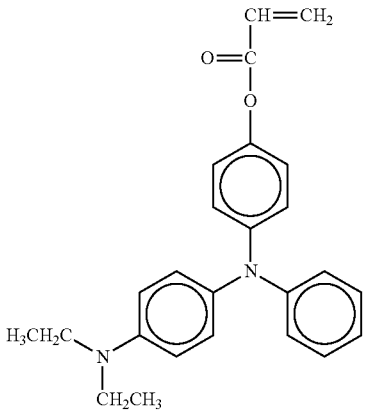

-continued
No. 19
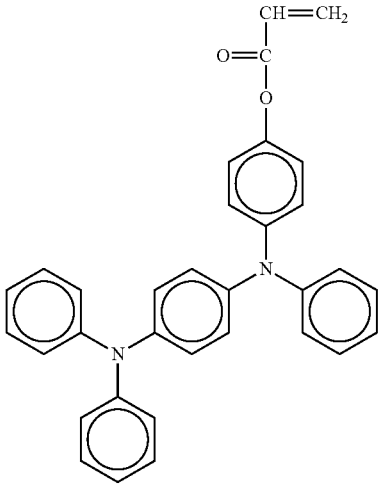
No. 20
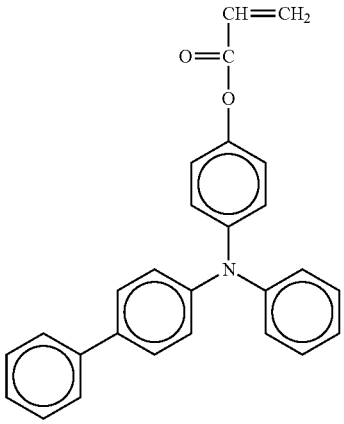
No. 21
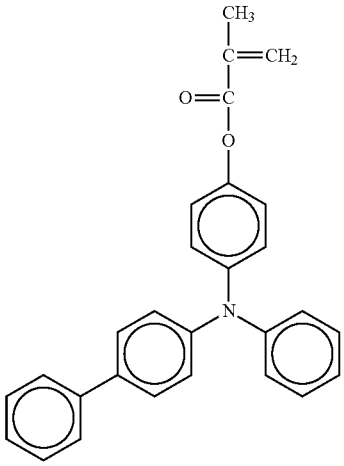

-continued
No. 22
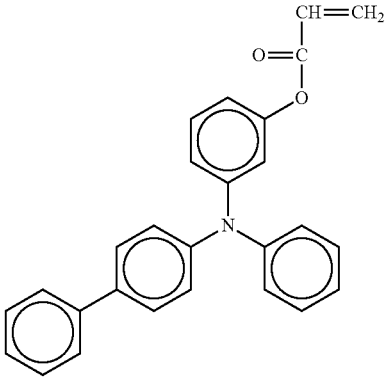
No. 23
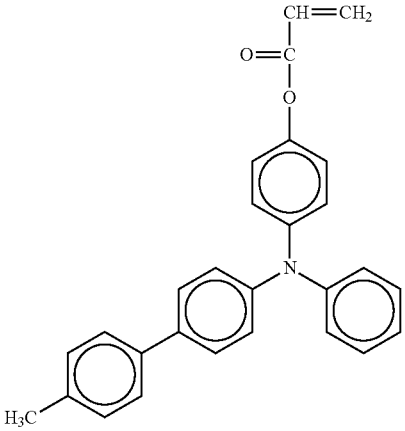
No. 24
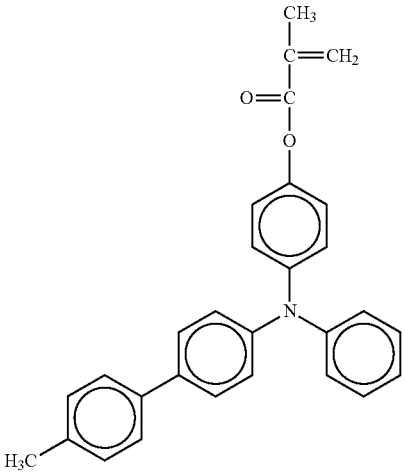

-continued
No. 25
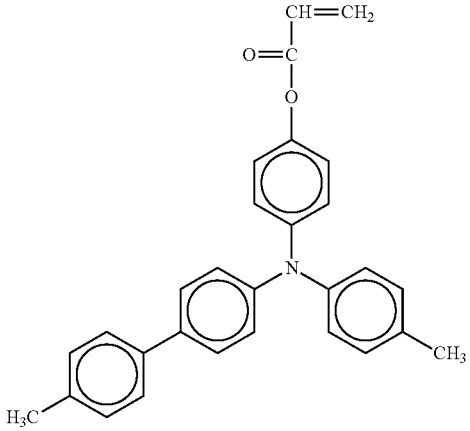
No. 26
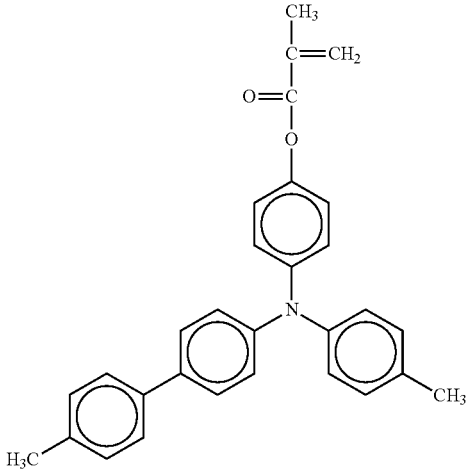
No. 27
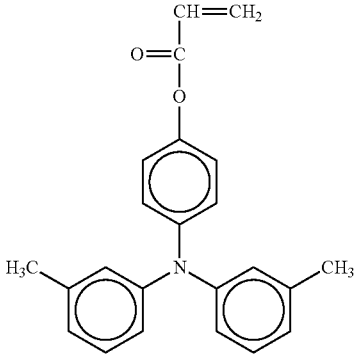
No. 28
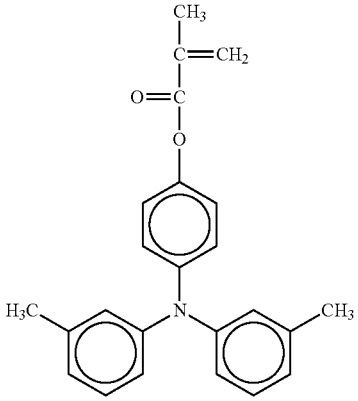

-continued
No. 29
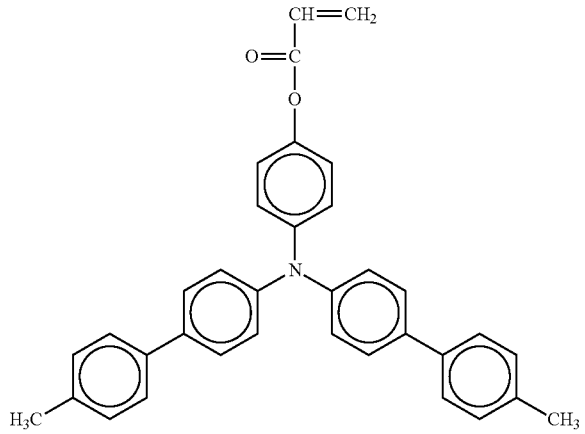
No. 30
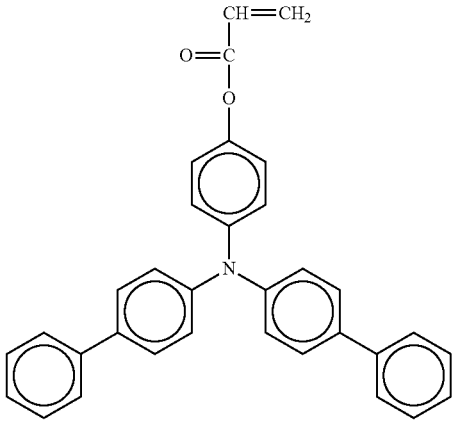
No. 31
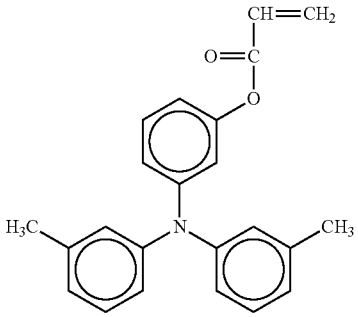
No. 32
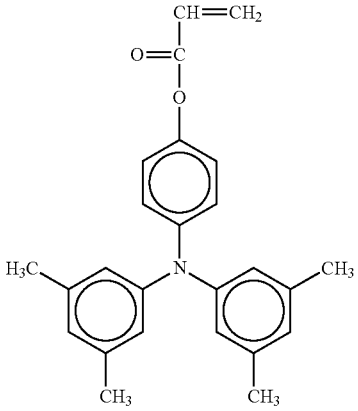

-continued
No. 33
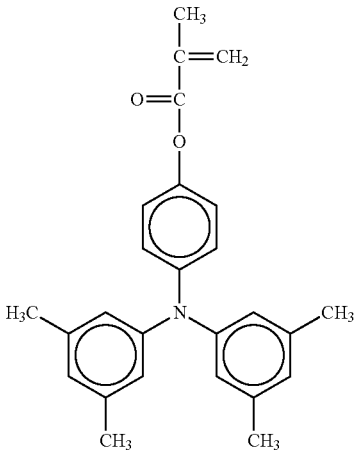
No. 34
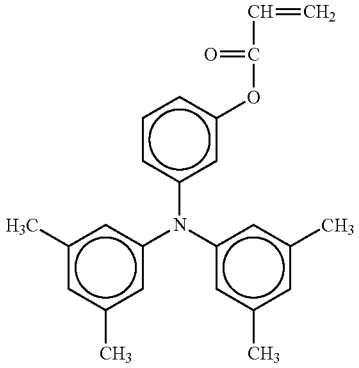
No. 35
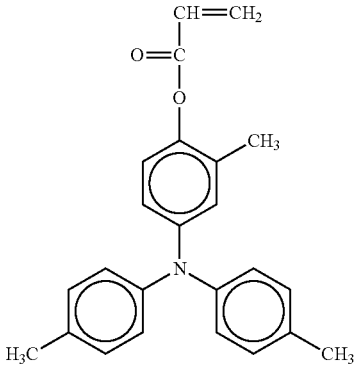
No. 36
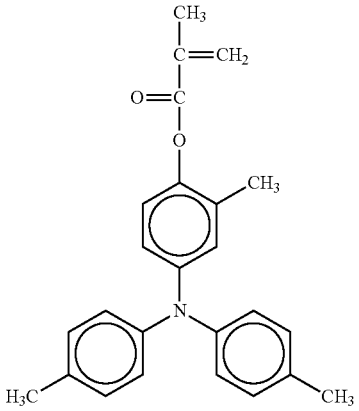

-continued
No. 37
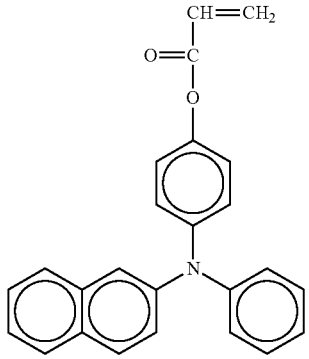
No. 38
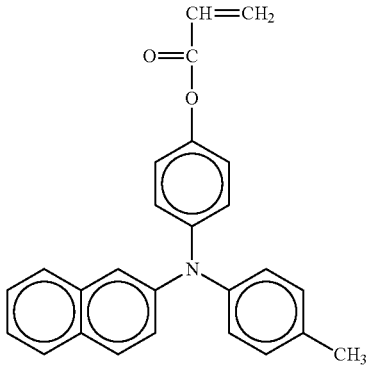
No. 39
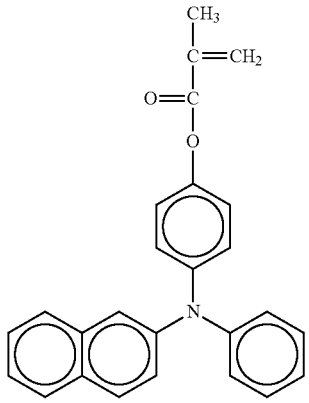
No. 40
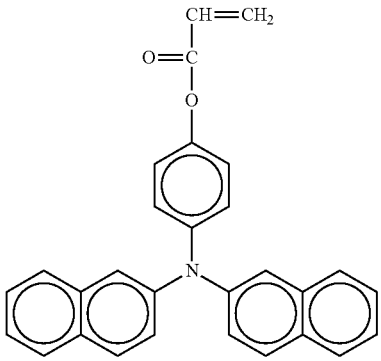

-continued
No. 41
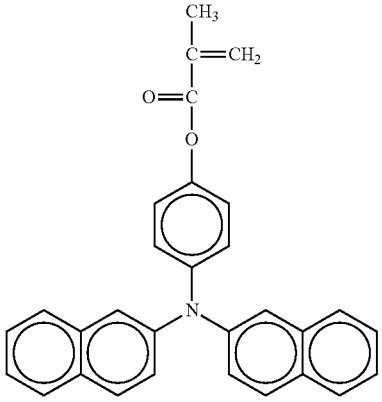
No. 42
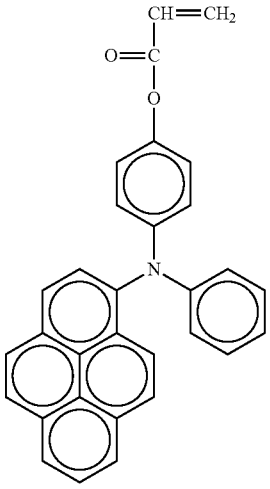
No. 43
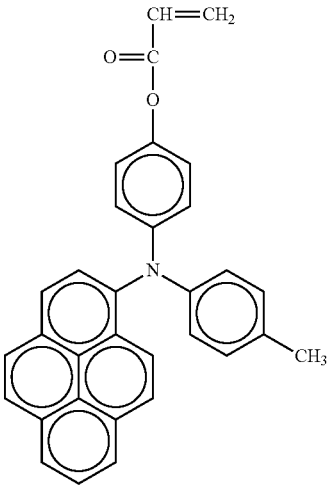

-continued
No. 44
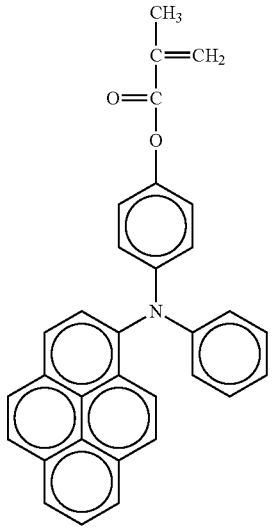
No. 45
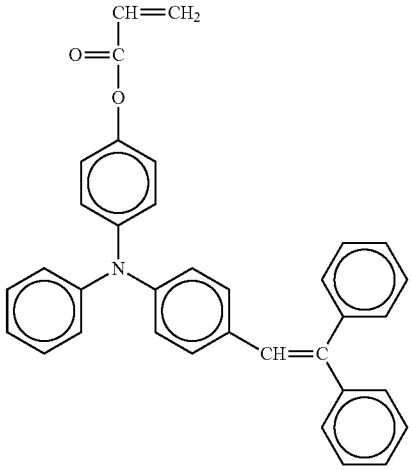
No. 46
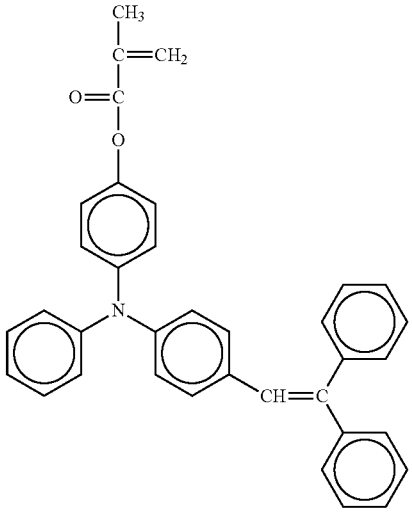

-continued
No. 47
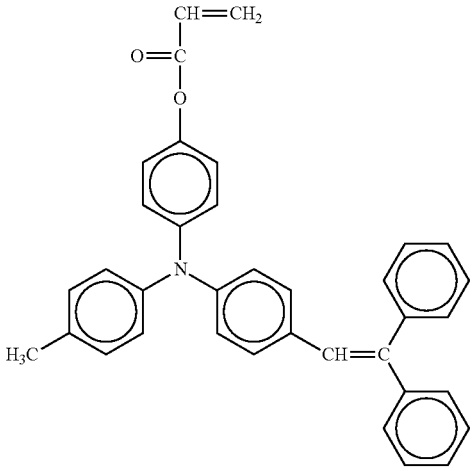
No. 48
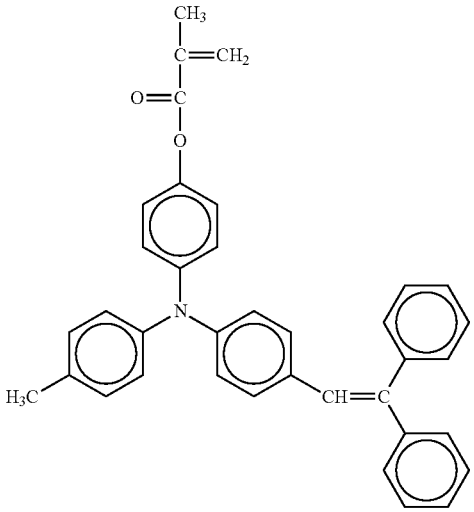
No. 49
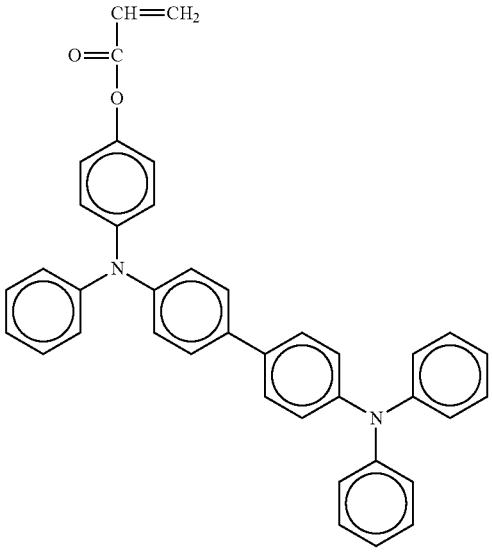

-continued
No. 50
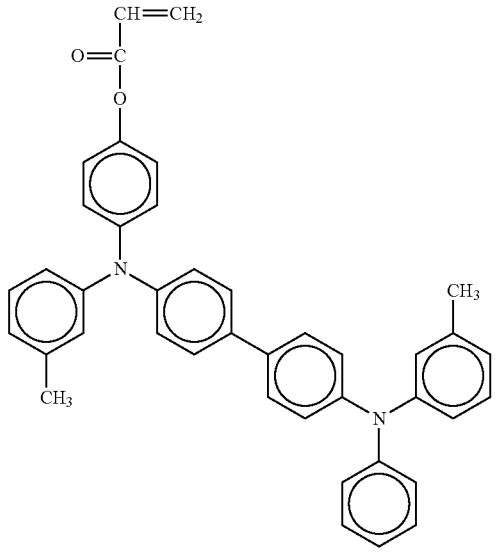
No. 51
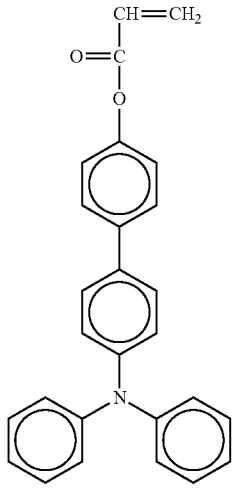
No. 52
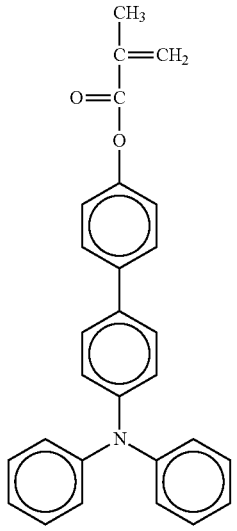

-continued
No. 53
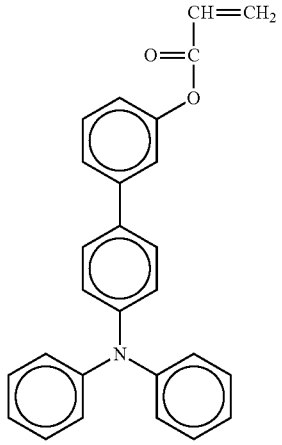
No. 54
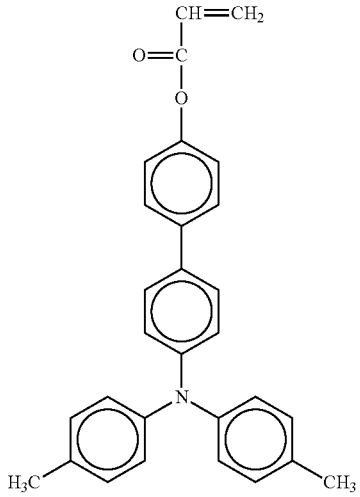
No. 55
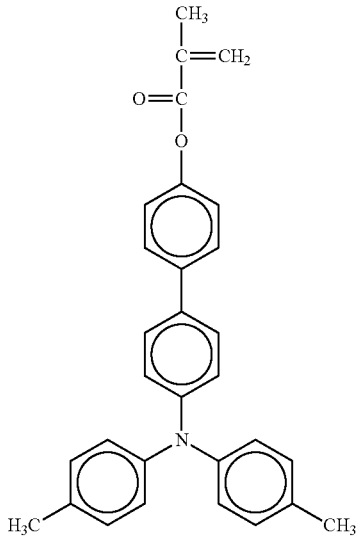

-continued
No. 56
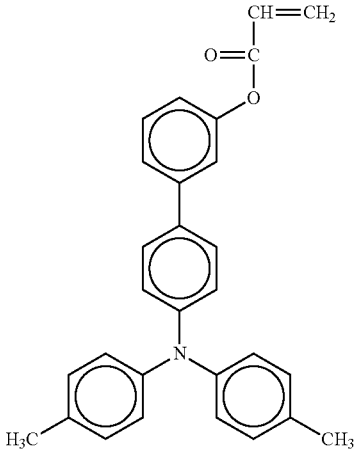
No. 57
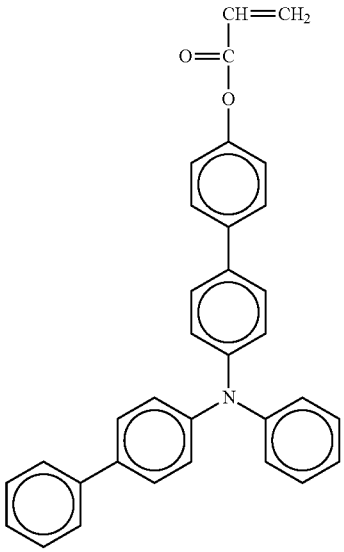
No. 58
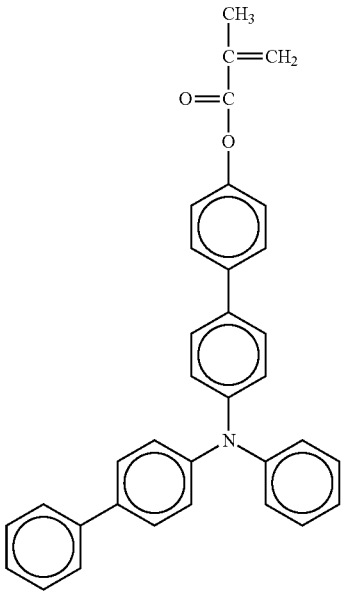

-continued
No. 59
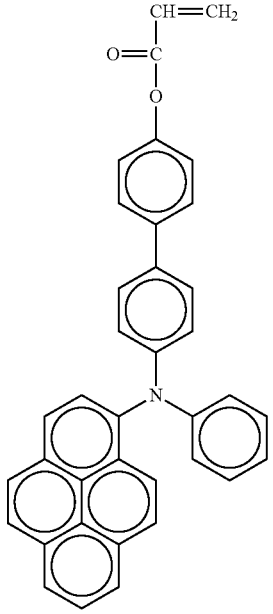
No. 60
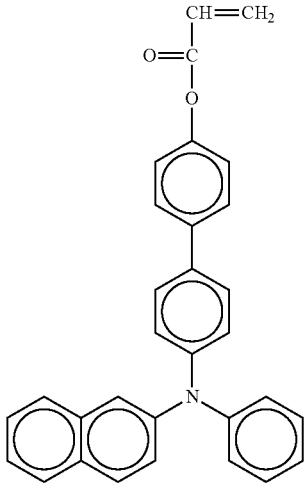
No. 61
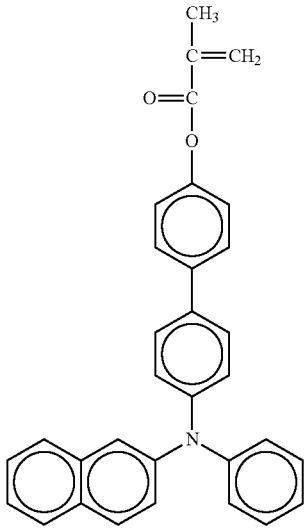

-continued
No. 62
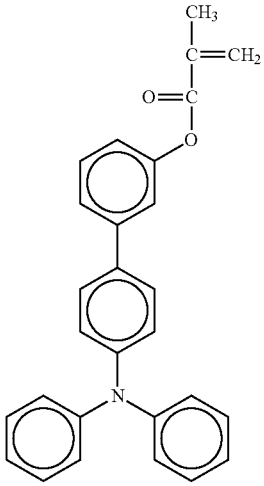
No. 63
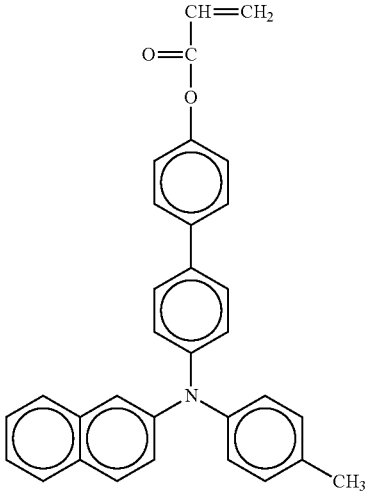
No. 64
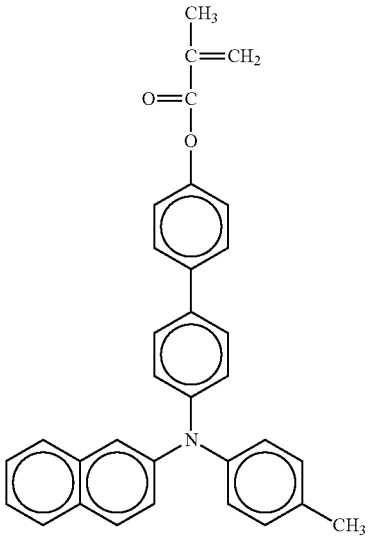

-continued
No. 65
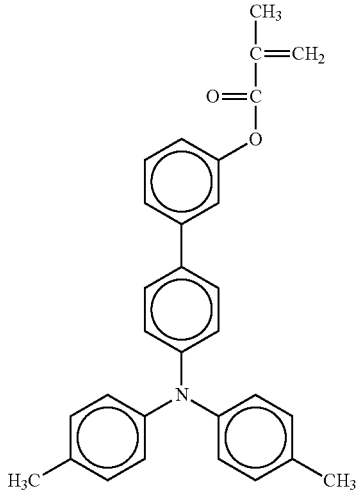
No. 66
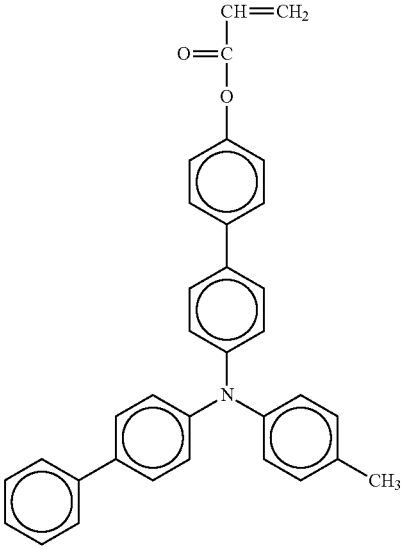
No. 67
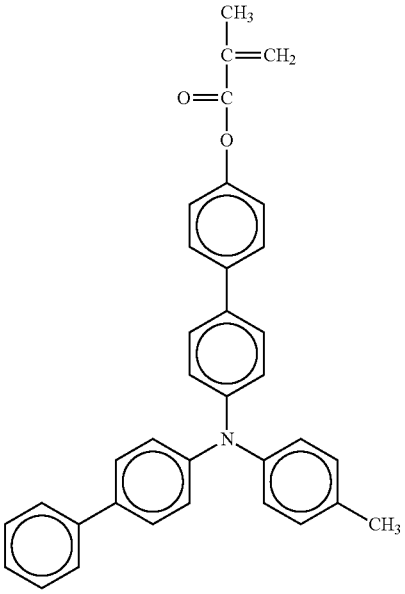

-continued
No. 68
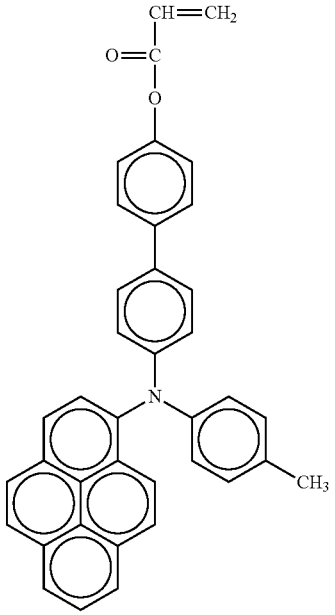
No. 69
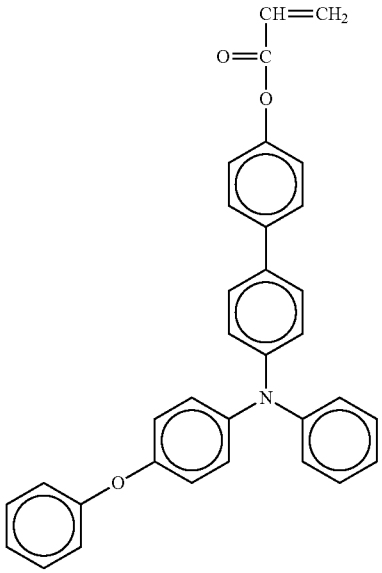

-continued
No. 70
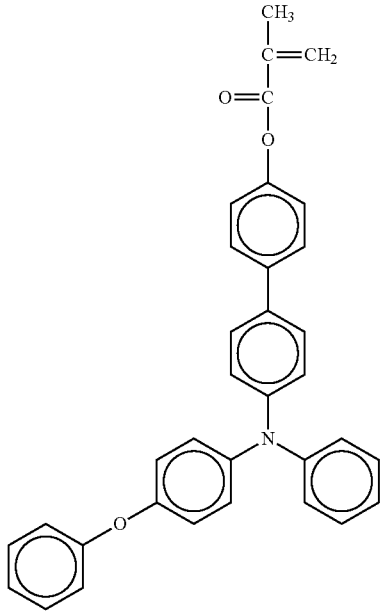
No. 71
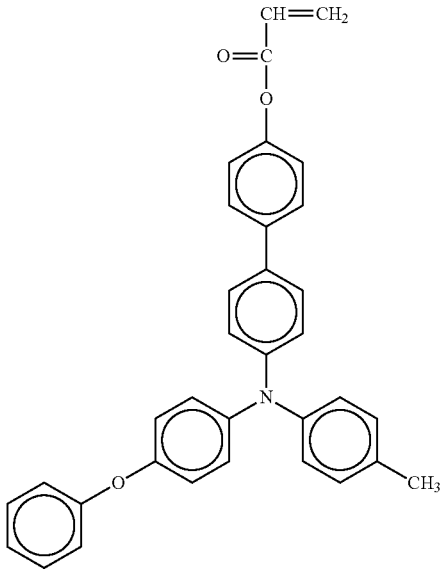

-continued
No. 72
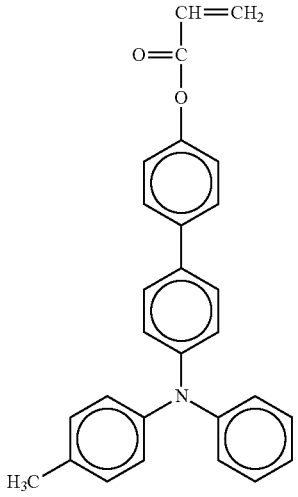
No. 73
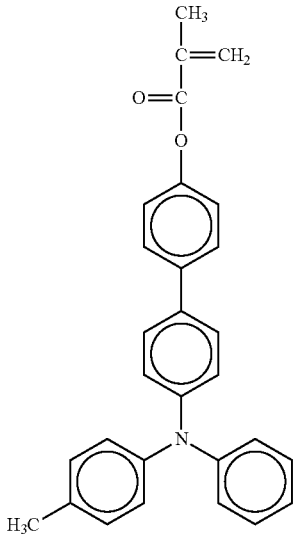
No. 74
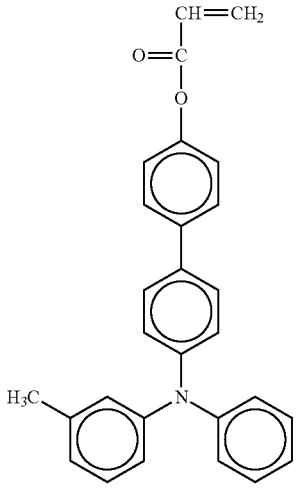

-continued
No. 75
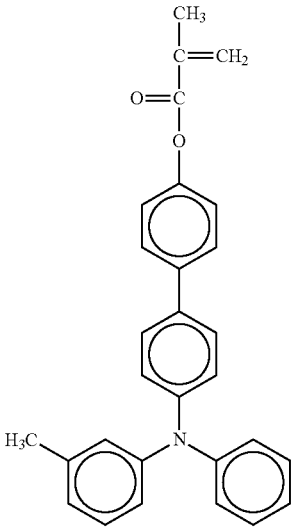
No. 76
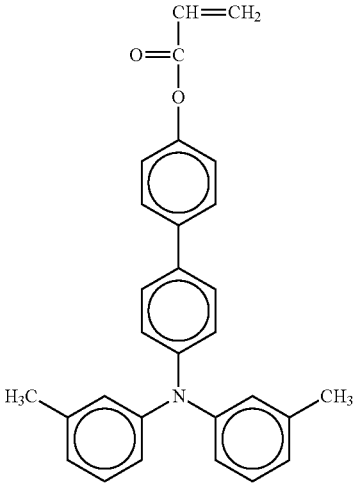
No. 77
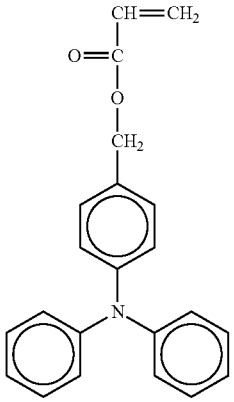

-continued
No. 78
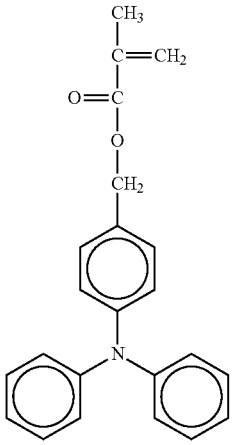
No. 79
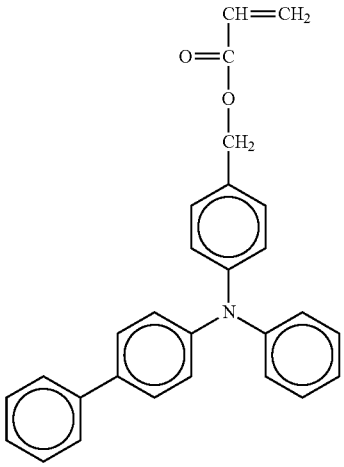
No. 80
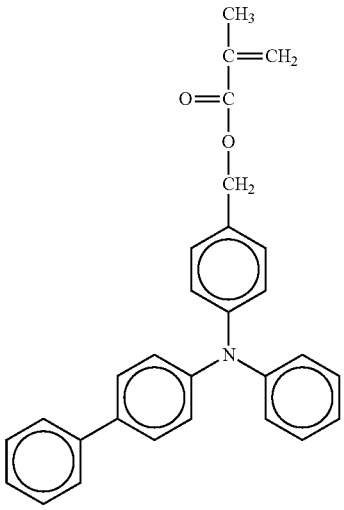

-continued
No. 81
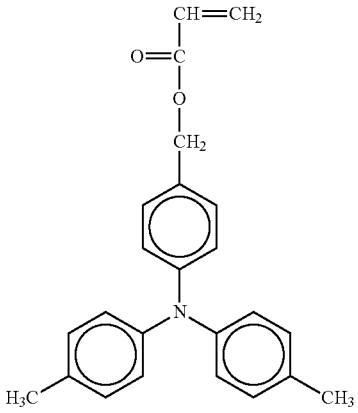
No. 82
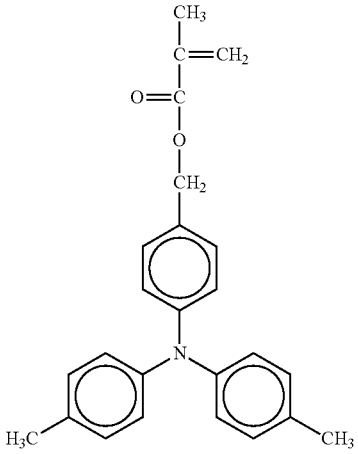
No. 83
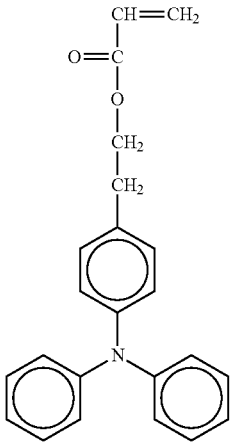

-continued
No. 84
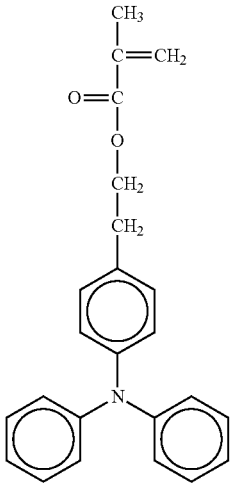
No. 85
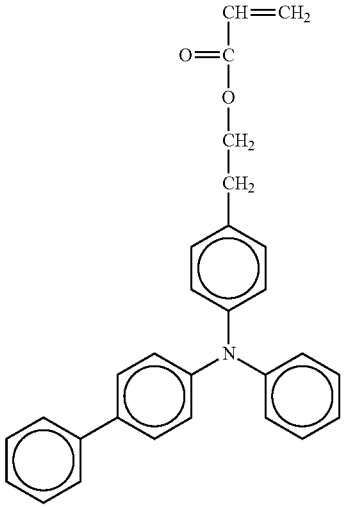
No. 86
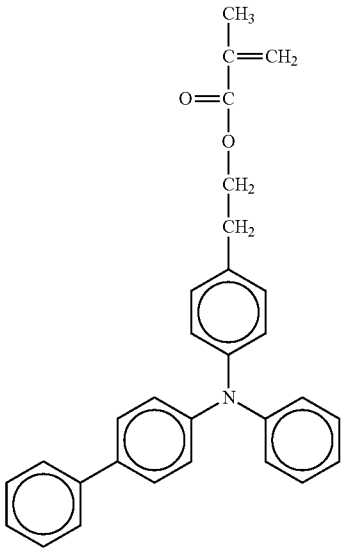

-continued
No. 87
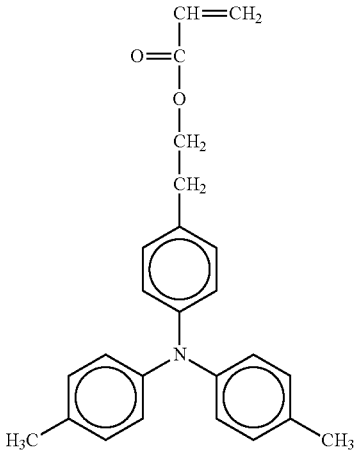
No. 88
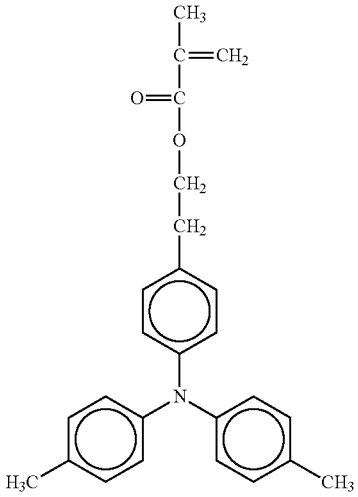
No. 89
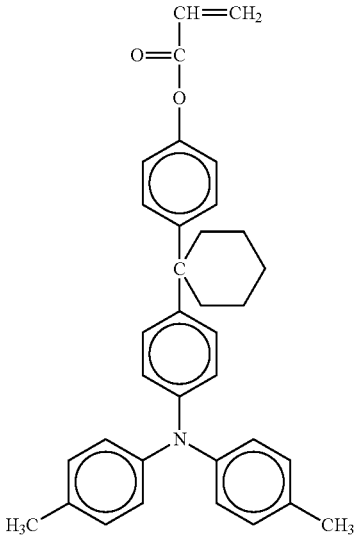

-continued
No. 90
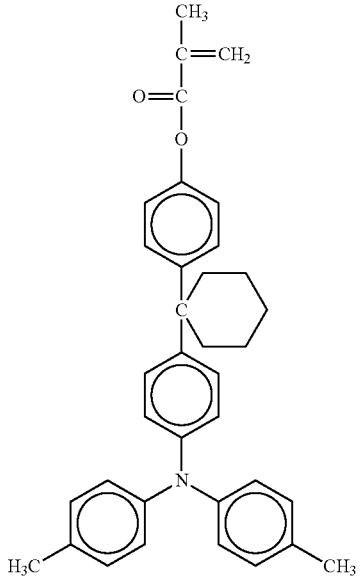
No. 91
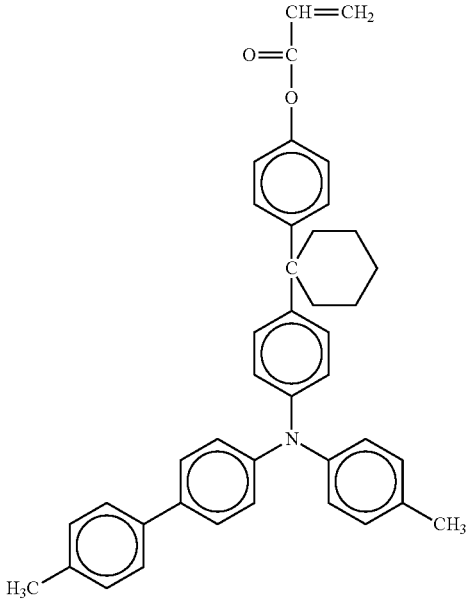

-continued
No. 92
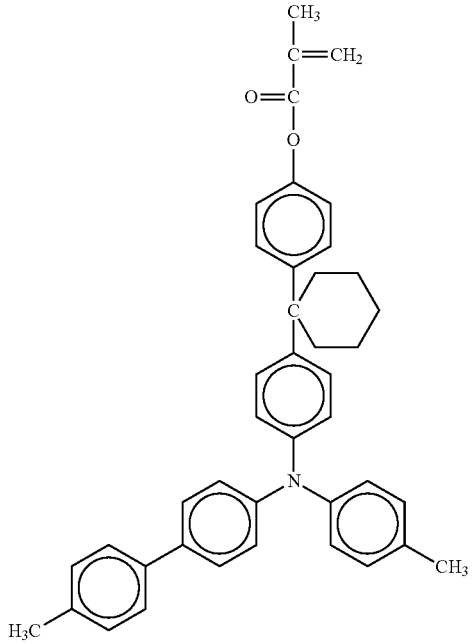
No. 93
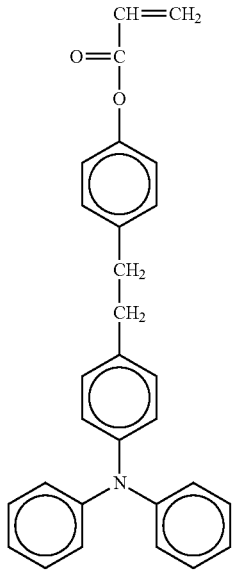

-continued
No. 94
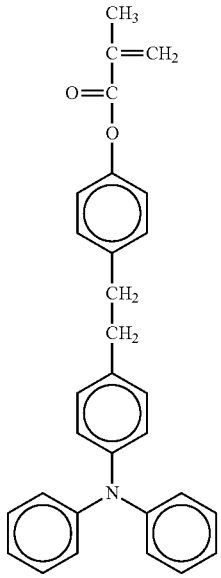
No. 95
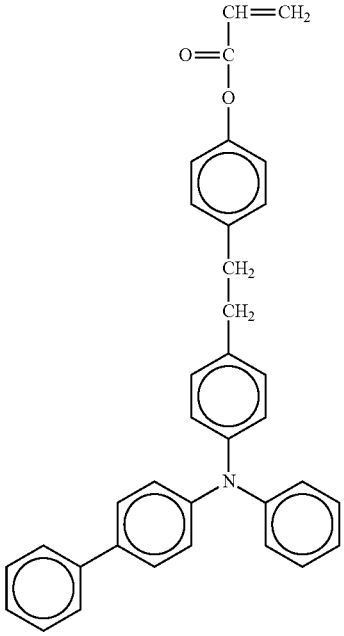

-continued
No. 96
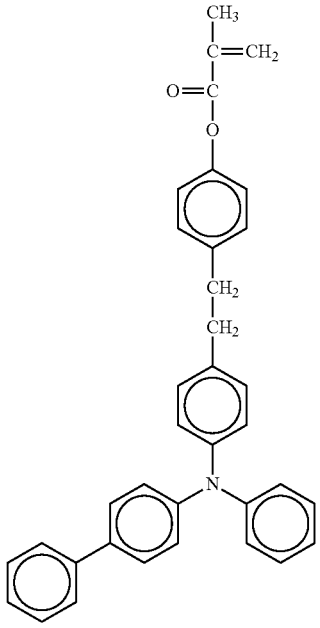
No. 97
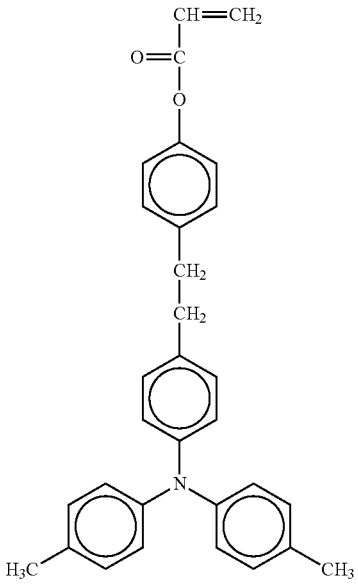

-continued
No. 98
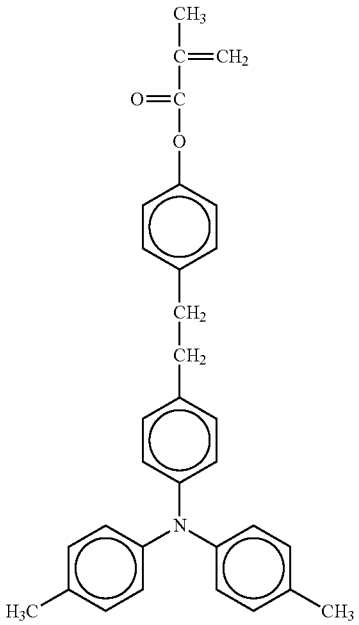
No. 99
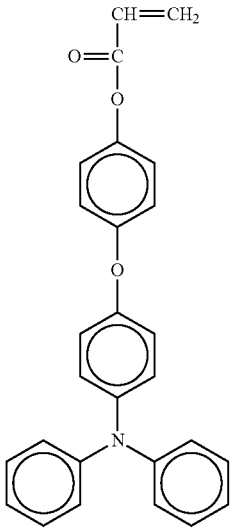

-continued
No. 100
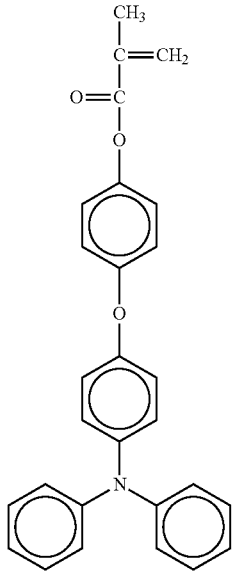
No. 101
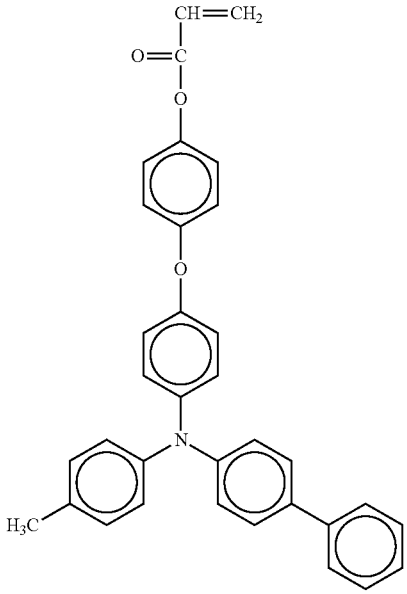

-continued
No. 102
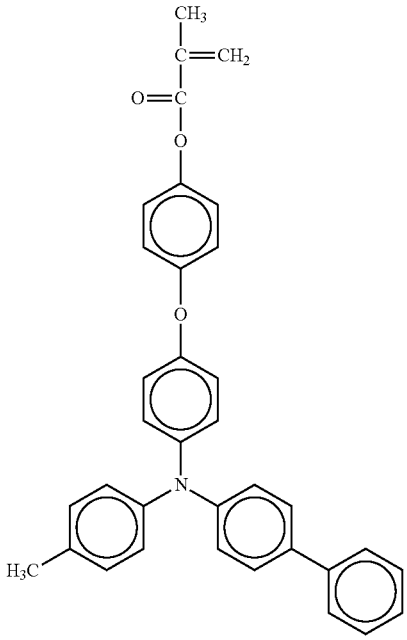
No. 103
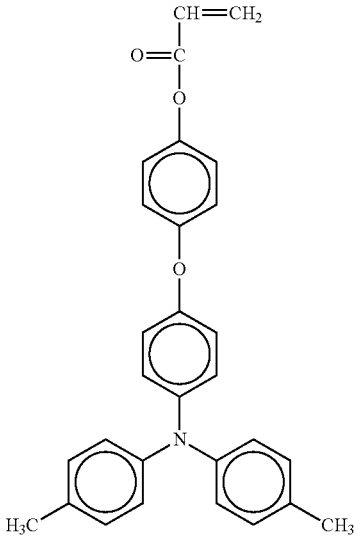

-continued
No. 104
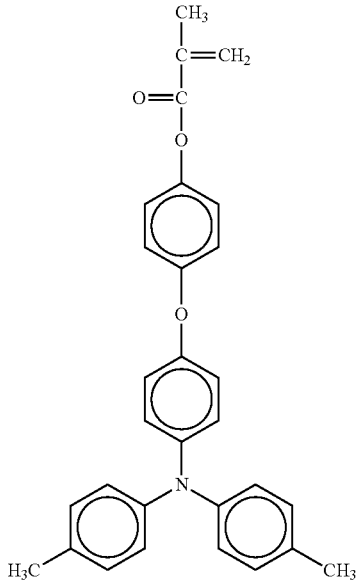
No. 105
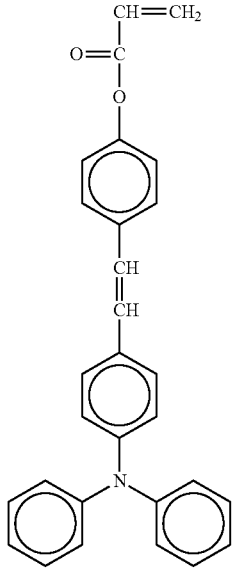

-continued
No. 106
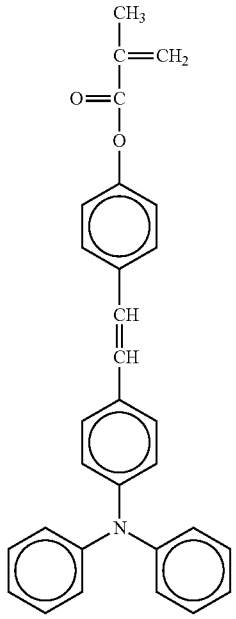
No. 107
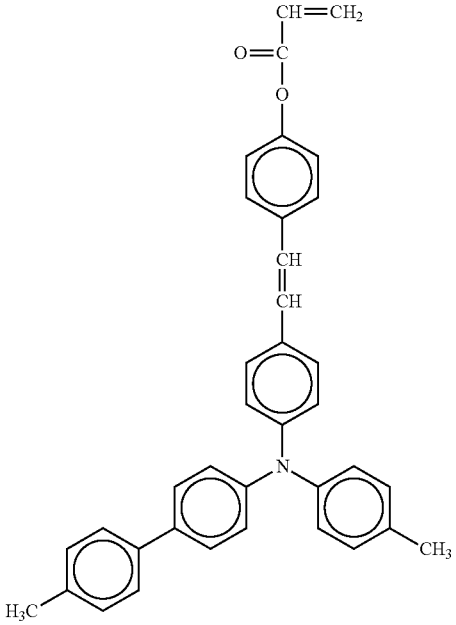

-continued
No. 108
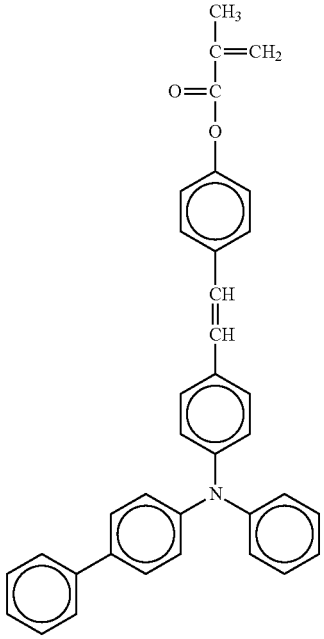
No. 109
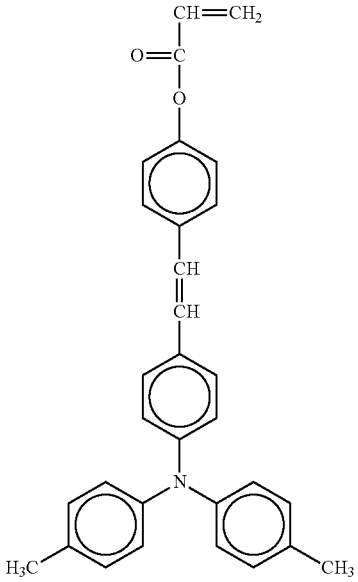

-continued
No. 110
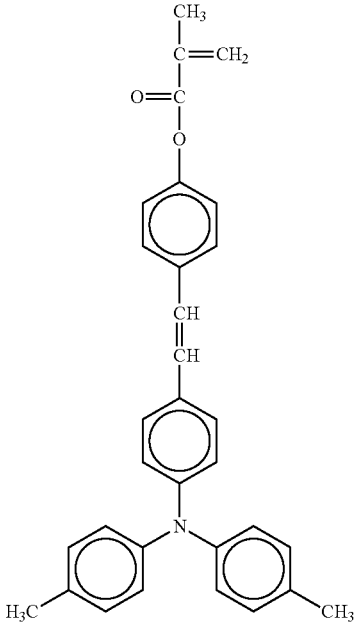
No. 111
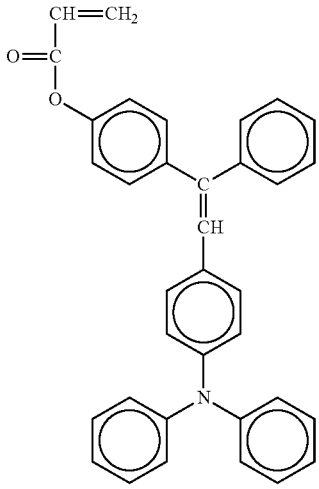
No. 112
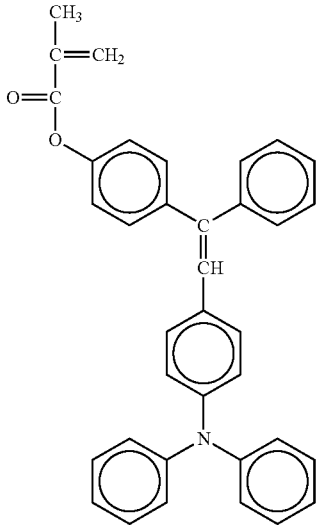

-continued
No. 113
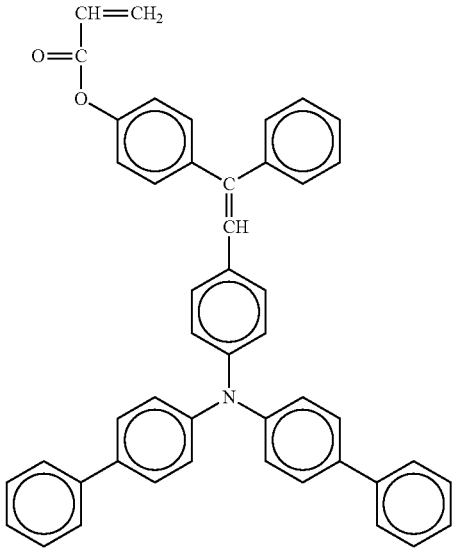
No. 114
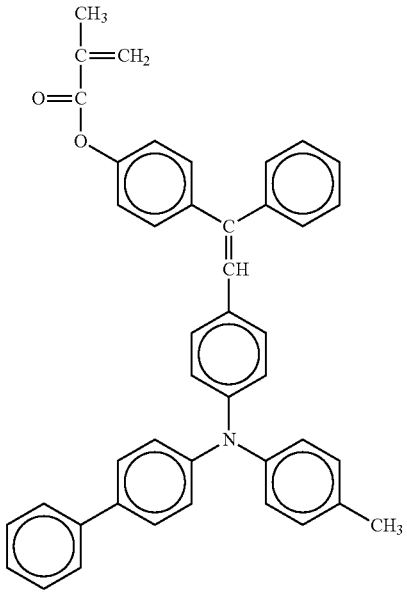
No. 115
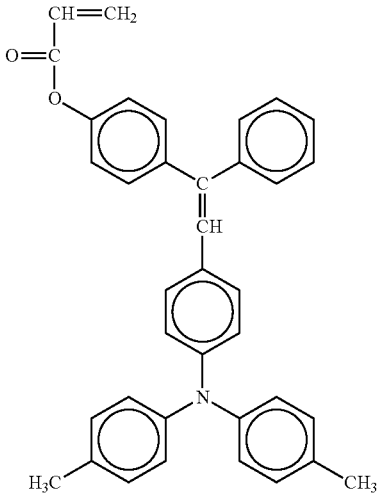

-continued
No. 116
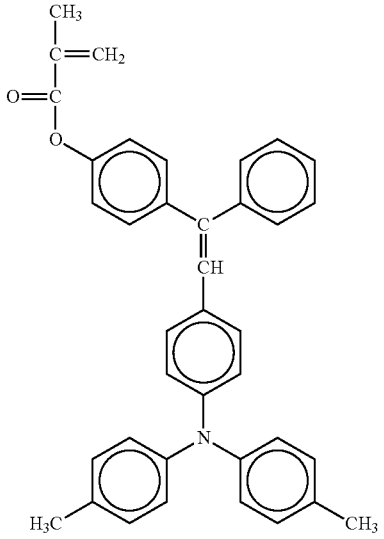
No. 117
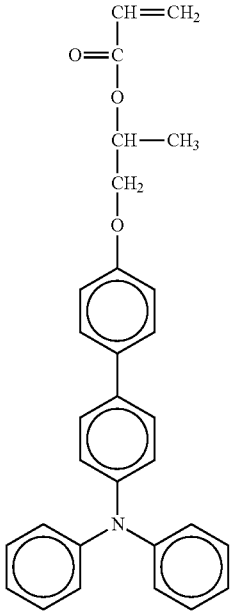

-continued
No. 118
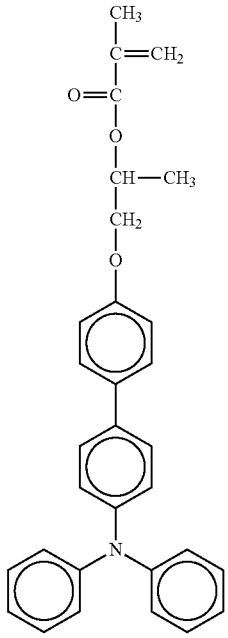
No. 119
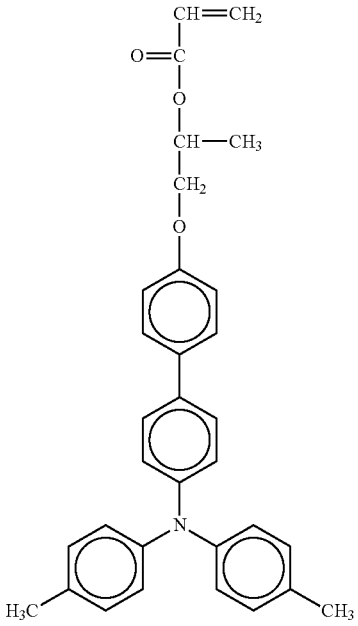

-continued
No. 120
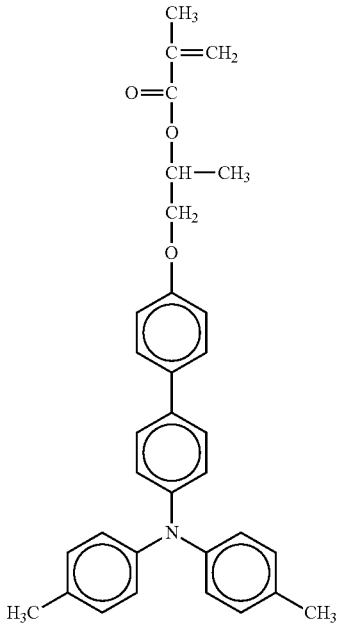
No. 121
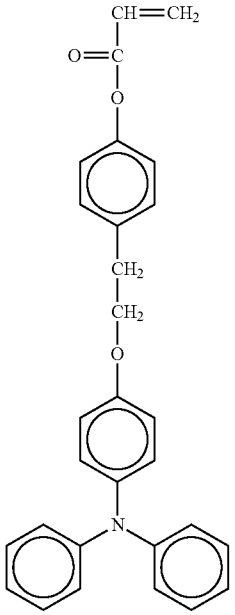

-continued
No. 122
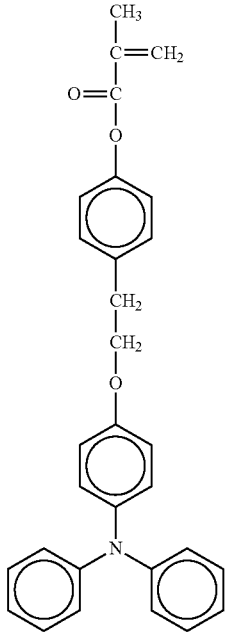
No. 123
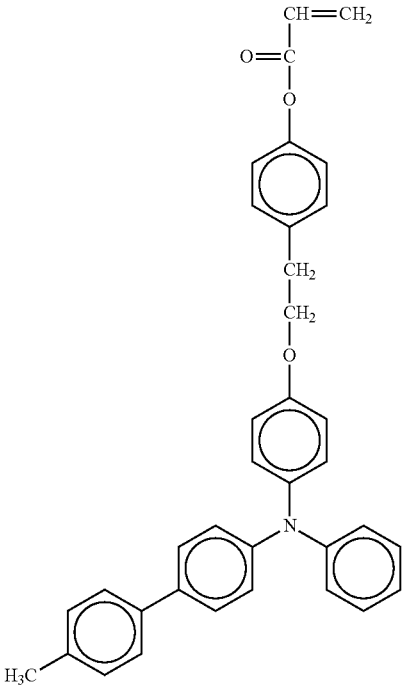

-continued
No. 124
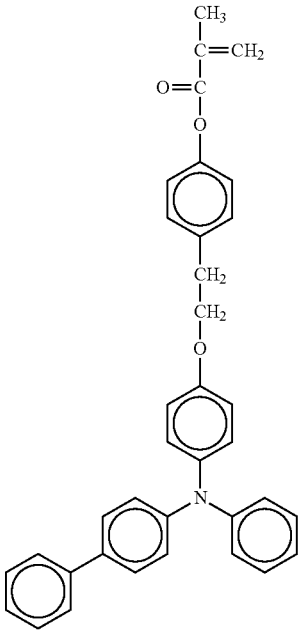
No. 125
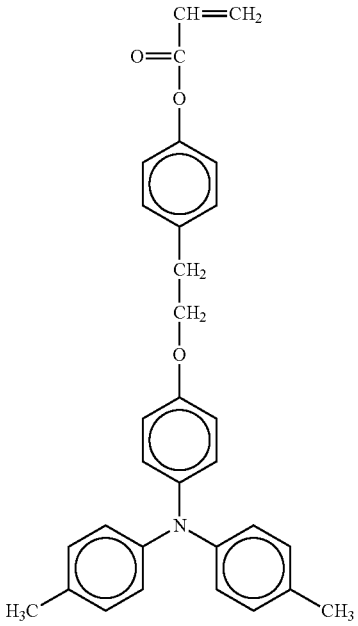

-continued
No. 126
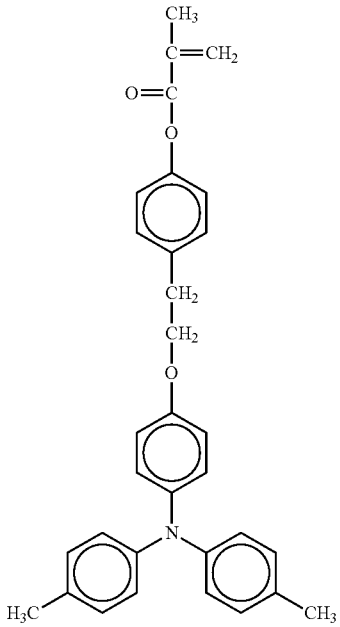
No. 127
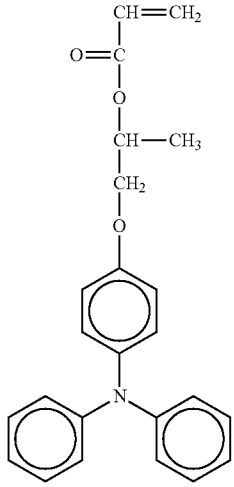
No. 128
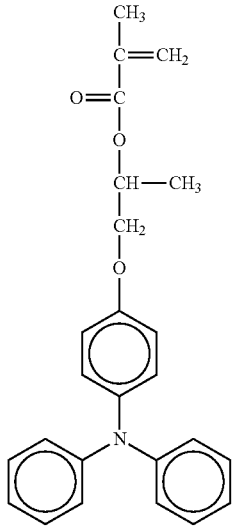

-continued
No. 129
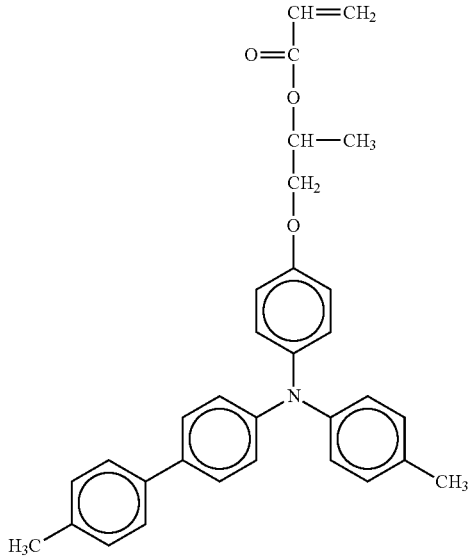
No. 130
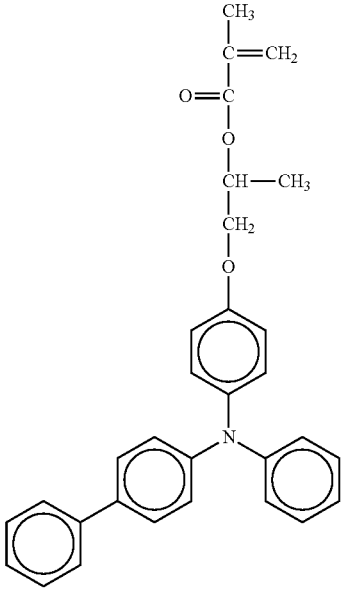
No. 131
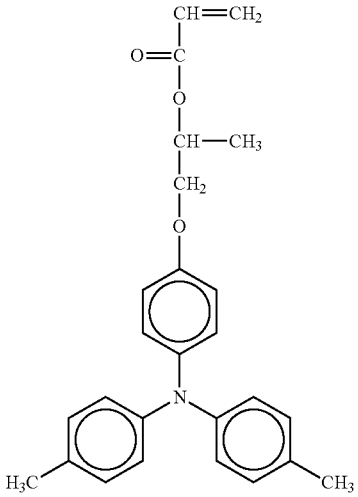

-continued
No. 132
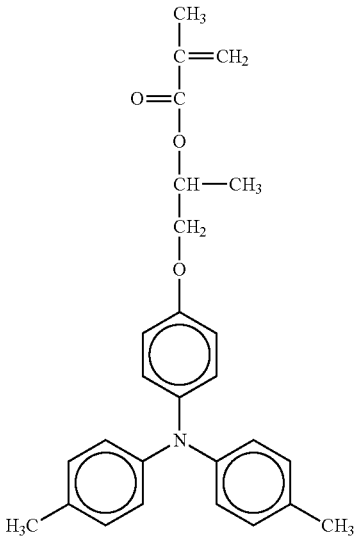
No. 133
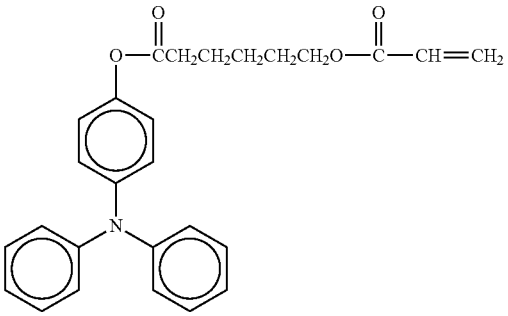
No. 134
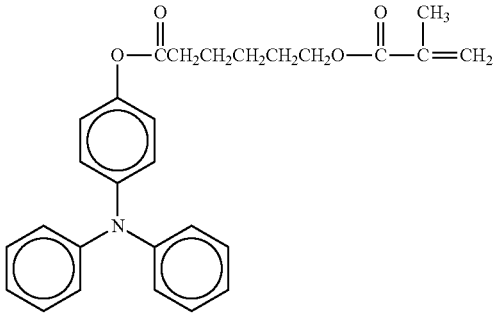
No. 135
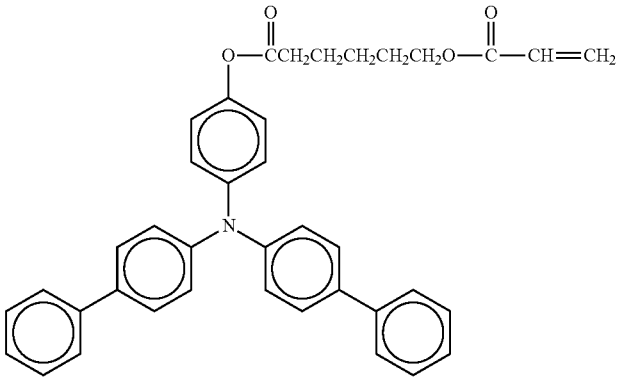

-continued
No. 136
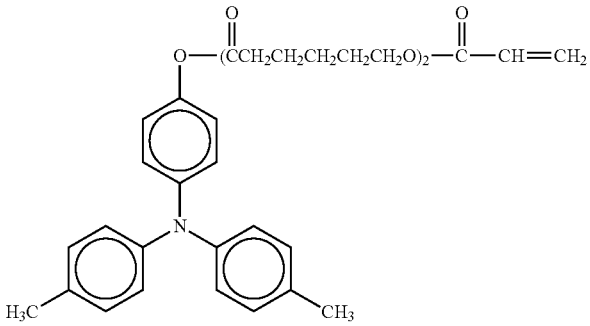
No. 137
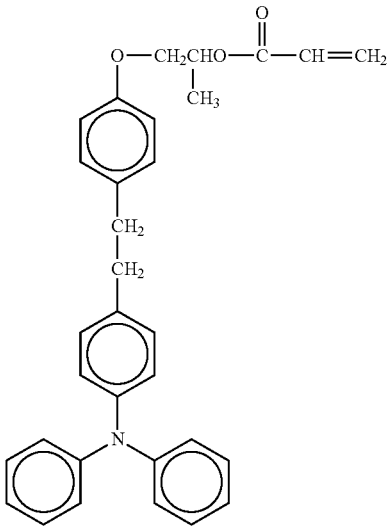
No. 138
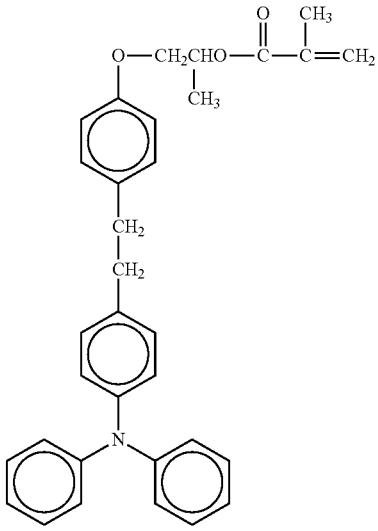

-continued
No. 139
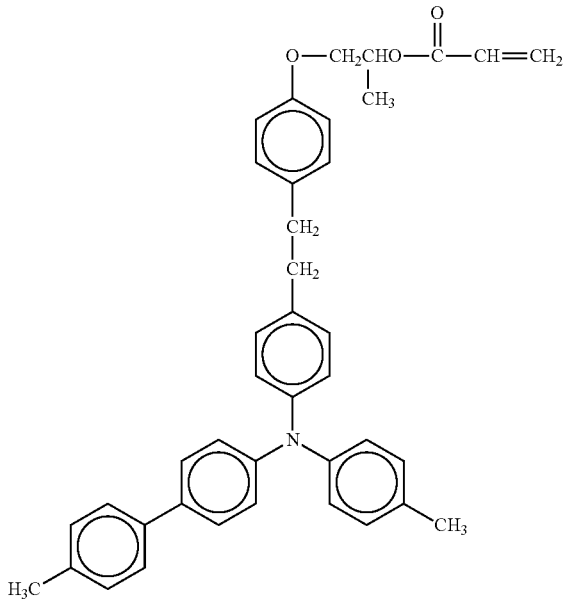
No. 140
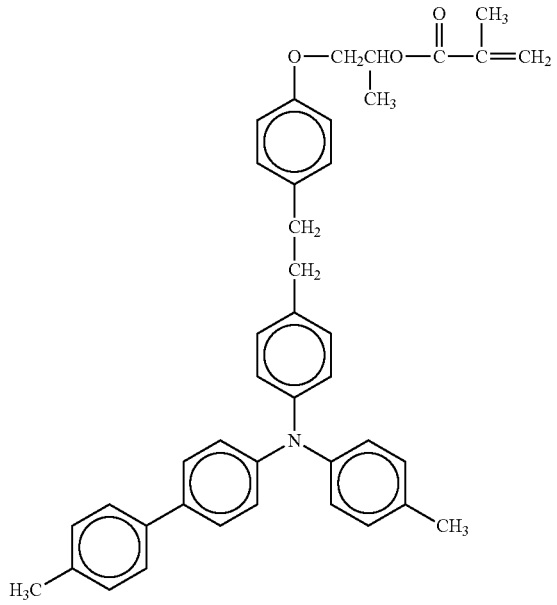

-continued
No. 141
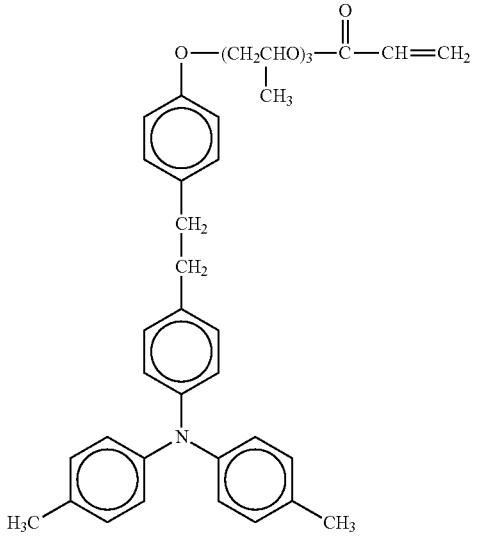
No. 142
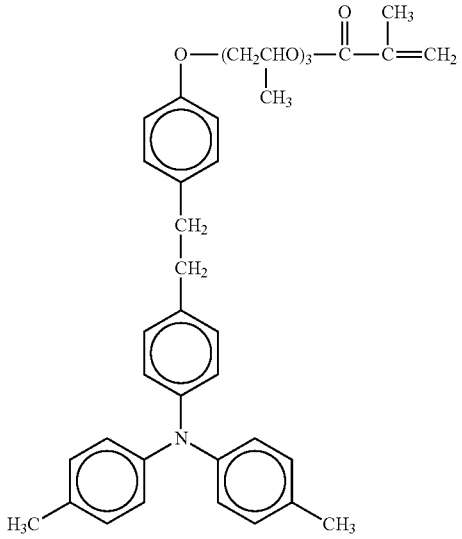
No. 143
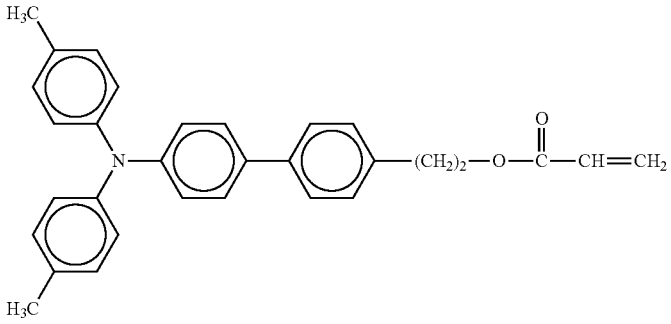

-continued
No. 144
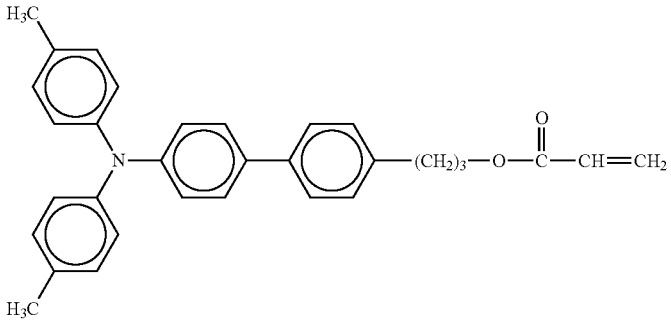
No. 145
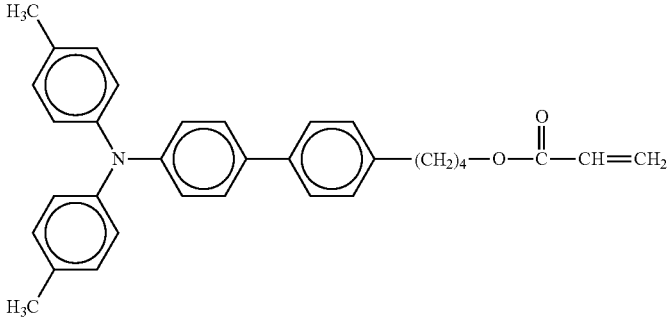
No. 146
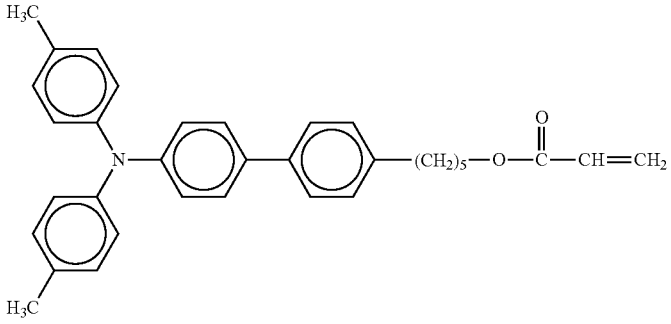
No. 147
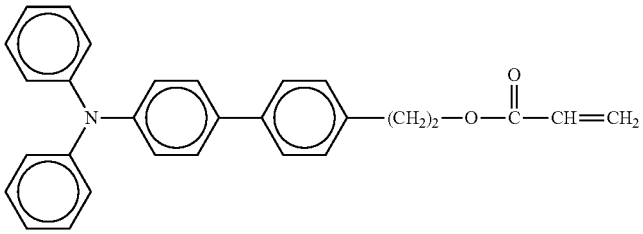
No. 148
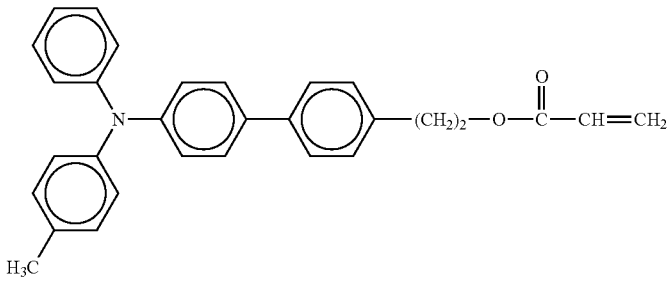

-continued
No. 149
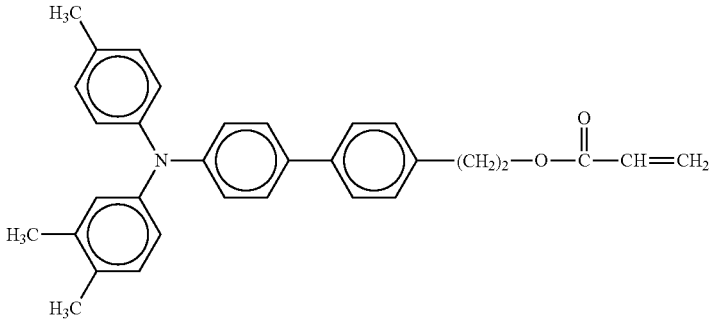
No. 150
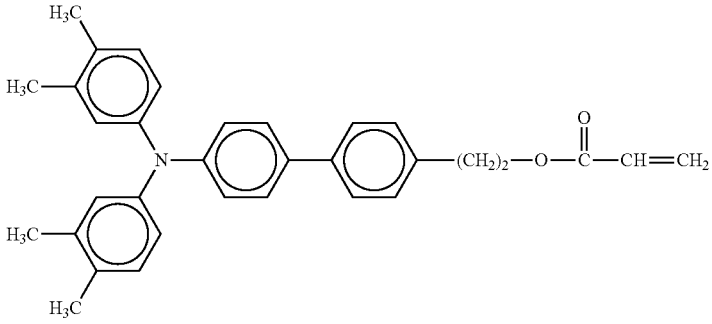
No. 151
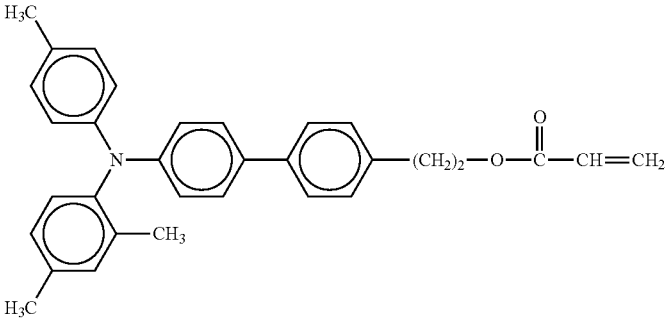
No. 152
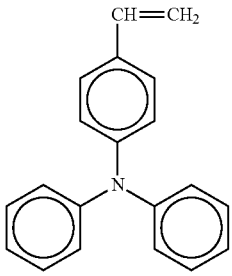
No. 153
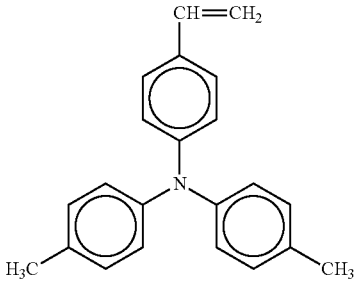

-continued
No. 154
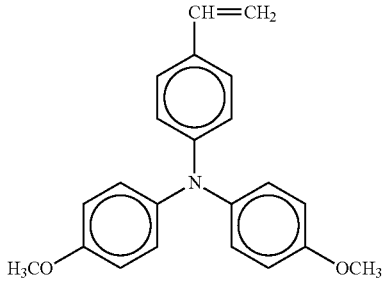
No. 155
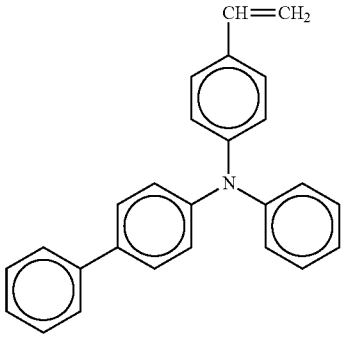
No. 156
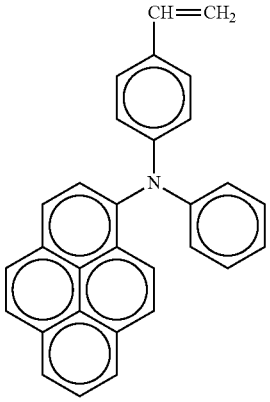
No. 157
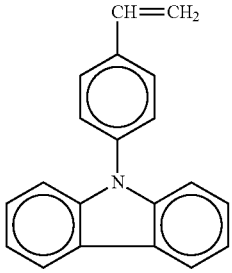
No. 158
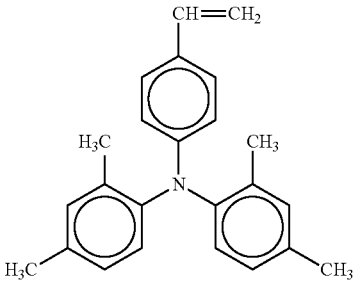

-continued
No. 159
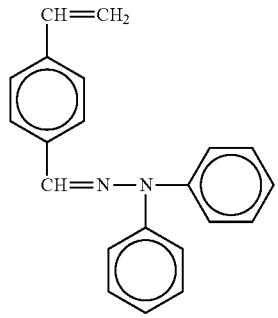
No. 160
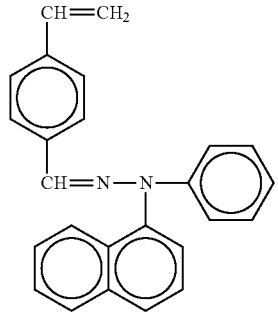
No. 161
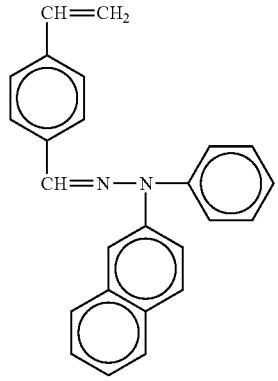
No. 162
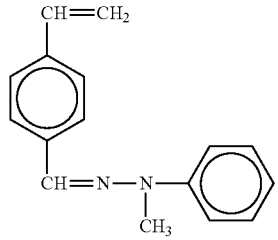
No. 163
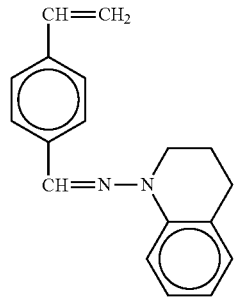

-continued
No. 164
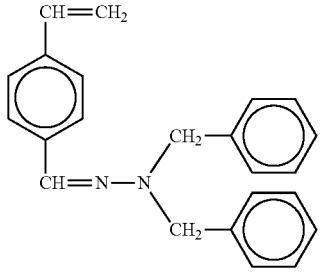
No. 165
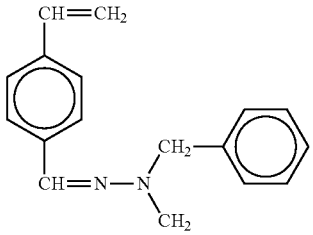
No. 166
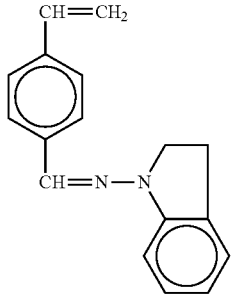
No. 167
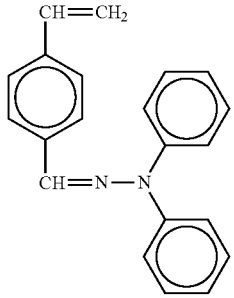
No. 168
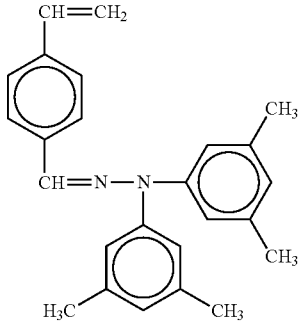

-continued

No. 169

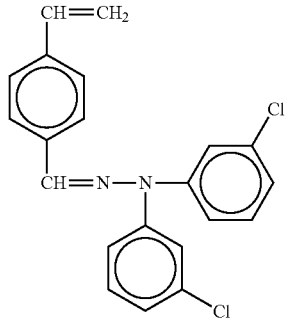

In addition, the radical polymerizable compound having a charge transport structure for suitably use in the present invention imparts a charge transport power to the cross-linked surface layer, and the content ratio of the radical polymerizable compound having a charge transport structure is from 20 to 80% by weight, and preferably from 35 to 65% by weight based on the total weight of the cross-linked surface layer.

When the content of the radical polymerizable compound having a charge transport structure that is excessively small, the charge transport power of the cross-linked surface layer tends not to be sustained, which leads to deterioration of electric characteristics such as sensitivity, and a rise of residual voltage over repetitive use. A content of the radical polymerizable monomer having a charge transport structure that is excessively large means reduction of the content of a monomer having three functional groups without having a charge transport structure. This easily leads to reduction of the cross linking density, which prevents demonstration of a high abrasion resistance. Desired electrostatic characteristics and abrasion resistance vary depending on the process used. Therefore, it is difficult to jump to any conclusion but considering the balance of both, the range of from 35 to 65% by weight is most preferred.

The cross-linked surface is suitably formed by curing a radical polymerizable monomer having at least three functional groups without having a charge transport structure and a radical polymerizable compound having a charge transport structure. In addition, a radical polymerizable monomer having one or two functional groups, a functional monomer and/or a radical polymerizable oligomer can be used in combination therewith to control the viscosity during coating, reduce the internal stress within a cross-linked surface layer, lower the surface energy, decrease the friction index, etc.

Any known radical polymerizable monomers and oligomers can be used.

Specific examples of such radical monomers having one functional group include, but are not limited to, 2-ethyl hexyl acrylate, 2-hydroxy ethyl acrylate, 2-hydroxy propyl acrylate, tetrahydroflu frylacrylate, 2-ethylhexyl carbitol acrylate, 3-methoxy butyl acrylate, benzyl acrylate, cyclohexyl acrylate, isoamyl acrylate, isobutyl acrylate, methoxy triethylene glycol acrylate, phenoxy tetraethylene glycol acrylate, cetyl acrylate, isostearyl acrylate, stearyl acrylate, and a styrene monomer.

Specific examples of the radical polymerizable having two functional groups include, but are not limited to, 1,3-butane diol acrylate, 1,4-butane diol acrylate, 1,4-butane diol dimethacrylate, 1,6-hexane diol diacrylate, 1,6-hexane diol dimethaacrylate, diethylene glycol diacrylate, neopentyl glycol diacrylate, bisphenol A—EO modified diacrylate, bisphenol F—EO modified diacrylate, and neopentyl glycol diacrylate.

Specific examples of such functional monomers include, but are not limited to, a substitution product of, for example, octafluoro pentyl acrylate, 2-perfluoro octyl ethyl acrylate, 2-perfluoro octyl ethyl methacrylate, and 2-perfluoroisononyl ethyl acrylate, in which a fluorine atom is substituted; a siloxane repeating unit described in unexamined published Japanese patent applications Nos. (hereinafter referred to as JPP) H05-60503 and H06-45770; and a vinyl monomer, an acrylate or a methacrylate having a polysiloxane group such as acryloyl polydimethyl siloxane ethyl, methacryloyl polydimethyl siloxane ethyl, acryloyl polydimethyl siloxane propyl, acryloyl polydimethyl siloxane butyl, and diacryloyl polydimethyl siloxane diethyl.

Specific examples of the radical polymerizable oligomers include, but are not limited to, an epoxy acrylate based oligomer, a urethane acrylate based oligomer, and a polyester acrylate based oligomer.

An excessive amount of the radical polymerizable monomer having one or two functional groups and a radical polymerizable oligomer tends to lead to a substantial decrease in the density of three-dimensional cross-linking in a cross-linked surface layer, which leads to deterioration of the abrasion resistance thereof.

Therefore, the content of these monomer and oligomer is not greater than 50 parts and preferably not greater than 30 parts based on 100 parts of a radical polymeric monomer having at least three functional groups.

In addition, the cross-linked surface is suitably formed by curing a radical polymerizable monomer having at least three functional groups without having a charge transport structure and a radical polymerizable compound having a charge transport structure. Optionally, the cross-linked surface layer may contain a polymerization initiator to accelerate the curing reaction.

Specific examples of thermal polymerization initiators include a peroxide based initiator such as 2,5-dimethyl hexane-2,5-dihydroperoxide, dicumyl peroxide, benzoyl peroxide, t-butylcumyl peroxide, 2,5-dimethyl-2,5-di(peroxybenzoyl)hexine-3, di-t-butyl beroxide, t-butylhydro beroxide, cumenehydro beroxide, lauroyl peroxide, and 2,2-bis(4,4-di-t-butylperoxy cyclohexane)propane, and an azo based initiator such as azobis isobutyl nitrile, azobis cyalohexane carbonitrile, azobis iso methyl butyric acid, azobis isobutyl amidine hydrochloride, and 4,4'-azobis-4-cyano valeric acid.

Specific examples of photopolymerization initiators include, but are not limited to, an acetophenon based or ketal based photopolymerization initiators such as diethoxy acetophenone, 2,2-dimethoxy-1,2-diphenyl ethane-1-on, 1-hydroxy-cyclohexyl-phenyl-ketone, 4-(2-hydroxyethoxy) phenyl-(2-hydroxy-2-propyl)ketone, 2-benzyl-2-dimethylamino-1-(4-morpholinophenyl)butanone-1,2-hydroxy-2-methyl-1-phenyl propane-1-on, and 1-phenyl-1,2-propanedion-2-(o-ethoxycarbonyl)oxime; a benzoine ether based photopolymerization initiator such as benzoine, benzoine methyl ether, benzoine ethyl ether, benzoine isobutyl ether, and benzoine isopropyl ether; a benzophenone based photopolymerization initiator such as benzophenone, 4-hydroxy benzophenone, o-benzoyl methyl benzoate, 2-benzoyl naphthalene, 4-benzoyl biphenyl, 4-benzoyl phenyl ether, acrylizes benzophenone and 1,4-benzoyl benzene; a thioxanthone based photopolymerization initiator such as 2-isopropyl thioxanthone, 2-chlorothioxanthone, 2,4-dimethyl thioxanthone, 2,4-diethyl thioxanthone, and 2,4-dichloro thioxanthone; and other photopolymerization initiators such as ethyl anthraquinone, 2,4,6-trimethyl benzoyl diphenyl phosphine oxide, 2,4,6-trimethyl benzoyl phenyl ethoxy phosphine oxide, bis(2,4,6-trimethyl benzoyl)phenyl phosphine oxide, bis(2,4-dimethoxybenzoyl)-2,4,4-trimethyl pentyl phosphine oxide, a methylphenyl glyoxy ester, 9,10-phenanthrene, an acridine based compound, a triadine based compound and an imidazole based compound.

In addition, a compound having an acceleration effect on photopolymerization can be used alone or in combination with the photopolymerization initiator.

Specific examples of such compounds include, but are not limited to, triethanol amine, methyl diethanol amine, 4-dimethyl amino ethyl benzoate, 4-dimethyl amino isoamyl benzoate, ethyl benzoate (2-dimethyl amino), and 4,4'-dimethyl amino benzophenone.

These polymerization initiators can be used alone or in combination. The content of such a polymerization initiator is from 0.5 to 40 parts by weight and preferably from 1 to 20 parts by weight based on 100 parts by weight of the compound having a radical polymerization property.

Furthermore, the liquid application for use in formation of the surface layer for use in the present invention optionally includes additives such as various kinds of plasticizers (for reducing internal stress or improving adhesiveness), a leveling agent, a charge transport material having a low molecular weight having no radical reaction property.

Known additives can be used as these additives. A typical resin such as dibutylphthalate and dioctyl phthalate can be used as the plasticizer. The content thereof is not greater than 20% by weight and preferably not greater than 10% based on the total solid portion of the liquid application.

Silicone oils such as dimethyl silicone oil, methyl phenyl silicone oil and a polymer or an oligomer having a perfluoroalkyl group in its side chain can be used as the leveling agent. The content thereof is suitably not greater than 3% by weight based on the total solid portion of the liquid application.

The cross-linked surface layer for use in the present invention is suitably formed by coating and curing a liquid application containing a radical polymerizable monomer having at least three functional groups with no charge transport structure, and a radical polymerizable compound having a charge transport structure. When a liquid radical polymerizable monomer is used for the liquid application, other components are possibly dissolved in the liquid followed by application. Optionally, the liquid application is diluted by a suitable solvent before coating.

Specific examples of such solvents include, but are not limited to, an alcohol such as methanol, ethanol, propanol and butanol; a ketone such as acetone, methyl ethyl ketone, methyl isobutyl ketone, and cycle hexanone; an ester such as ethyl acetate and butyl acetate; an ether such as tetrahydrofuran dioxane and propyl ether; a halogen based solvent such as dichloromethane, dichloroethane, trichloroethane and chlorobenzene; an aromatic series based solvent such as benzene, toluene and xylene; and a cellosolve based solvent such as methyl cellosolve, ethyl cellosolve and cellosolve acetate.

These solvents can be used alone or in combination.

The dilution ratio by using such a solvent is arbitrary and varies depending on the solubility of a composition, a coating method, and a target layer thickness.

A dip coating method, a spray coating method, a bead coating method, a ring coating method, etc., can be used in application of the liquid application.

In the present invention, subsequent to application of a liquid of application, a cross-linked surface layer is cured upon application of external energy such as heat, light and radiation ray. As light energy, a UV irradiation light source such as a high pressure mercury lamp or a metal halide lamp having an emission wavelength mainly in the ultraviolet area is used. A visible light source can be selected according to the absorption wavelength of a radical polymerizable compound and a photopolymerization initiator.

In addition, the cross-linking reaction by the radical polymerization is greatly affected by the temperature and the surface temperature of the film formed upon optical irradiation is preferably from 20 to 170° C.

There is no specific limit to the selection of the surface temperature control device for the film. A method of control the surface temperature using a thermal medium is preferable.

Below are examples of the application method when the material for use in the cross-linked surface layer in the present invention. When an acrylate monomer having three acryloyloxy groups and a triaryl amine compound having an acryloyloxy group are used as a liquid of application, the content ratio of the acrylate monomer to the triaryl amine is 3/7 to 7/3 and an polymerization initiator is added in an amount of 3 to 20% by weight based on the total amount of the acrylate compound followed by an addition of a solvent to prepare a liquid of application.

When a triaryl amine based doner and a polycarbonate as a binder resin are used in a charge transport layer provided under the cross-linked surface layer is formed by a spray method, it is preferred to use teterahydrofuran, 2-butanone or ethyl acetate as the solvent mentioned above for a liquid for application, the content of which is 3 to 10 times as much as the total weight of the acrylate compound.

The thus cured and manufactured cross-linked surface layer is preferably insoluble in an organic solvent.

A film that is not sufficiently cured is soluble in an organic solvent and has a thin cross-linking density, which leads to degradation of mechanical strength.

Next, for example, the liquid of application prepared as described above is applied with, for example, a spray, on a latent image bearing member in which an undercoating layer, a charge generation layer and cured on application of light via drying by finger touch.

In the case of UV ray irradiation, a metal halide lamp, etc. is used with a preferable illuminance of from 50 to 1,000 $mW/cm^2$. For example, when a UV ray of 700 $mW/cm^2$ is used, the drum is rotated to irradiate all the surface evenly for about two minutes for, for example, curing. The surface temperature is controlled not to be extremely high by using a thermal medium.

After completion of curing, the resultant is heated in a range of from 100 to 150° C. for 10 to 30 minutes to reduce the residual organic solvent before a latent image bearing member of the present invention is obtained.

In addition, to satisfy Relationship (I), it is preferable to extremely reduce the oxygen density in the atmosphere when heated or irradiated with UV ray.

In addition, at the time of UV ray irradiation, the surface is irradiated with UV ray while in rotation. It is more preferable to reduce the oxygen density in the atmosphere regardless of whether or not the UV ray is received.

Furthermore, when a spray coating is used, it is suitable to conduct application in the atmosphere where the oxygen density is reduced by filling nitrogen in the application facility, or dry by finger touch.

The cross-linked surface layer of the present invention preferably has a thickness of from 1 to 30 μm, more preferably from 2 to 20 μm, and furthermore preferably from 4 to 15 μm.

When the surface layer is too thin and carriers are attached thereto and dents therein, the durability of the cross-linked surface layer is not easily secured.

To the contrary, a surface layer that is too thick tends to cause a problem such as a rise in the residual voltage.

Therefore, it is preferable to form a cross-linked surface layer having a suitable layer thickness by which an allowance for abrasion and scar is secured and a residual voltage is reduced.

Photosensitive Layer

Next, the laminate type photosensitive layer and the single layer type photosensitive layer that form the latent image bearing member for use in the present invention are described.

Laminate Type Photosensitive Layer

The laminate type photosensitive layer has a structure in which a charge generation layer (CGL) and a charge transport layer (CTL) are typically applied to a substrate, in that order.

Charge Generation Layer

The charge generation layer contains at least a charge generation material and other optional materials such as a binder resin.

There is no specific limit to the selection of the charge generation material. Either one of an inorganic material and an organic material is suitably used.

There is no specific limit to the selection of the inorganic materials. Specific examples thereof include, but are not limited to, crystal selenium, amorphous-selenium, selenium-tellurium, selenium-tellurium-halogen, and selenium-arsenic compounds.

There is no specific limit to the selection of the organic materials. Specific examples thereof include, but are not limited to, phthalocyanine pigments, for example, metal phthalocyanine and metal-free phthalocyanine; azulenium salt pigments; squaric acid methine pigments; azo pigments having a carbazole skeleton; azo pigments having a triphenylamine skeleton; azo pigments having a diphenylamine skeleton; azo pigments having a dibenzothiophene skeleton; azo pigments having a fluorenone skeleton; azo pigments having an oxadiazole skeleton; azo pigments having a bis-stilbene skeleton; azo pigments having a distilyloxadiazole skeleton; azo pigments having a distylylcarbazole skeleton; perylene pigments, anthraquinone or polycyclic quinone pigments; quinoneimine pigments; diphenylmethane and triphenylmethane pigments; benzoquinone and naphthoquinone pigments; cyanine and azomethine pigments, indigoid pigments, and bis-benzimidazole pigments.

These can be used alone or in combination.

There is no specific limit to the selection of the binder resin for use in the charge generation layer. Specific examples of the binder resin include, but are not limited to, polyamides, polyurethanes, epoxy resins, polyketones, polycarbonates, silicone resins, acrylic resins, polyvinylbutyrals, polyvinylformals, polyvinylketones, polystyrenes, poly-N-vinylcarbazoles, and polyacrylamides.

These can be used alone or in combination.

A charge transport material can be optionally added.

In addition, other than the binder resins mentioned above, a charge transport polymer can be also added.

As a method of forming the charge generating layer, vacuum thin layer forming methods and casting methods from a solution dispersion system can be mentioned.

In the vacuum thin layer forming methods, for example, there are glow discharging polymerization methods, vacuum deposition methods, chemical vacuum deposition (CVD) methods, sputtering methods, reactive sputtering methods, ion plating methods and accelerated ion injection methods.

In these vacuum thin layer forming methods, the inorganic based materials and the organic based materials specified above can be suitably used.

To form a charge generation layer by the casting method, it is possible to use a typical method such as a dip coating method, a spray coating method and a beat coating method.

Specific examples of organic solvents for use in forming a liquid application for a charge generating layer include acetone, methyl ethylketone, methyl itopropylketone, cyclohexanone, benzene, toluene, xylene, chloroform, dichloromethane, dichloroethane, dichloropropane, trichloroethane, trichloroethylene, tetrachloroethane, tetrahydrofuran, dioxolane, dioxane, methanol, ethanol, isopropylalcohol, butanol, ethyl acetate, butyl acetate, dimethyl sulfoxide, methyl cellosolve, ethyl cellosolve, and propyl cellosolve. These can be used alone or in combination.

Among these, tetrahydrofuran, methyl ethylketone, dichloromethane, methanol and ethanol, which have a boiling point of from 40 to 80° C., are particularly preferred because drying after their coating is easy.

The liquid application for forming a charge generating layer is prepared by dispersing and dissolving the charge generating material and the binder resin in the organic solvent. As a method of dispersing an organic pigment in an organic solvent, there are a dispersion method using a dispersion medium such as a ball mill, a bead mill, a sand mill and a vibration mill, and a high speed liquid collision dispersion method.

The electrophotographic characteristics, especially photosensitivity, vary depending on the thickness of the charge generating layer. In general, as the layer thickens, the photosensitivity becomes high.

Therefore, it is preferred to set the layer thickness of the charge generating layer in a suitable range according to the specification of a desired image forming apparatus. To obtain the sensitivity suitable as an image bearing member, the layer thickness thereof is preferably from 0.01 to 5 μm and more preferably from 0.05 to 2 μm.

Charge Transport Layer

In the present invention, when the charge transport layer is a cross-linked surface layer, as described above, the charge transport layer contains at least a silicone based compound and is formed by curing a polymerizable compound having a charge transport structure. The image forming apparatus satisfies the following relationships Relationship (I), Relationship (II) and Relationship (III):

$$|(A1-B1)-(A2-B2)|\leqq 5.0 \quad \text{Relationship (I)}$$

$$B1\geqq 1 \text{ (atomic \%)} \quad \text{Relationship (II)}$$

$$1 \text{ (nm)}\leqq X\leqq 30 \text{ (nm)} \quad \text{Relationship (III)},$$

where, according to XPS analysis, A1 represents an oxygen atom content ratio in the cross-linked surface layer, B1 represents a silicon atom content ratio therein, A2 represents an oxygen atom content ratio in a surface obtained by digging through the cross-linked surface layer along a direction perpendicular to the surface of the latent image bearing member to the electroconductive substrate to a depth point X where the silicon atom content ratio of B1 decreases to not greater than B1×0.5, and B2 represents the silicone atom content ratio in the surface at the depth point X.

However, in the case of a structure in which the cross-linked surface layer is a protection layer formed on the charge transport layer, the charge transport layer may have a weak abrasion resistance.

In addition, to achieve the objective of holding the charge, the electric resistance is required to be high.

Furthermore, to achieve the objective of obtaining a high surface voltage by the held charge, a small dielectric constant and good charge mobility are required.

Specific examples of the positive hole carrier transport materials (electron donating materials) include oxazole derivatives, oxadiazole derivatives, imidazole derivatives, triphenyl amine derivatives, 9-(p-diethylaminostyryl anthracene), 1,1-bis-(4-dibenzyl aminophenyl)propane, styrylanthracene, styrylpyrazoline, phenylhydrazones, α-phenylstilbene derivatives, thiazole derivatives, triazole derivatives, phenazine derivatives, acridine derivatives, benzfuran derivatives, benzimidazole derivatives and thiophen derivatives. These can be used alone or in combination.

Specific examples of the charge transport polymers include compounds having the following structure.

(a) Polymer Having Carbazole Ring

Specific examples include, but are not limited to, poly-N-vinylcarbazole, and the compounds described in JPs S54-9632-A, S54-11737-A, H04-175337-A, H04-183719-A and H06-234841-A.

(b) Polymer Having Hydrazone Structure

Specific examples include, but are not limited to, the polymers described in JPs S57-78402-A, S61-20953-A, S61-296358-A, H01-134456-A, H01-179164-A, H03-180851-A, H03-180852-A, H03-50555-A, H05-310904-A and H06-234840-A.

(c) Polysilylene Polymer

Specific examples include, but are not limited to, polymers described in JP S63-285552-A, H01-88461-A, H04-264130-A, H04-264131-A, H04-264132-A, H04-264133-A and H04-289867-A.

(d) Polymer Having Triarylamine Structure

Specific examples include, but are not limited to, N,N,bis(4-methylphenyl)-4-aminopolystyrene, and polymers described in JPs H01-134457-A, H02-282264-A, H02-304456-A, H04-133065-A, H04-133066-A, H05-40350-A, and H05-202135-A.

(e) Other Polymer

Specific examples include, but are not limited to, a condensation polymerized formaldehyde compound of nitropropylene, and polymers described in JPs S51-73888, S56-150749-A, H06-234836 and H06-234837.

In addition, there are other examples of the charge transport polymers, which are, for example, polycarbonate resins having a triaryl amine structure, polyurethane resins having a triaryl amine structure, polyester resins having a triaryl amine structure and polyether resins having a triaryl amine structure.

Specific examples thereof include, but are not limited to, polymers described in JPs S64-1728-A, S64-13061-A, S64-19049-A, H04-11627-A, H04-225014-A, H04-230767-A, H04-320420-A, H05-232727-A, H07-56374-A, H09-127713-A, H09-222740-A, H09-265197-A, H09-211877-A and H09-304956-A.

Other than the polymers specified above, copolymers, block polymers, graft polymers and star polymers with a known monomer, and cross-linking polymers having the electron donating groups described in JP H03-109406-A can be used as the polymers having an electron donating group.

Specific examples of the binder resins for use in the charge transport layer include, but are not limited to, polycarbonate resins, polyester resins, methacryl resins, acryl resins, polyethylene resins, polyvinyl chloride resins, polyvinyl acetate resins, polystyrene resins, phenol resins, epoxy resins, polyurethane resins, polyvinylidene chloride resins, alkyd resins, silicone resins, polyvinylcarbazole resins, polyvinyl butyral resins, polyvinyl formal resins, polyacrylate resins, polyacryl amide resins and phenoxy resins. These can be used alone or in combination.

The charge transport layer can also contain a copolymer of a cross-linking binder resin and a cross-linking charge transport material.

The charge transport layer can be formed by dissolving or dispersing these charge transport materials and the binder resins in a suitable solvent followed by coating and drying.

The charge transport layer can optionally contain additives such as a plasticizing agent, an anti-oxidizing agent and a leveling agent in a suitable amount if desired.

The layer thickness of the charge transport layer preferably ranges from 5 to 100 μm. The layer thickness of a charge transport layer has been thinned to satisfy the demand for improving the quality of images in recent years. It is preferred that the charge transport layer has a thickness that ranges from 5 to 30 μm for a high definition of 1,200 dpi or higher.

Next, the photosensitive layer is described.

Single Layered Photosensitive Layer

The exemplary single layer photosensitive layer mentioned above contains a charge generating material, a charge transport material, a binder resin and other optional components.

A single layer photosensitive layer can be formed by a casting method. Such a single-layered photosensitive layer can be formed by dissolving or dispersing a charge generation material, a themocuring binder resin, and a charge transport material having a cross-linkable functional group in a suitable solvent followed by coating and drying.

A plasticizer can be optionally contained in such a single-layered photosensitive layer.

The single-layered photosensitive layer preferably has a thickness of from 5 to 10 μm and more preferably from 5 to 50 μm.

When the layer thickness is too thin, the charging property tends to deteriorate. When the layer thickness is too thick, the sensitivity may deteriorate.

Substrate

There is no specific limit to the selection of the substrate of the latent image bearing member in the present invention. Any known material can be suitably used.

For example, an electroconductive body or an electroconductively-treated insulating body are suitably used. Specific examples thereof include: metals such as Al, Ni, Fe, Cu, Au, and alloys thereof; materials in which a thin layer of a metal such as Al, Ag and Au; or an electroconductive material such as $In_2O_3$ and $SnO_2$ is formed on an insulating substrate such as polyester, polycarbonate, polyimide and glass; resin substrates to which electroconductivity is imparted by uniformly dispersing carbon black, graphite, metal powder formed of Al, Cu and Ni and electroconductive glass powder in a resin to impart electrocondcutivity; and electroconductivley-treated paper.

There is no specific limit to the form and the size of the substrate. A plate form, a drum form or a belt form substrate can be used.

When a substrate having a belt form is used, devices such as a driving roller and a driven roller are desired to be provided. Therefore, the apparatus using such a substrate is increased in size, but there is a merit in that the layout latitude increases. However, when a protective layer is formed, the flexibility thereof is insufficient, which leads to the possibility of cracking on the surface. This may cause the background fouling to appear granular. Therefore, a drum having a high hardness is preferable as the substrate.

Undercoating Layer

An undercoating layer can be optionally provided between the substrate and the photosensitive layer.

The undercoating layer is provided to improve the adhesive property, prevent the occurrence of moiré, improve the coating property of a layer provided thereon, reduce the residual voltage, etc.

Typically, such an undercoating layer is mainly made of a resin. Considering that a photosensitive layer is applied to such an undercoating layer (i.e., resin) in a form of solvent, the resin is preferably hardly soluble in a known organic solvent. Specific examples of such resins include, but are not limited to, water-soluble resins such as polyvinyl alcohol, casein and sodium polyacrylate, alcohol-soluble resins such as copolymerized nylon, and methoxymethylated nylon, curing resins forming three-dimensional structure such as polyurethane, melamine resins, alkyd-melamine resins and epoxy resins.

In addition, fine powder of metal oxides such as titanium oxide, silica, alumina, zirconium oxide, tin oxide and indium oxide, metal sulfides and metal nitrides can be optionally added. Such an undercoating layer can be formed by a typical method using a suitable solvent.

An undercoating layer can be formed by anodizing a metal oxide layer of Al2O3 formed by a sol-gel process, etc. or by coating organic compounds such as a polyparaxylyene (parylene) or an inorganic compound such as $SnO_2$, $TiO_2$, ITO, and $CeO_2$ using a silane coupling agent, a titanium coupling agent, and a chromium coupling agent by a vacuum thin layer forming method.

There is no specific limit to the layer thickness of such an undercoating layer. The layer thickness thereof can be determined to a suitable purpose and preferably ranges from 0.1 to 10 μm, and more preferably ranges from 1 to 5 μm.

Image Forming Apparatus

The image forming apparatus of the present invention includes a latent image bearing member, a charging device, a latent image formation device, a transfer device, a lubricant supplier (applicator), a development device, and other optional devices such as a fixing device, a discharging device, a cleaning device, a recycling device, and a control device. The lubricant supplier is provided on the downstream side of the transfer device relative to the rotation direction of the latent image bearing member, and supplies a lubricant to the latent image bearing member on the upstreams side of the charging device relative to the rotation direction of the latent image bearing member. The development device is provided on the downstream side of the charging device relative to the rotation direction of the latent image bearing member and on the downstream side of the transfer device relative to the rotation direction of the latent image bearing member to form a toner image.

Latent Image Formation Process and Device

The latent image formation process is a process of forming a latent electrostatic image on the latent image bearing member.

The latent image bearing member of the present invention is used.

The latent electrostatic image is formed by, for example, uniformly charging the surface of the latent image bearing member followed by irradiation according to data information with the latent image formation device.

The latent image formation device includes, for example, a charging device that uniformly charges the surface of the latent image bearing member, and an irradiation device that irradiates the surface of the latent image bearing member according to data information.

Charging is conducted by applying a voltage to the surface of the latent image bearing member using the charging device.

There is no specific limit to the selection of the charing device and any known device can be suitably used. Specific examples thereof include, but are not limited to, a known contact type charging device that includes an electroconductive or semiconductive roller, brush, film, and a rubber blade, and a non-contact type charing device using corona discharging such as corotron, and scorotron.

The charging device may employ any form other than the roller, for example, a magnetic brush, and a fur brush and can be selected according to the specification or form of an image forming apparatus.

When a magnetic brush is used, ferrite particles such as Zn—Cu ferrite is used as the charging member to form the magnetic brush together with a non-magnetic electroconductive sleeve to support the charging member, and a magnet roll provided inside the electroconductive sleeve.

When a brush is used, a fur brush electroconductively treated with carbon, copper sulfide, metal or metal oxide is rolled on or attached to metal or electroconductively treated metal core to function as the charging device.

The charging device is not limited to the contact type charing device described above, but using such a contact type charging device is preferable because an image forming apparatus obtained produces a reduced amount of ozone.

It is preferable to apply a direct current or a voltage obtained by overlapping an alternate current voltage to a direct current voltage to the surface of the latent image bearing member by the charging device arranged in contact with or in the vicinity of the latent image bearing member.

It is preferable to apply a direct current or a voltage obtained by overlapping an alternate current voltage to a direct current voltage to the surface of the latent image bearing member by the charging device arranged in contact with or in the vicinity of the latent image bearing member.

Irradiation is conducted by irradiating the surface of the latent image bearing member according to data information using the irradiation device.

There is no specific limit to the selection of the irradiating device as long as the irradiation device irradiates the surface of the latent image bearing member charged by an charging device according to data information. Specific examples thereof include, but are not limited to, various kinds of irradiation devices such as photocopying optical systems, rod-lens array systems, laser optical systems, and liquid crystal shutter optical systems.

Embodiments of the present invention can employ a dorsal irradiation system in which the latent image bearing member is irradiated according to data information from the rear side thereof.

Development Process and Device

The developing process mentioned above is a process of developing and visualizing the latent electrostatic image mentioned above with a toner or a development agent to obtain a toner image.

The toner image is formed by, for example, developing the latent electrostatic image with the toner or the development agent by the development device.

There is no specific limit to the selection of the development device as long as it develops the latent image with the toner or the development agent described above. Any known device can be suitably used. For example, a development device is suitable which includes a development unit that accommodates the toner or the development agent and provides the toner or the development agent to the latent electrostatic image in contact or non-contact therewith.

The development unit employs a dry or wet development system, and a monochrome development unit or a full color development unit. For example, a development unit including a stirrer that abrasively stirs the toner or the development agent and the rotatable magnet roller is suitable.

In the development unit, for example, toner and carrier are mixed and stirred to frictionally charge the toner. The charged toner is held in a filament manner on the surface of the magnet roller in rotation to form a magnet brush. Since the magnet roller is provided in the vicinity of the latent image bearing member (photoreceptor), part of the toner forming the magnet brush formed on the surface of the magnet roller is electrically attracted to the surface of the latent image bearing member.

As a result, the latent electrostatic image is developed with the toner so that a toner image of the toner is formed on the surface of the latent image bearing member.

Either one of a single component development agent and a two component development agent can be used as the development agent accommodated in the development unit.

Transfer Process and Device

The transfer process is a process of transferring the toner image to a transfer medium (recording medium). Preferably, the toner image is primarily transferred to an intermediate transfer body followed by a secondary transfer of the toner image to a recording medium. It is preferable that the transfer process includes a primary transfer process in which an overlapped complex transfer toner image is formed from multiple color toner images on an intermediate transfer body and a secondary transfer process that transfers the complex image to a recording medium all at once.

The transfer is conducted by, for example, transferring the toner image to a transfer body using a transfer unit in the transfer device.

The transfer device preferably includes a primary transfer device that forms a complex transfer image on an intermediate transfer body by transferring a toner image, and a secondary transfer device that transfers the complex transfer image to a recording medium.

There is no specific limit to the selection of the intermediate transfer body. Any known transfer body such as an intermediate transfer belt can be suitably selected and used.

The intermediate transfer body preferably has a static friction coefficient of from 0.1 to 0.6 and more preferably from 0.3 to 0.5.

The intermediate transfer body preferably has a volume resistance of from several to $10^3$ Ωcm.

When the volume resistance in this range, the intermediate transfer body is protected from being charged. Also, since the charge imparted by a charge imparting device hardly remain on the intermediate transfer body, the uneven transfer during the secondary transfer does not occur.

In addition, a transfer bias application becomes easy at the secondary transfer

The intermediate transfer belt can be formed of any known material.

For example, (1) a single layer belt having a high Young's modulus (tensile elastic modulus) is suitable and specific examples thereof include, but are not limited to, PC (polycarbonate), PVF (polyvinilidene fluoride), PAT (polyalkylene terephthalate), a blend material of PC and PAT, a blend material of ETFE (copolymer of ethylene tetra fluoroethylene) and PC, a blend material of ETFE (copolymer of ethylene tetra fluoroethylene) and PC, a blend material of ETFE and PAT, a blend material of PC and PAT, and a thermocuring polyimide in which carbon black is dispersed.

These single layer belts having a high Young's modulus are strong for the stress during image formation and hardly causes mis-registration particularly during color image formation.

(2) A two or three layered laminate belt having a structure in which a surface layer or an intermediate layer is provided on the belt having a high Young's modulus described above as the base layer. This two or three layered laminate belt is free from the phenomenon of image missing in a line image caused by the hardness of the single layer belt.

(3) A rubber or elastomer belt having a relatively low Young's modulus and has an advantage that no image missing in a line image occurs because of its softness.

In addition, since the width of the belt is set to be wider than the driving roll and the suspension roller, the belt ear portion that protrudes from the roll is elastic enough to prevent meandering. Therefore, this belt is cost-saving because it does not require a rib or a meandering prevention device.

The intermediate transfer belt is typically made of a fluorine-based resin, a polycarbonate resin, a polyimide resin, etc. In recent years, an elastic belt entirely or partially made of an elastic material has been used.

The resin belt has the following problems with regard to transferring color images.

Color images are typically formed of four colored toners.

Four toner layers from first to fourth are formed in one color toner image.

The toner layer receives pressure when passing through the primary transfer (transfer from a latent image bearing member to an intermediate transfer belt), and the secondary transfer (transfer from the intermediate transfer belt to the recording medium), thereby increasing the agglomeration force between the toner particles.

As the agglomeration force between the toner particles increases, the image missing in the center portion of a line image or the edge portion of a solid image easily occurs.

The resin belt has a high hardness and doe not deform according to the toner layer. Therefore, the toner layer tends to be compressed, which leads to the image missing particularly in the center portion of a line image.

In addition, demand for printing full color images on various kinds of recording media such as Japanese paper or paper which is intentionally roughened has been increasing in recent years.

However, paper that does not have a smooth surface tends to have voids between the paper and toner at transfer, which leads to image missing at transfer.

If the transfer pressure at the secondary transfer portion is increased to make the adhesion, concentration force of the toner layer increases, thereby image missing in the center portion of characters (lines) as described above.

The elastic belt is used for the following purposes.

The elastic belt deforms according to the toner layer and rough paper.

That is, since the elastic belt tends to deform according to local concavo-convex portion, good adhesion between the toner layer and the medium is obtained without increasing the transfer pressure against the toner layer excessively. Therefore, uniform transfer images are obtained for rough paper without causing the image missing of characters.

Specific examples of the resin for use in the elastic belt include, but are not limited to, polycarbonate; fluorine containing resin such as ethylene-tetrafluoroetylene (ETFE) and polyvinylidene fluoride (PVDF); styrene-containing resin (monopolymers or copolymers containing styrene or a styrene substitute) such as polystyrene, chloropolystyrene, poly-α-methylstyrene, styrene-butadiene copolymers, styrene-vinyl chloride copolymers, styrene-vinyl acetate copolymers, styrene maleic acid copolymers, styrene acrylate ester copolymers (styrene-methylacrylate copolymers, styrene-etylacrylate copolymers, styrene-butylacrylate copolymers, styrene-octylacrylate copolymers and styrene-phenyl acrylate copolymers), styrene-methacrylate ester copolymers (styrene-methylmethacrylate copolymers, styrene-ethylmethacrylate copolymers, and styrene-phenyl methacrylate copolymers), styrene-α-methyl chloroacrylate copolymers, and styrene-acrylonitrile-acrylate ester copolymers; methyl methacrylate resins; butyl methacrylate resins; ethyl acrylate resins; butyl acrylate resins; modified acryl resins (silicone modified acryl resins, vinylchloride resin modified acryl resins, acryl-urethane resins, etc.); vinyl chloride resins; styrene-vinyl acetate copolymers; vinylchloride-vinyl acetate copolymers; rosin modified maleic acid resin; phenol resins; epoxy resins; polyester resins; polyester polyurethane resins; polyethylene; polypropylene; polybuthadiene; polyvinyidene chloride; ionomer resins; polyurethane resins; silicone resins; ketone resins; ethylene-ethylacrylate copolymers; xylene resins and polyvinyl butyral resins; polyamide resins; and modified polyphenylene oxide resins. These can be used alone or in combination.

Specific examples of the elastic rubber and elastomers include, but are not limited to, butyl rubber, fluorine containing rubber, acryl rubber, ethylene propylene diene monomer (EPDM) rubber, nitrile rubber (NBR), acrylointrile-butadiene-styrene rubber natural rubber, isoprene rubber, styrene-butadiene rubber, butadiene rubber, ethylene-propylene rubber, ethylene-propylene terpolymers, chloroprene rubber, chlorosulfonated polyethylene, chlorinated polyethylene, urethane rubber, syndiotactic 1,2-polybutadiene, epichlorohydrin containing rubber, silicone rubber, fluorine rubber, polysulfide rubber, polynorbornene rubber, hydrogenated nitrile rubber, and thermoplastic elastomers such as polystyrene containing elastomers, polyolefine containing elastomers, polyvinyl chloride containing elastomers, polyurethane containing elastomers, polyamide containing elastomers, polyurea containing elastomers, polyester containing elastomers and fluorine resin containing elastomers).

These can be used alone or in combination.

There is no specific limit to the electrocondcutive agents to adjust the resistance. Specific examples of such agents include carbon black, graphite, powder of a metal such as aluminum and nickel, and electroconductive metal oxides such as tin oxides, titanium oxides, antimony oxides, indium oxides, kalium titanate, mixture oxides of antimony oxide-tin oxide (ATO) and mixture oxides of indium oxide and tin oxide (ITO). These electroconductive can be optionally coated with insulative particulates of, for example, barium sulfate, magnesium silicate and calcium carbonate.

The electroconductive agents are not limited thereto.

The surface layer and materials therefor are required to prevent contamination of the elastic material to a latent image bearing member and improve the secondary transfer property and the cleaning property by reducing the surface friction resistance to the transfer belt surface to decrease the attachment force of the toner.

For example, polyurethanes, polyesters, epoxy resins, etc. can be used singly or in combination together with other materials in a manner that the other materials are dispersed. Such other materials are, for example, powder or particles of fluorine resins, fluorine compounds, fluorine carbides, titanium dioxides, and silicon carbide which can reduce the surface energy to improve lubricity. These materials can be used alone or in combination. Further, the same material having different particle diameters can be used together.

In addition, when a fluorine containing rubber material is thermally treated, a fluorine rich surface layer having a small surface energy can be formed. Such a material can be also used.

There is no specific limit to the methods of manufacturing the belt. Specific examples thereof include, but are not limited to, centrifugal molding method in which a belt is formed by pouring a material into a rotating cylindrical mold, a spray application method by which a thin surface layer is formed, a dipping method in which a cylindrical mold is dipped into and drawn out of the solution of a material, a cast molding method in which a material is poured into between an inside mold and an outside mold, and a method by which a compound is wound around a cylindrical mold for vulcanization and grinding. In addition, these methods are typically used in combination for belt manufacturing.

To prevent stretch of the elastic belt, there is a method in which the rubber layer is formed on the core resin layer with little stretch, or a material which prevents the stretch is mixed in the core resin layer, etc.

Specific examples of the materials which can prevent the stretch of the core layer include natural fiber such as cotton and silk, synthetic fiber such as polyester fiber, nylon fiber, acrylic fiber, polyolefin fiber, polyvinyl alcohol fiber, polyvinyl chloride fiber, polyvinylidene chloride fiber, polyurethane fiber, polyacetal fiber, polyfluoroethylene fiber and phenol fiber, inorganic fiber such as carbon fiber, glass fiber and boron fiber, metal fiber such as iron fiber and copper fiber.

Theses can be used alone or in combination to form woven fabric or filament fabric.

The filament mentioned above can be twisted using a piece of or multiple pieces thereof. Any twisting method, for example, single twisted yarn, double-folded twisted yarn and multi-folded twisted yarn, can be used.

In addition, the fabric of the material selected from the materials mentioned above can be mixed.

Also, such a filament can be used singly after the filament is electroconductively treated.

With regard to the woven fabric, any weaving method such as knitting can be used. Combined woven fabric can be also used. Such fabric can be electroconductively treated.

There is no specific limit to the methods of manufacturing a core layer. For example, there can be used a method in which a die is covered with a woven fabric having a cylindrical form and is further covered with a covering layer, a method in which a woven fabric having a cylindrical form is dipped in a liquid rubber, etc., and covers either side or both sides of the core layer, and a method in which a filament is spirally wound around a die, etc., with an arbitrary pitch and a covering layer is formed thereon.

When the thickness of the elastic layer is too thick, expansion and contraction of the surface becomes large so that cracking is easy to occur in the surface depending on the hardness of the elastic layer.

In addition, an excessive amount of expansion and contraction is not preferred because expansion and contraction of an image also become large. Therefore, the thickness of the elastic layer is preferably thinner than about 1 mm.

The transfer device (the primary transfer device and the secondary transfer device) preferably has a transfer unit that peels off and charges the toner image formed on the image bearing member to the side of the recording medium.

One or more transfer devices can be provided.

Specific examples of the transfer device include, but are not limited to, a corona transfer device using corona discharging, a transfer belt, a transfer belt, a transfer roller, a pressure transfer roller and an adhesive transfer device.

A typical example of the recording medium is plain paper but any paper to which a non-fixed image after development is transferred can be suitably used. PET base for an overhead projector can be also used.

The fixing process is a process in which a toner image transferred to the recording paper is fixed by a fixing device. Fixing can be performed every time each color toner image is transferred or all at once for a multi-color overlapped image.

Any fixing device can be suitably selected. Any known heating and pressure device can be used.

A combination of a heating roller and a pressure roller and a combination of a heating roller, a pressure roller and an endless belt can be used as the heating and pressure device.

The heating temperature by the heating and pressure device is preferably from 80 to 200° C.

In addition, in the present invention, any known optical fixing device can be used together with or instead of the fixing device in the fixing process mentioned above.

The discharging process mentioned above is a process in which the latent image bearing member mentioned above is discharged by application of a discharging bias or irradiation of discharging light and is suitably conducted by a discharging device.

There is no specific limit to the discharging device as long as the surface charge on the latent image bearing member can be removed. For example, a dicharger that applies a discharging bias or a discharging lamp is suitably used.

The cleaning process is a process of removing toner remaining on the surface of the latent image bearing member and can be suitably conducted by a cleaning device.

Any known cleaning device that can remove the toner remaining on the surface of the latent image bearing member can be suitably selected and used. For example, a magnetic brush cleaner, an electrostatic brush cleaner, a blade cleaner, a brush cleaner, and a web cleaner can be preferably used.

The image forming apparatus of the present includes a lubricant supplying device that supplies and applies to a lubricant to the surface of the latent image bearing member.

Specific examples of the lubricants include, but are not limited to, an aliphatic metal salt, a natural wax such as carnauba wax, and a fluorine-containing resin such as polytetrafluoroethylene.

Particularly, the aliphatic metal salt is preferably used. A preferable example is a metal salt formed by at least one aliphatic acid selected from the group consisting of stearic acid, palmitic acid, milistic acid, and oleic acid, and at least one metal selected from the group consisting of zinc, aluminum, calcium, magnesium, iron, and lithium because is easy to solidify and thus handle.

The recycling process is a process in which the color toner removed in the cleaning process mentioned above is returned to the developing device for recycle use. This recycling can be suitably conducted by a recycling device.

There is no specific limit to the recycling device and any known transfer device, etc., can be used.

The controlling process mentioned above is a process of controlling each process and the controlling can be suitably performed by a controlling device.

There is no specific limit to the controlling device as long as the device can control the behavior of each device. Any controlling device can be suitably selected to purpose. For example, devices such as a sequencer and a computer can be used.

The image forming apparatus of the present invention is described next with reference to accompanying drawings.

Figure 6:
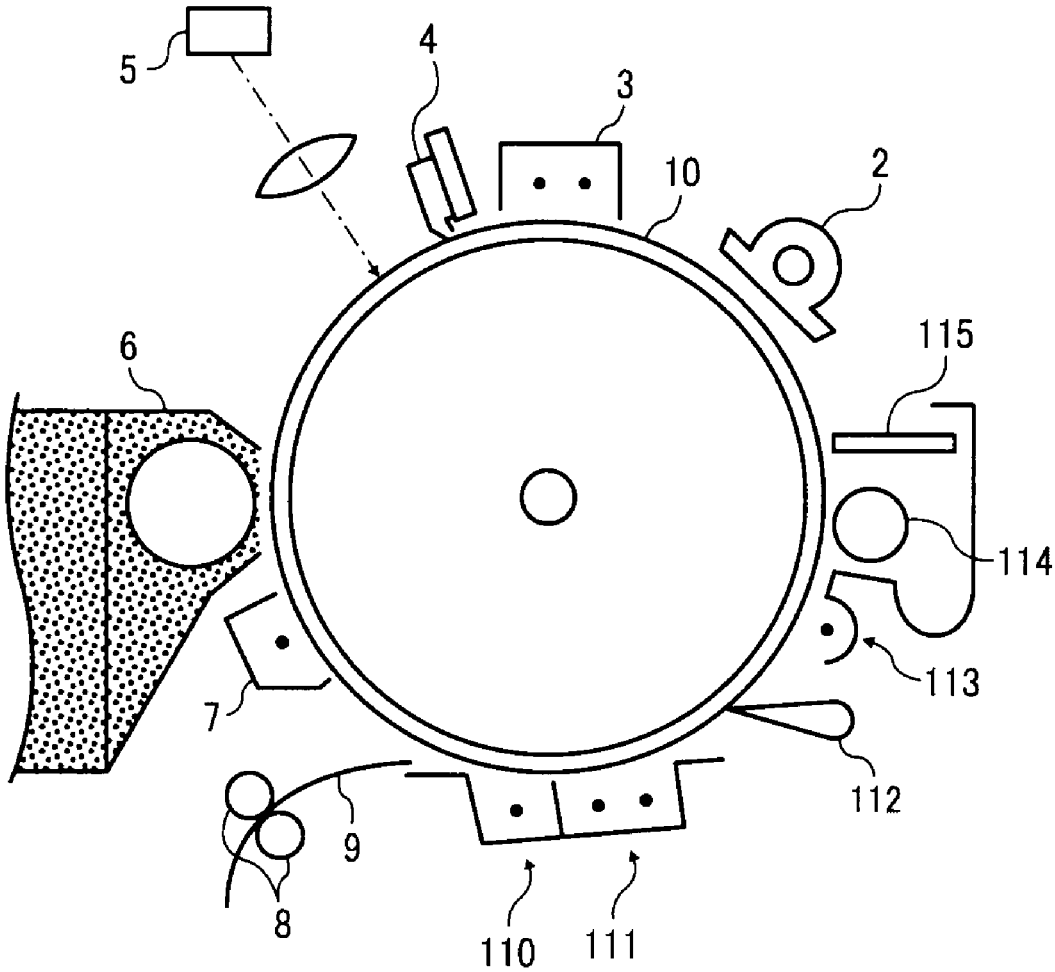
FIG. 6 is a schematic diagram illustrating an example of the image forming apparatus of the present invention.

FIG. 6 is a schematic diagram illustrating an example of the image forming apparatus of the present invention.

The image forming apparatus of FIG. 6 is an image forming apparatus using the latent image bearing member (electrophotographic photoreceptor) formed by a drum-like latent image bearing member (photoreceptor) 10, a charger 3, a pre-transfer charger 7, a transfer charger 110, a separation charger 111, a separation claw 112, and a pre-cleaning charger 113.

The form of the latent image bearing member 10 is not limited to a drum. For example, a latent image bearing member having a sheet form or an endless belt form is suitably used.

In addition, as the charger, a corotoron, scorotoron, a solid state charger, can be used. A known charging roller can be used provided in contact with or in the vicinity of the latent image bearing member by providing a gap tape or a step at the end of the latent image bearing member.

The charging roller provided in the vicinity of the latent image bearing member has a great advantage in comparison with the charging roller in terms of uneven charging, allowability for bad charging ascribable to contamination of the charging roller, and maintenance (no maintenance is required). However, a large application voltage is required, meaning a great hazard to the surface of the latent image bearing member so that extremely severe abrasion occurs to the uppermost surface layer (charge transport layer or protection layer) formed by a typical binder polymer.

In addition, discharging by the charging roller provided in the vicinity of the latent image bearing member is not stable when simply a direct current voltage is used for application. This may lead to uneven density in an image. Therefore, a voltage in which an alternate current voltage is overlapped with a direct current voltage.

Consequently, the hazard to the surface of the latent image bearing member extremely increases. Therefore, the working life of the latent image bearing member becomes short, which results in cost increase and frequent maintenance. However, the latent image bearing member of the present invention is hardly abraded by such a charger and resultantly stably charged.

In addition, since the residual voltage on the irradiated portion is reduced and the image blur is also reduced, the image forming apparatus having the latent image bearing member stably produces quality images for an extended period of time for repetitive use.

As the transfer device, the charger described above can be suitably used. A combinational use of a transfer charger and a separation charger as illustrated in FIG. 6 is suitable. Also, as illustrated in FIG. 6, a method is preferable that uses the separation claw 112 to separate the recording medium (the transfer medium) 9 from the surface of the latent image bearing member 10.

In addition, any known luminescent material such as a fluorescent lamp, a tungsten lamp, a halogen lamp, a mercury lamp, a sodium lamp, a luminescent diode (LED), a semiconductor diode (LED), and electroluminescence (EL) can be suitably used as the light source for an image irradiation portion 5 and a discharging lamp 2. Various kinds of optical filters, for example, a sharp cut filter, a band-pass filter, a near infrared filter, a dichroic filter, a coherent filter and a color conversion filter, can be used in combination with these light sources to irradiate the latent image bearing member with light having only a desired wavelength.

These light sources can be used in processes such as a transfer process using optical irradiation in combination, a discharging process, a cleaning process, or a pre-irradiation to irradiate the latent image bearing member 10 in addition to the processes illustrated in FIG. 6. Furthermore, the embodiment illustrated in FIG. 6 is structured of an eraser 4 that removes the residual toner.

The toner image developed on the latent image bearing member 10 by a development unit 6 is transferred to a recording medium 9. However, some toner is un-transferred and remains on the latent image bearing member 10.

If the next image formation process starts without removing such residual toner, bad cleaning performance and trouble occurring when a latent image is formed by irradiation are repeated.

Therefore, a cleaning device is typically used to remove the residual toner.

At least one of a cleaning brush 114 or a cleaning blade 115 is used as the cleaning device. Any known cleaning brush such as a fur brush, and a magfur brush can be used.

The cleaning blade 115 is formed by an elastic material having a low friction index such as urethane resin, silicone resin, fluorine resin, urethane elastomer, silicone elastomer, and fluorine elastomer.

For the cleaning blade 115, thermocuring urethane resin is preferable and urethane elastomer is particularly preferable in terms of abrasion resistance, ozone resistance and contamination resistance. Elastomer includes rubber. The cleaning blade 115 having a hardness (JIS-A) of from 65 to 85 degree is preferable.

In addition, the cleaning blade 115 preferably has a thickness of from 0.8 to 3.0 mm and a protrusion amount of from 3 to 15 mm.

Furthermore, other conditions such as contact pressure, contact angle and the amount of dent can be suitably determined.

The cleaning device in contact with such a latent image bearing member has a high toner removing property but naturally provides mechanical hazard to the latent image bearing member, thereby causing abrasion of the surface layer thereof.

The latent image bearing member of the present invention has a cross-liked surface layer having an extremely high abrasion resistance. Therefore, quality images are stably produced even when a cleaning device directly in contact with the surface is used.

The image forming apparatus of the present invention has a mechanism (not shown) of supplying and applying a lubricant to the surface of the latent image bearing member.

Particularly, spherical toner has been widely used in recent years because it is advantageous for improvement of the quality of images. However, such removing spherical toner on the latent image bearing member is relatively difficult in comparison with the typical pulverization toner.

Therefore, measures are taken such as increasing the contact pressure of the cleaning blade or using a urethane rubber blade having a high hardness.

However, such measures increase the hazard to the surface of the latent image bearing member with which the blade contacts. In fact, it is found that the abrasion amount of the surface of the latent image bearing member tends to increase when the spherical toner is used.

The latent image bearing member of the present invention has an extremely high abrasion resistance, the cross-linked surface layer is hardly abraded even under the condition of a great hazard. However, problems such as squeaky noise of the blade and abrasion of the edge of the blade tend to occur due to the high friction index between the blade and the surface.

Since the image forming apparatus of the present invention includes the lubricant supplying device that supplies and applies a lubricant to the surface of the latent image bearing member, the friction index of the surface against the cleaning blade is reduced for an extended period of time and thus the problems described above are dissolved.

Figure 7:
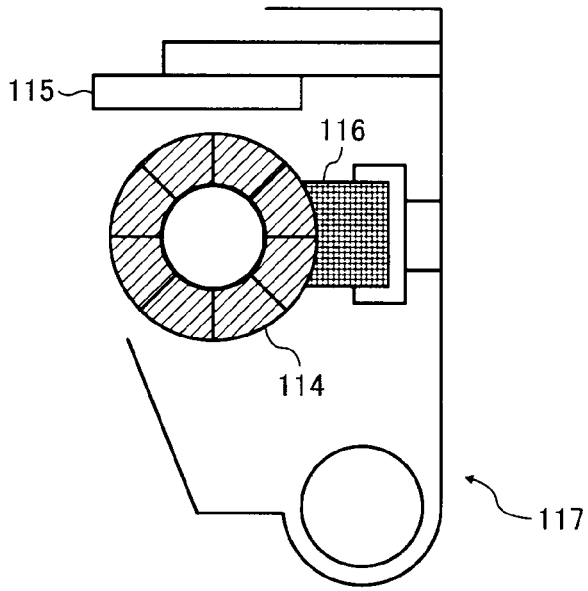
FIG. 7 is a schematic diagram illustrating an example of the lubricant applicator mechanism for use in the image forming apparatus of the present invention.

FIG. 7 is a diagram illustrating a cleaning brush 114 against which a solidified bar-like lubricant 116 is pressed. When the cleaning brush 114 rotates, the lubricant is scraped and the lubricant attached to the brush 114 is applied to the surface of the latent image bearing member.

The lubricant is not necessarily a solid. Powder, liquid, half-kneaded or other lubricant can be suitably used as long as it can be applied to the surface of the latent image bearing member.

However, considering the stability of supplying and ease of handling, a solid lubricant is preferable. Among these, an aliphatic metal salt which is easy to process as a solid lubricant is preferable and particularly a metal salt including at least one aliphatic acid selected from the group consisting of stearic acid, palmitic acid, milistic acid, and oleic acid, and at least one metal selected from the group consisting of zinc, aluminum, calcium, magnesium, iron, and lithium is more preferably used.

As illustrated in FIG. 7, by providing the lubricant to a cleaning unit 117, the layout designing around the drum becomes easy and the mechanism is simplified. However, this mechanism has problems such that a great amount of the lubricant is mixed with the toner so that recycling the toner is difficult or the cleaning efficiency of the brush deteriorates.

An application unit (not shown) having a lubricant supplying device can be provided separately from the cleaning unit to dissolve the problems.

The application unit is preferably provided on the downstream side of the cleaning unit. Furthermore, when multiple application units can be provided at multiple places and operated sequentially or at the same time, the application efficiency of the lubricant is improved and the amount of consumption is controlled.

Figure 8:
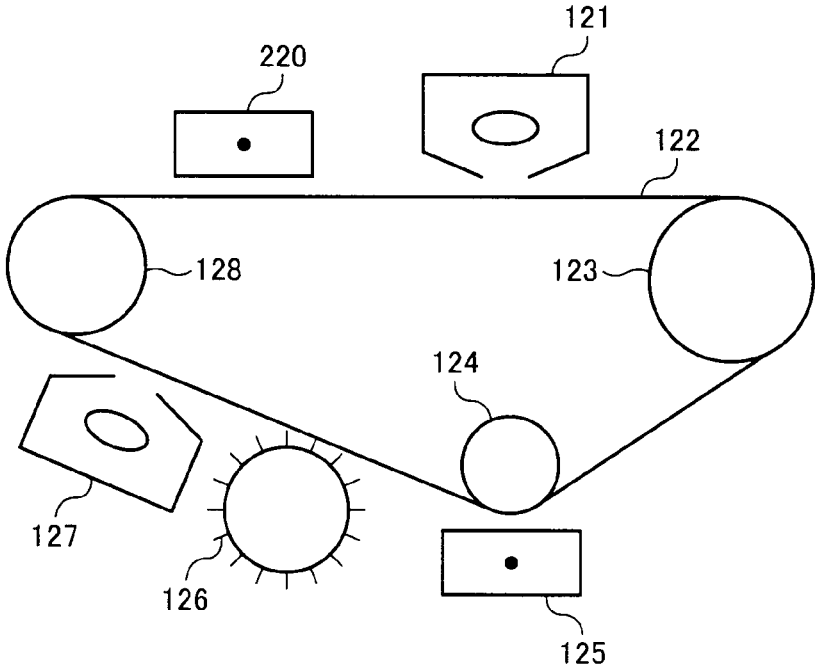
FIG. 8 is a schematic diagram illustrating another example of the image forming apparatus of the present invention.

FIG. 8 is a schematic diagram illustrating another process example of the image forming apparatus of the present invention.

In FIG. 8, a photoreceptor 122 is the latent image bearing member of the present invention and is rotationarily driven by a driving roller 123, a driven roller 128, and a transfer roller 124 to repeatedly conduct charging by a charger 220, irradiation by a image irradiation light source 121 according to data information, development (not shown), transfer by a transfer roller 124 and a transfer charger 125, cleaning by a cleaning brush 126, and discharging by a discharging light source 127.

Figure 9:
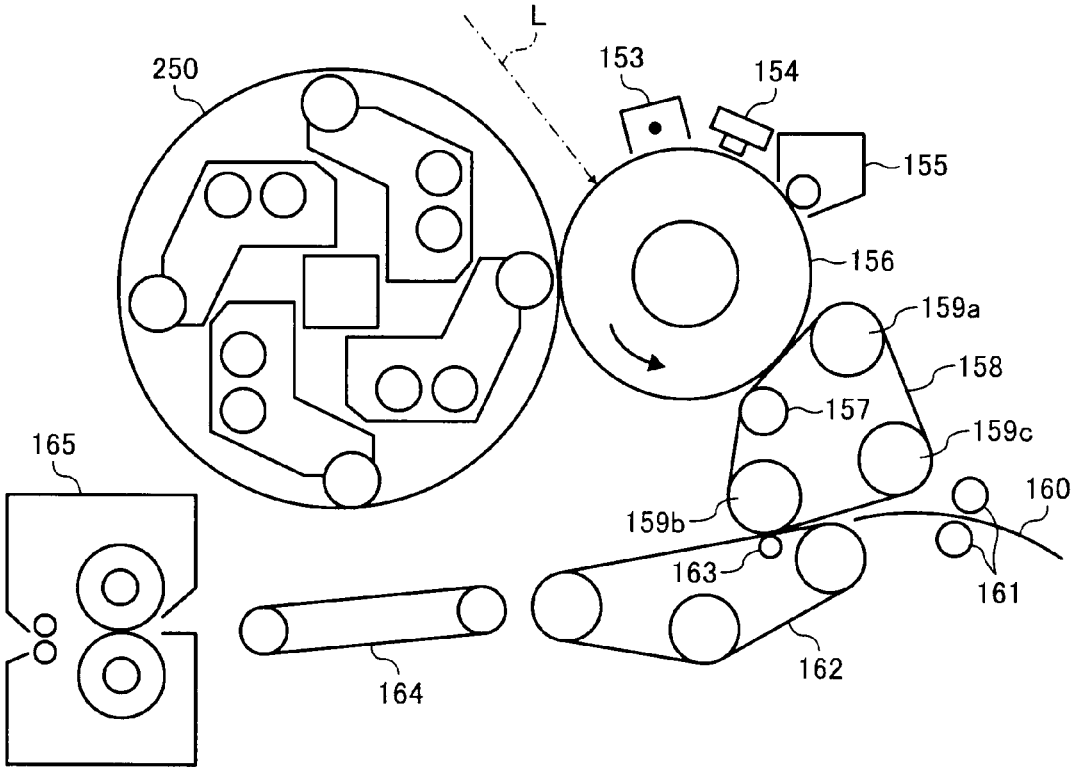
FIG. 9 is a schematic diagram illustrating another example of the image forming apparatus of the present invention.

FIG. 9 is a schematic diagram illustrating a full color image forming apparatus to which the latent image bearing member of the present invention is applied.

In FIG. 9, while a photoreceptor 156 is rotationarily driven counterclockwise, the surface is uniformly charged by a charger 153 such as a corotron, or a scrotron, and then bears a latent electrostatic image upon scanning of a laser beam L emitted from a laser optical device (not shown).

This scanning is conducted according to image information dissembled into single color information of yellow, magenta, cyan and black. Therefore, latent electrostatic images of yellow, magenta, cyan and black are formed on the photoreceptor 156.

On the left side of the photoreceptor 156 in FIG. 9, a revolver development unit 250 is provided.

This unit has a yellow development unit, a magenta development unit, a cyan development unit, and a black development unit in the drum-like housing that rotates, and moves each development unit to the development position opposing the photoreceptor drum 156 sequentially by rotation.

The yellow development unit, the magenta development unit, the cyan development unit, and the black development unit preform development by attachment of the yellow toner, the magenta toner, the cyan toner, and the black toner.

Latent electrostatic images of yellow, magenta, cyan and black are sequentially formed on the photoreceptor drum 156. These images are sequentially developed by each development unit in the revolver development unit 250 to form a yellow toner image, a magenta toner image, a cyan toner image, and a black toner image.

An intermediate transfer unit is provided on the downstream side of the photoreceptor 156 relative to the development position mentioned above.

In this intermediate transfer unit, rotational driving of a belt driving roller 159*c* moves an intermediate transfer belt 158 suspended over a suspension roller 159*a*, an intermediate transfer bias roller 157 functioning as a transfer device, a secondary transfer backup roller 159*b*, and a belt driving roller 159*c*.

The yellow toner image, the magenta toner image, the cyan toner image, and the black toner image developed on the photoreceptor drum 156 enter an intermediate transfer nip where the photoreceptor drum 156 and the intermediate transfer belt 158.

Then, while affected by bias from the intermediate transfer bias roller 184, these toner images are primarily transferred and overlapped on the intermediate transfer belt 158 to form a toner image obtained by overlapping of the four color toner images.

The intermediate transfer system in which toner images are overlapped by using an intermediate transfer belt is relatively easy and accurate to determine the relative position of a photoreceptor and an intermediate transfer body. Therefore, the system is advantageous in terms of color misalignment (shift) and thus suitable to produce quality full color images.

The surface of the photoreceptor 156 that has passed through the intermediate transfer nip according to the rotation is cleaned by a drum cleaning unit 155 to remove the un-transferred residual toner.

This cleaning unit 155 cleans the surface of the photoreceptor drum 156 by a cleaning roller to which a cleaning bias is applied. A cleaning brush formed of a fur brush, or magfur brush or a cleaning can be also used.

The surface of the photoreceptor 156 from which the un-transferred residual toner has been removed is discharged by a discharging lamp 154.

A fluorescent lamp, a tungsten lamp, a halogen lamp, a mercury lamp, a sodium lamp, a luminescent diode (LED), a semiconductor diode (LED), electroluminescence (EL), etc. is used as the discharging lamp 154.

A semi-conductor laser is used as the light source of the optical laser device described above.

Various kinds of optical filters, for example, a sharp cut filter, a band-pass filter, a near infrared filter, a dichroic filter, a coherent filter and a color conversion filter, can be used in combination with these light sources to irradiate the latent image bearing member with light having only a desired wavelength.

A transfer unit formed of a transfer belt and various kinds of rollers such as a transfer bias roller, a driving roller, etc. is arranged below the intermediate transfer unit in FIG. 9. On the left side, a conveyor belt 164 and a fixing unit 165 are arranged.

The transfer belt that moves endlessly may move upward and downward in FIG. 9 by a moving device (not shown). When a single color toner (yellow toner image), or two or three color overlapped toner image on the intermediate transfer belt 158 passes through the opposition position of the secondary transfer bias roller 163, the transfer unit retreats at least to a position where the transfer unit is not in contact with the intermediate transfer belt 158.

Then, the transfer unit moves to the contact position with the intermediate transfer belt 158 to form a secondary transfer nip before the front end of four color overlapped toner image advances into the opposition position of the secondary transfer bias roller 163.

A pair of registration rollers 161 that pinches a recording medium (transfer medium) 160 which is fed from a paper feeder cassette (not shown) between the two rollers feeds the recording medium 160 to the secondary transfer nip at the timing of transferring the four color overlapped toner image on the intermediate transfer belt 158 to the recording medium 160.

The four color overlapped toner image on the intermediate transfer belt 158 is secondarily transferred to the recording medium 160 all at once by the secondary transfer bias from a paper transfer bias roller 163 in the secondary transfer nip.

By this secondary transfer, a full color toner image is formed on the recording medium 160.

The recording medium 160 on which the full color image is formed is sent to the conveyor belt 164 by a transfer conveyor belt 162.

The conveyor belt 164 sends the recording medium received from the transfer unit to the fixing unit 165. The fixing unit 165 conveys the fed recording medium 160 to the fixing nip formed by a contact between a heating roller and a backup roller.

The full color image on the recording medium 160 is caused to fix on the recording medium 150 from heat by the heating roller and pressure in the fixing nip.

A bias is applied to the transfer conveyor belt 162 and the transfer belt 164 to attach the recording medium 160.

In addition, there are provided a recording medium discharger to discharge the recording medium 160 and three belt dischargers to discharge each belt (intermediate transfer belt 158, the transfer conveyor belt 162 and the transfer belt 164).

In addition, the intermediate transfer unit has a belt cleaning unit having the same structure as that of the drum cleaning unit 155, thereby removing the un-transferred residual toner on the intermediate transfer belt 158.

Figure 10:
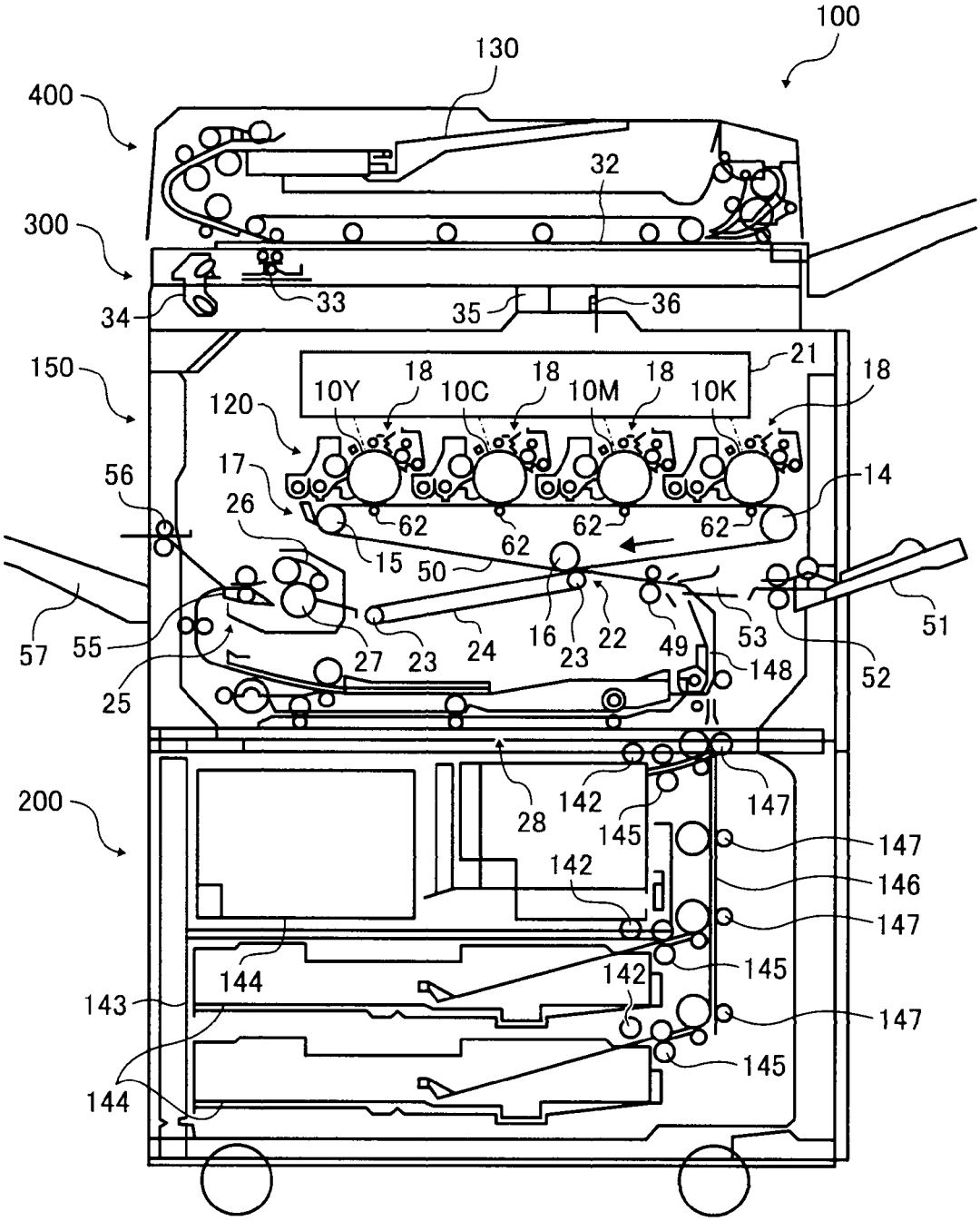
FIG. 10 is a schematic diagram illustrating an example of an image forming apparatus (tandem system, color printing) of the present invention.

FIG. 10 is a diagram illustrating a color image forming apparatus employing a tandem system using the latent image bearing member of the present invention.

A tandem image forming apparatus 100 includes a main body 150 of the image forming apparatus, a paper feeder table 200, a scanner 300, and an automatic document feeder (ADF) 400.

The main body 150 of the image forming apparatus has an intermediate transfer body 50 having an endless form at the center.

The intermediate transfer 50 is suspended over support rollers 14, 15 and 16 and rotatable clockwise in FIG. 10.

An intermediate transfer cleaning device 17 to remove the un-transferred residual toner on the intermediate transfer body 50 is arranged around the support roller 15.

A tandem development device 120 having four image formation units 18 of yellow, cyan, magenta and black is arranged along the intermediate transfer body 50 suspended over the support rollers 14 and 15.

An irradiation device 21 is arranged near the tandem development device 120.

A secondary transfer device 22 is arranged opposite to the tandem development device 120 with the intermediate transfer body 50 therebetween.

In the secondary transfer device 22, a secondary transfer belt 24 having an endless form is suspended over a pair of rollers 23 and a recording medium transferred on the secondary transfer belt 24 is contactable with the intermediate transfer body 50.

A fixing device 25 is arranged near the secondary transfer device 22.

In addition, in the tandem image forming apparatus 100, a sheet reverse device 28 to form images on both sides of the recording medium by reversing the recording medium is arranged near the secondary transfer device 22 and the fixing device 25.

Next, the formation of a full color image using the tandem development device 120 is described.

First, set a document (original) on a document table 130 or open the automatic document feeder 400, set a document on a contact glass 32 on the scanner 300, and close the automatic document feeder 400.

By pressing a start button (not shown), after the document is moved to the contact glass 32 when the document is set on the automatic document feeder 400, or immediately when the document is set on the contact glass 32, the scanner 300 is driven to scan the document on the contact glass 32 with a first scanning unit 33 and a second scanning unit 34.

Then, the document is irradiated with light from the first scanning unit 33, reflection light from the document is redirected at the first scanning unit 33 to the second scanning unit 34. The redirected light is reflected at the mirror of the second scanning unit 34 to a reading sensor 36 through an image focusing lens 35 to read the color document (color image) to obtain black, yellow, magenta and cyan image data information.

Each data information for black, yellow, magenta and cyan is conveyed to each image formation unit 18 (image formation units for black, yellow, magenta and cyan) to form each color toner image by each image formation unit.

Figure 11:
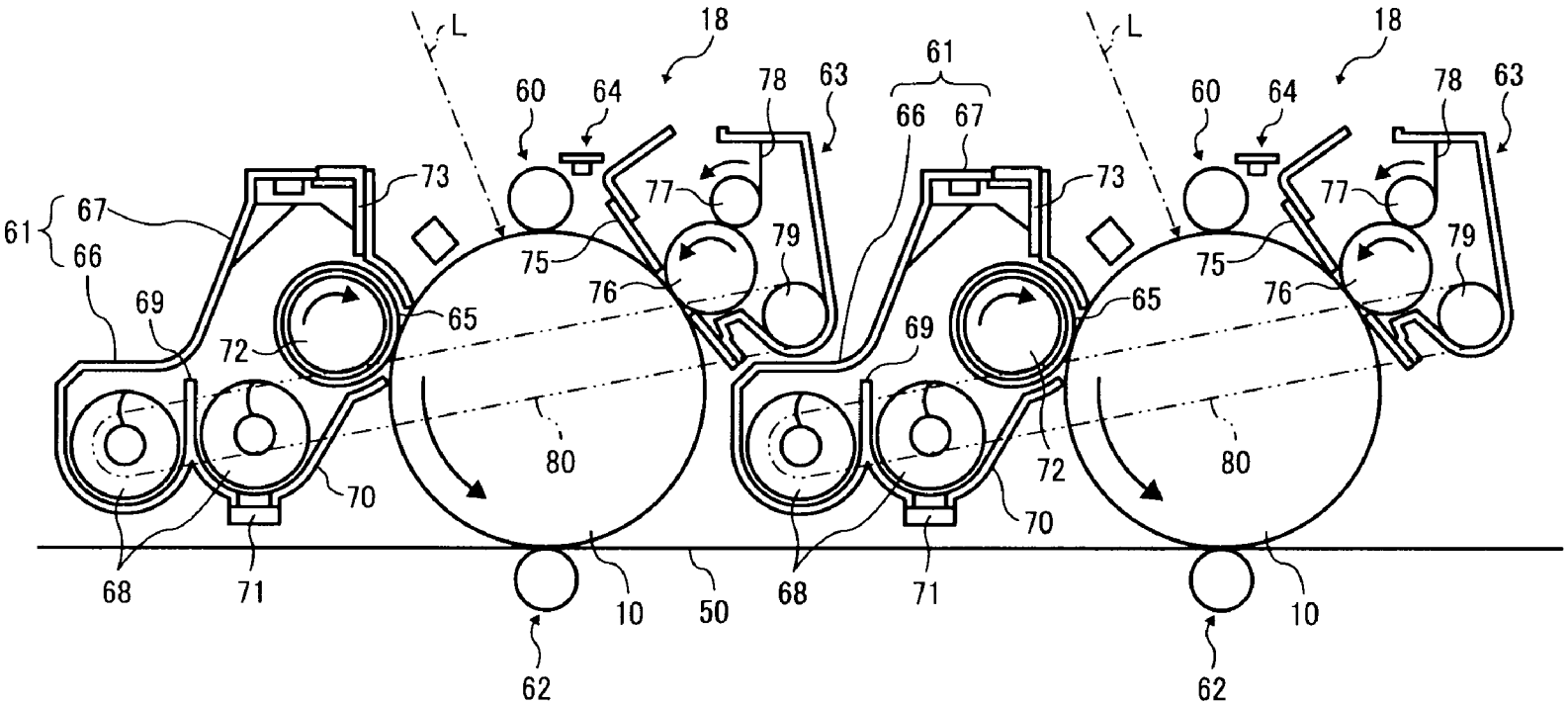
FIG. 11 is an enlarged schematic diagram of a portion of the image forming apparatus illustrated in FIG. 10.

Each image formation unit 18 (image formation units for black, yellow, magenta and cyan) in the tandem development device 120 includes a photoreceptor 10 (a photoreceptor 10K for black, a photoreceptor 10Y for yellow, a photoreceptor 10M for magenta and a photoreceptor 10C for cyan), a charger 60 that uniformly charges the photoreceptor 10, an irradiation device that irradiates the photoreceptor 10 according to each color image data information with beams of light L, a development unit 61 that forms a toner image with each color toner by developing each latent electrostatic image with each color toner (black toner, yellow toner, magenta toner, and cyan toner), a transfer charger 62 that transfer the toner image to the intermediate transfer body 50, a cleaning device 63, and a discharger 64 as illustrated in FIGS. 10 and 11. Therefore, each single color image (black image, yellow image, magenta image, and cyan image) can be formed based on each color image information.

The thus formed black color image, yellow color image, magenta color image, and cyan color image on the photoreceptor 10K for black, a photoreceptor 10Y for yellow, a photoreceptor 10M for magenta and a photoreceptor 10C for cyan, respectively, is primarily transferred to the intermediate transfer body 50 rotated by the support rollers 14, 15 and 16 sequentially.

Then, the black color image, yellow color image, magenta color image, and cyan color image are overlapped on the intermediate transfer body 50 to form a synthesized color image (complex transfer image).

In the paper feeder table 200, one of the paper feeder rollers 142 is selectively rotated to feed a recording medium (sheet) from a paper bank 143 having multiple stacks by separating the recording medium one by one to a paper feeding path 146 by a separation roller 145. Then, the recording medium is guided by transfer rollers 147 to a paper path 148 in the main body 150 of the image forming apparatus, and stopped at a registration roller 49.

Alternatively, the recording medium (sheet) on a manual tray 51 is separated by a separation roller 52 one by one to feed it to a manual sheet feeding path 53 and then the recording medium is stopped at the registration roller 49.

The registration roller 49 is typically grounded but a bias can be applied to remove paper dust on the recording medium.

The registration roller 49 is rotated in synchronization with the synthesized color image (complex transfer image) on the intermediate transfer body 50 to feed the recording medium (sheet) between the intermediate transfer body 50 and the secondary transfer device 22. The synthesized color image (complex transfer image) is secondarily transferred to the recording medium (sheet) to obtain a color image thereon.

The residual toner remaining on the intermediate transfer body 50 after image transfer is removed by a cleaning device 17 for the intermediate transfer body.

The recording medium to which the color image is transferred is sent to the fixing device 25 by the secondary transfer device 22 and the synthesized color image is fixed on the recording medium by heat and pressure at the fixing device 25 using a fixing belt 26 and a pressure roller 27.

Thereafter, the recording medium is discharged outside by a discharging roller 56 by a switching claw 55 and stacked on a discharging tray 57. Alternatively, the recording medium is guided again to the transfer position by the switching claw 55 and the sheet reverse device 28 and then an image is formed on the reverse side. Thereafter, the recording medium is discharged by the discharging roller 56 and stacked on the discharging tray 57.

FIG. 11 is an enlarged diagram illustrating the photoreceptors 10 of the image forming apparatus employing a tandem system illustrated in FIG. 10 and their surroundings. The reference numerals 60, 61, 62, 63, 64, 65, 66, 67, 68, 69, 70, 71, 72, 73, 75, 76, 77, 78, 79 and represent the charging roller, a development unit, a transfer roller, a cleaning unit, a discharging unit, a development sleeve, a stirring unit, a development unit, a stirring screw, a separation board, a development case, a toner density sensor, a development roller, a doctor blade, a cleaning blade, a cleaning brush, a charging roller, a scrapes, a collection screw, and a toner recycling device, respectively.

In the tandem system, each color latent image is formed and developed in parallel so that the image formation speed is faster than the revolver system.

Furthermore, the printer (image forming apparatus) as illustrated in FIG. 10 employs an intermediate transfer system so that when the latent image bearing member of the present invention is installed, full color quality images are stably produced at an extremely high speed without color shift for an extended period of time.

Process Cartridge

The process cartridge of the present invention includes the latent image bearing member of the present invention with at least one device selected from the group consisting of a latent image development device, an irradiation device, a development device, a transfer device, and a cleaning device with other optional devices.

The development device includes at least a development agent container that accommodates the toner or the development agent described above, the latent image bearing member that bear and transfers the toner and the development agent accommodated in the development agent container with optional devices such as a layer thickness regulator that regulates the toner layer thickness borne on the latent image bearing member.

Figure 12:
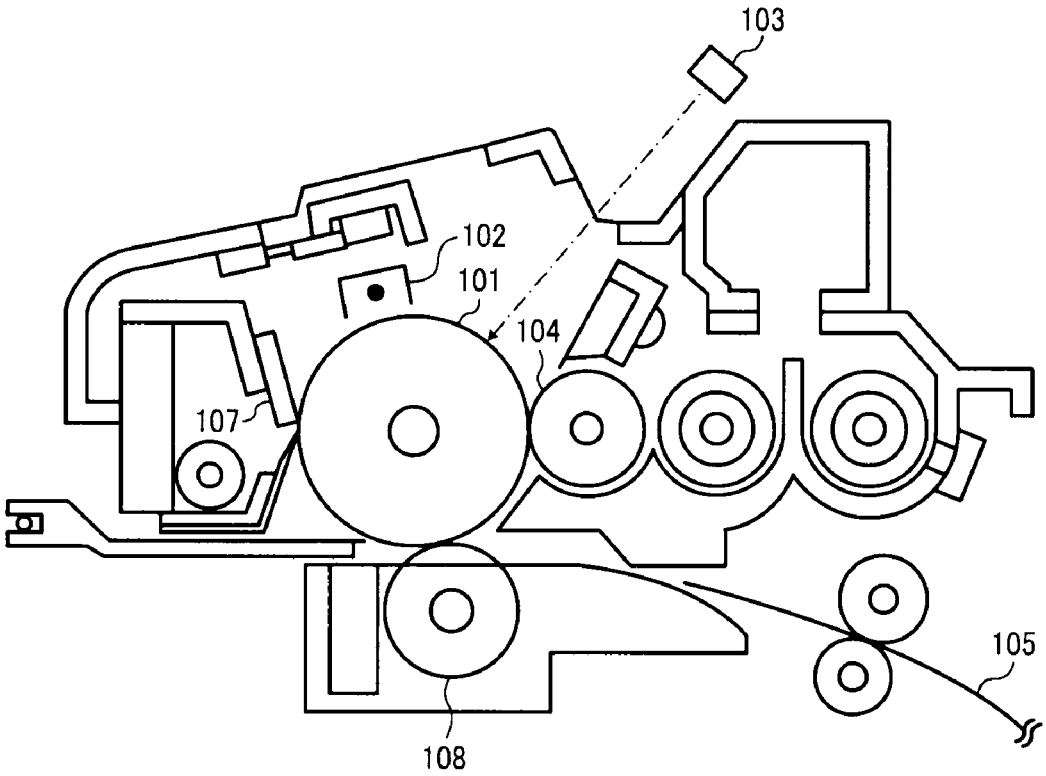
FIG. 12 is a schematic diagram illustrating an example of the process cartridge for use in the image forming apparatus of the present invention.

The process cartridge illustrated in FIG. 12 includes a latent image bearing member (photoreceptor) 101, a charger 102, an irradiation device 103, a development device 104, and a cleaning device 107 with other optional devices.

The reference numerals 105 and 108 represent a recording medium, and a transfer roller 108, respectively.

The latent image bearing member of the present invention is used as the latent image bearing member 101.

A light source that is writable with a high definition is used as the irradiation device 103.

Any known charging member is used as the charger 102.

The process cartridge containing the structure elements such as the latent image bearing member, the development device, and the cleaning device is integrally structured as a unit, which is detachably attached to the image forming apparatus of the present invention.

In addition, a process cartridge can be formed by a latent image bearing member with at least one device selected from the group consisting of a charger, an irradiator, a development device, a transfer device or a separator, and a cleaning device as and structured as a single unit detachably attachable to an image forming apparatus by using a guiding device such as a rail in the image forming apparatus.

Therefore, the latent image bearing member and other process members can be exchanged in a short time with ease, thereby reducing the time and cost to be taken for maintenance.

In addition, since the process members and the latent image bearing member are integrally united, the relational positioning of the members is accurate.

Synthesis Example of Polymerizble Compound Having Charge Transport Structure

A specific example of the polymerizable compounds having a charge transport structure for use in the present invention is a charge transport material having a hydroxyl group, which can be manufactured by, for example, a synthesis method described in Japanese patent No. 3540056.

Synthesis examples of the charge transport material having a hydroxyl group are as follows:

Synthesis Example of Charge Transport Polyol (CTP-2)

Synthesis of [4-methoxy benzil diethylphosphonate]

156.6 parts of 4-methoxy benzil chloride and 332.0 parts of triethyl phosphite are reacted at 150° C. for 5 hours.

Thereafter, excess triethyl phosphite and a by-product of ethyl chloride are removed by distillation under reduced pressure to obtain 227.8 parts of 4-methoxt benzil diethylphosphonate.

Synthesis of [4-methoxy-4'-(di-p-tolyl amino) stilbene]

Equimolar of 77.5 parts of 4-methoxy benzil diethylphosphonate and 90.4 parts of 4-(di-p-tolylamino)benzaldehyde is dissolved in 1,000 parts of N,N-dimethyl formamide and 51.8 parts of tert-buthoxy potassium is added little by little while stirring in eater-cooling condition. After 5 hour stirring at room temperature, water is added and 121.2 parts of a coarse product of the target compound precipitates by acidation.

Furthermore, the coarse product is fined by column chromatography using silica gel to obtain 115.4 parts of the target product of 4-methoxy-4'-(di-p-tolyl amino) stilbene.

Synthesis of [4-hydroxy-4'-(di-p-tolyl amino) stilbene]

40.5 parts of the thus obtained 4-methoxy-4'-(di-p-tolyl amino) stilbene and 16.8 parts of its twice equivalent of sodium ethane thiolate are dissolved in 440 parts of N,N-dimethyl formamide followed by reaction at 130° C. for 5 hours.

Thereafter, the solution is cooled down and poured to water followed by neutralization with hydrochloric acid to extract the target object with ethyl acetate. The liquid extraction is water-washed, dried, and removed with a solvent to obtain 39.2 parts of a coarse produce. Furthermore, the coarse product is fined by column chromatography using silica gel to obtain 35.6 parts of the target product of 4-hydroxy-4'-(di-p-tolyl amino) stilbene (CTP-1) represented by the following Chemical formula 6.

Chemical formula 6

(CTP-1)

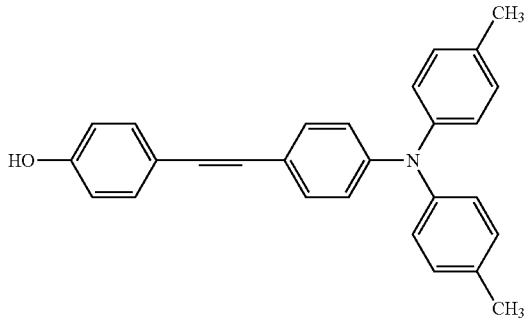

Synthesis of [1,2-dihydroxy-3-[4'-(di-p-tolyl amino) stilbene-4-yloxy]propane 11.75 g of [4-hydroxy-4'-(di-p-tolyl amino) stilbene], 4.35 g of glycidyl methacryalte, and 8 ml of toluene are placed in a reaction container equipped with a stirrer, a thermometer, a condenser, and a dripping funnel and the system is heated to 90° C. followed by addition of 0.16 g of triethylamine. The resultant is heated and stirred at 95° C. for 8 hours.

Thereafter, 16 ml of toluene, and 20 ml of 10% sodium hydroxide are added and the resultant is heated and stirred at 95° C. for 8 hours again.

After completion of the reaction, the resultant is diluted with ethyl acetate. Subsequent to acid-washing followed by water-washing, the solvent is distiled away to obtain 19 g of a coarse product.

Furthermore, according to column chromatography (solvent: ethylacetate) using silica gel, the target object of [1,2-dihydroxy-3-[4'-(di-p-tolyl amino) stilbene-4-yloxy]propane (CTP-2) (OH equivalent: 232.80) represented by the following chemical formula 7 is obtained (yield: 9.85 g, yellow crystal, melting point: 127 to 128.7 g).

Figure 5:
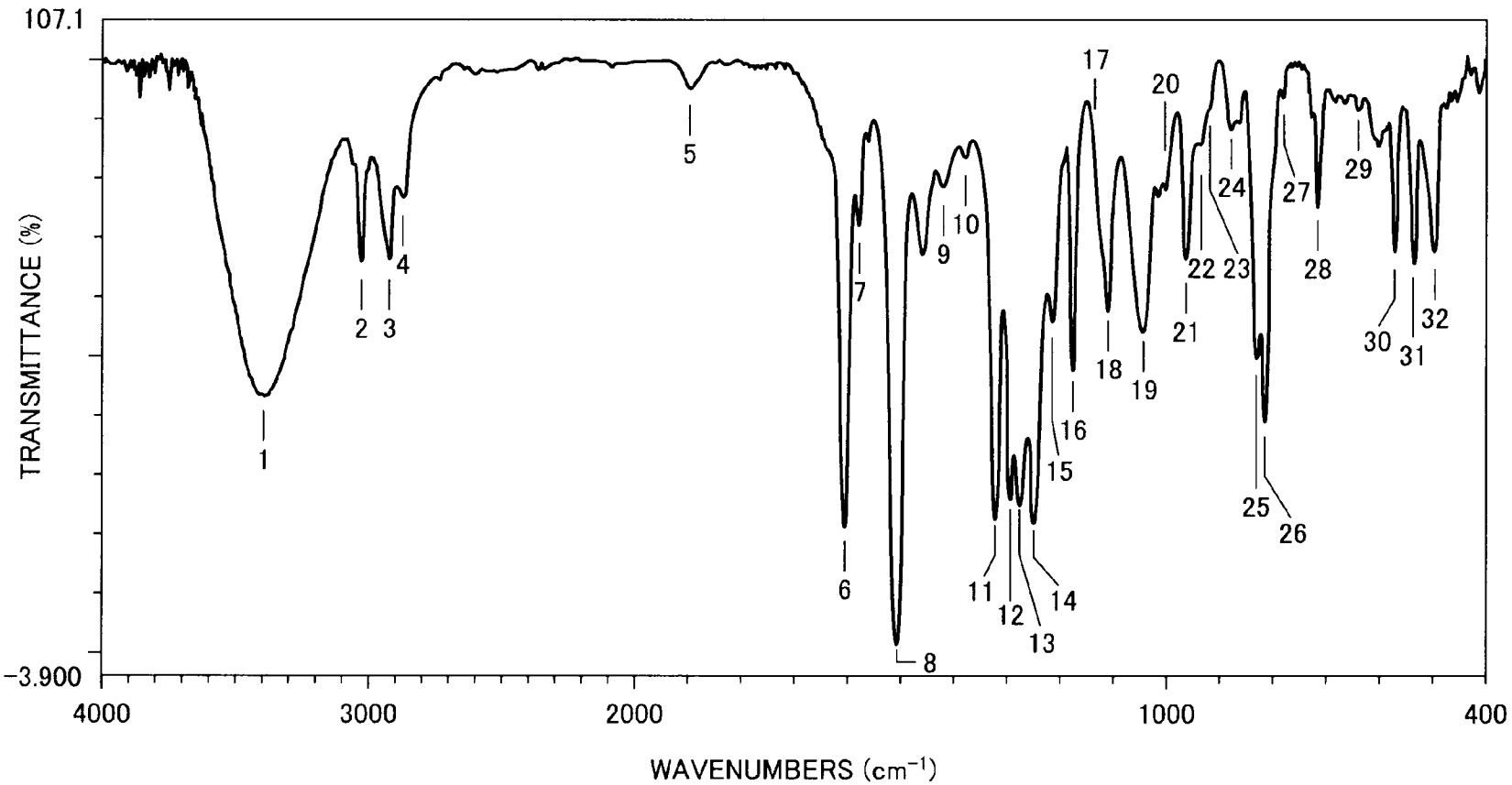
FIG. 5 is a graph illustrating IR measuring data of a polyol (CTP-2) having a charge transport property.

IR measurement data are illustrated in FIG. 5 (IR data No. 1).

Chemical formula 7

(CTP-2)

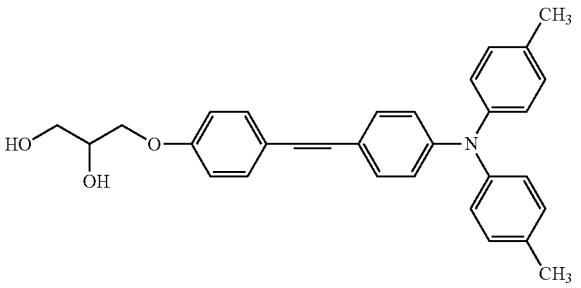

Synthesis Example of Charge Transport Polyol (CTP-4)

Derivatives required for the structure of the target compound are used to synthesize hydroxyaphenylstilbene derivative ({4-[2,2-bis-(4-hydroxyphenyl)-vinyl)-phenyl}-di-p-toluoyl-amine) represented by the following chemical formula 8 (CTP-3) by the same reaction route as that for the synthesis example specified above.

Chemical formula 8

(CTP-3)

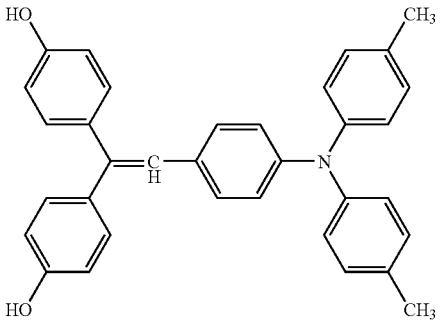

33.9 g of the amine specified above and 35 g of potassium carbonate are placed in a reaction container equipped with a stirrer and 120 ml of DMAc and 3 ml of nitrobenzene are added for dissolution. Then, 70.5 g of 2-bromoethanol is dropped to the reaction container to conduct reaction at 100° C. for 18 hours.

Thereafter, the resultant is cooled down to the room temperature and then, impurities are removed followed by dilution by toluene. Then, the toluene solution is washed with water and salt solution followed by addition of magnesium sulphate for dehydration. Thereafter, the resultant is filtered and the toluene is diluted away to obtain 39.6 g of a coarse product of the target product. Then, the coarse product is refined by a column chromatography using a column filled with silica gel with a developing solvent of a solvent mixture of dichloromethane and ethyl acetate (20/1 to 3/1). The refined product is recrystallized twice using a solvent mixture of toluene and cyclohexane (2/1) to obtain the target product (CTP-4) represented by the following chemical formula 9, i.e., (2-(4-{2-[4-di-p-toluoyl-amino)-phenyl-]-1-[4-(2-hydroxy-phenoxy)-ethanol) (OH equivalent: 285.86)

(Yield: 22.3 g, yellow crystal, melting point: 178.5 to 179.0° C.)

Chemical formula 9

(CTP-4)

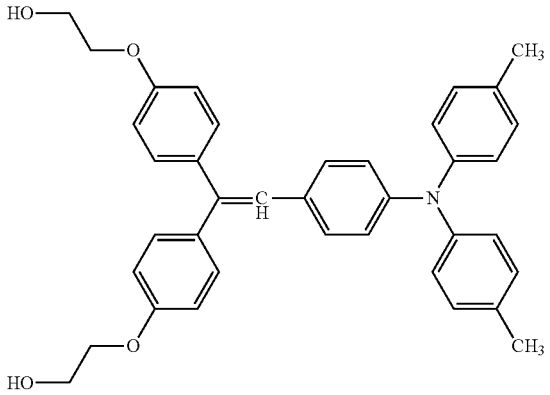

Such charge transport materials form, for example, a cross-linked layer having a uretane bonding by cross-linking with an isocyanate compound, or a cross-linked layer having a siloxane bonding by cross-linking with a silanol compound.

Synthesis Example of Radical Polymerizable Compound Having Charge Transport Structure The radical polymerizable compound having a charge transport structure for use in the present invention can be synthesized by, for example, the method described in Japanese patent No. 3164426.

An example thereof is as follows.

(1) Synthesis of Hydroxyl Group Substituted Triarylamine Compound (Represented by Following Chemical Structure B)

240 ml of sulfolane are added to 113.85 g (0.3 mol) of methoxy group substituted triaryl amine compound represented by the Chemical structure A and 138 g (0.92 mol) of sodium iodide. The mixture is heated to 60° C. in nitrogen air stream.

99 g (0.91 mol) of trimethylchlorosilane is dropped to the resultant solution in one hour. Thereafter, the solution is stirred for 4.5 hours at around 60° C. and the reaction is terminated. About 1.5 litter of toluene is added to the reaction liquid. Subsequent to cooling down to room temperature, the liquid is repeatedly washed with water and sodium carbide aqueous solution. Thereafter, the solvent is removed from the toluene solution. The toluene solution is purified with column chromatography treatment {absorption medium (silica gel), developing solvent (toluene:ethyl acetate=20:1)}. Cyclohexane is added to the obtained light yellow oil to precipitate crystal. 88.1 g (yield ratio=80.4%) of the white crystal represented by the following Chemical structure B is thus obtained. The element analysis values are shown in Table 1.

Melting point: 64.0-66.0 degree C.

TABLE 1

| | Element Analysis Value (%) | | |
|---|---|---|---|
| | C | H | N |
| Measured value | 85.06 | 6.41 | 3.73 |
| Calculated value | 85.44 | 6.34 | 3.83 |

Chemical structure A

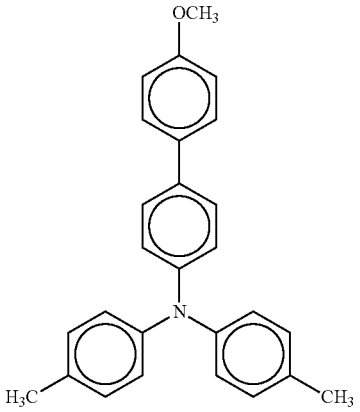

Chemical structure B

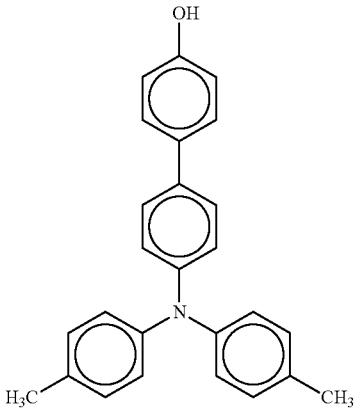

(2) Triaryl Amino Group Substituted Acrylate Compound (Illustrated Chemical Compound No. 54)

82.9 g (0.227 mol) of the hydroxyl group substituted triaryl amine compound (Chemical structure B) obtained in (1) is dissolved in 400 ml of tetrahydrofuran and sodium hydroxide aqueous solution (NaOH: 12.4 g, water: 100 ml) is dropped thereto.

The solution is cooled down to 5° C. and 25.2 parts (0.272 mol) of chloride acrylate is dropped thereto in 40 minutes. Thereafter, the solution is stirred for 3 hours at 5° C., and the reaction is terminated. The resultant reaction liquid is poured to water and extracted by toluene. The extracted liquid is repeatedly washed with sodium acid carbonate and water. Thereafter, the solvent is removed from the toluene aqueous solution and purified by column chromatography treatment (absorption medium: silica gel, development solvent: toluene). n-hexane is added to the obtained colorless oil to precipitate crystal.

80.73 g (yield ratio: 84.8%) of white crystal of the Illustrated Chemical Compound No. 54 is thus obtained.

The element analysis values are shown in Table 2. Melting point: 117.5-119.0 degree C.

TABLE 2

| | Element Analysis Value (%) | | |
|---|---|---|---|
| | C | H | N |
| Measured value | 83.13 | 6.01 | 3.16 |
| Calculated value | 83.02 | 6.00 | 3.33 |

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Liquid application having the following recipe is applied to an aluminum substrate (outer diameter: 100 mm Φ) by a dip coating method to form an undercoating layer having a layer thickness of 3.5 μm after drying at 130° C. for 20 minutes.

Liquid Application for Undercoating Layer

| | |
|---|---|
| Alkyd resin (Beckozole 1307-60-EL, manufactured by Dainippon Ink and Chemicals, Inc.) | 6 parts |
| Melamine resin (Super-beckamine G-821-60, manufactured by Dainippon Ink and Chemicals, Inc.) | 4 parts |
| Titanium oxide (CR-EL, manufactured by Ishihara Sangyo Kaisha, Ltd.) | 40 parts |
| Methylethyl ketone | 50 parts |

Liquid application for charge generation layer containing the bisazo pigment represented by the following chemical formula 10 is applied to this undercoating layer by a dip coating followed by heating and drying at 130° C. for 20 minutes to form a charge generation layer having a layer thickness of 0.2 μm.

Liquid Application for Charge Generation Layer

| | |
|---|---|
| Bisazo pigment represented by the following chemical formula 10 | 2.5 parts |

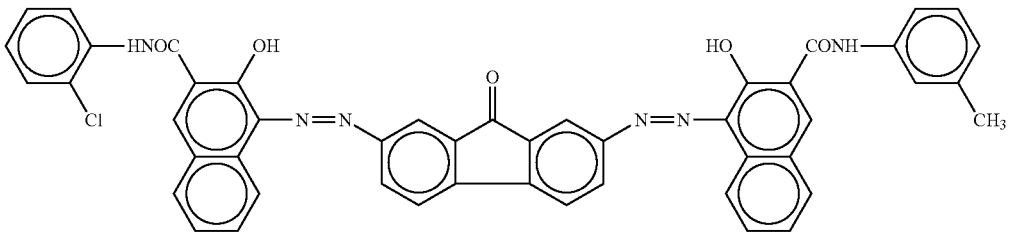

Chemical formula 10

| | |
|---|---|
| Polyvinyl butyral {XYHL, manufactured by Union Carbide Corporation (UCC)} | 0.5 parts |
| Cyclohexanone | 200 parts |
| Methylethyl ketone | 80 parts |

Liquid application for charge transport layer containing the following recipe is applied to the charge generation layer by a dip coating followed by heating and drying at 130° C. for 20 minutes to form a charge transport layer having a layer thickness of 22 μm.

Liquid Application for Charge Transport Layer

| | |
|---|---|
| Bisphenol Z type polycarbonate | 10 parts |
| Charge transport material having a small molecular weight represented by the following chemical formula 11 | 10 parts |

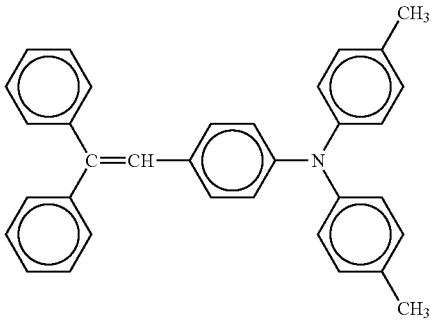

Chemical formula 11

| | |
|---|---|
| Tetrahydrofuran | 80 parts |

The liquid application for cross-linked surface layer having the following recipe is spray-applied to the charge transfer layer in the nitrogen atmosphere and left in the nitrogen atmosphere for 10 minutes followed by drying by finger touch.

Thereafter, the resultant is placed in a UV irradiation booth in which air is replaced with nitrogen air such that the oxygen density is 2% or less and irradiated with light under the following conditions (metal halide lamp: 160 W/cm, Irradiation length: 120 mm, Irradiation intensity: 700 mW/cm$^2$, Irradiation time: 60 seconds) followed by drying at 130° C. for 20 minutes to form a cross-linked surface layer having a layer thickness of 8 μm. Thus, the latent image bearing member (photoreceptor) of the present invention is obtained.

Liquid Application for Cross-linked Surface Layer

Radical polymerizable monomer having three or more functional groups with no charge transport structure: (trimethylol propane triacrylate: KAYARAD TMPTA, manufactured by Nippon Kayaku Co., Ltd., molecular weight of 296, number of functional groups: 3 functional groups, molecular weight/number of functional groups=99)

| | |
|---|---|
| Radical polymerizable compound having one functional group with a charge transport structure (Illustrated Compound No. 54) | 10 parts |

No. 54

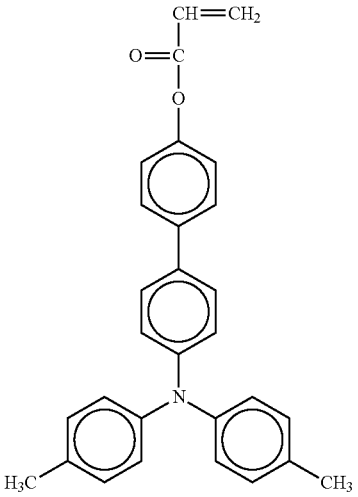

Chemical formula 12

| | |
|---|---|
| Photo polymerization initiator (1-hydroxy-cyclohexyl-phenyl-ketone (IRGACURE 184, manufactured by Chiba Specialty Chemicals)} | 1 part |
| Tetrahydrofuran solution of 1% UV curing type leveling agent (mixture of polyester modified polydimethyl siloxane having acrylic group and propoxy-modified-2-neopentyl glycol diacrylate: Product name BYK-UV 3570, manufactured by BYK Chemie) | 5 parts |
| Tetrahydrofuran | 100 parts |

Example 2

A photoreceptor of Example 2 is manufactured in the same manner as in Example 1 except that the radical polymerizable monomer having three or more functional groups without a charge transport structure contained in the liquid application for cross-linked surface layer is replaced with the following monomer.

Radical polymerizable monomer having three or more functional groups with no charge transport structure: (dipentaerythritol caprolactone modified hexaacrylate (KAYARAD DPCA-60, manufactured by Nippon Kayaku Co., Ltd.) molecular weight of 1,263, 6 functional groups, molecular weight/number of functional groups=211)] 10 parts Example 3

A photoreceptor of Example 3 is manufactured in the same manner as in Example 1 except that the radical polymerizable monomer having three or more functional groups without a charge transport structure contained in the liquid application for cross-linked surface layer is replaced with the following monomer.

Radical polymerizable monomer having three or more functional groups with no charge transport structure: (dipentaerythritol caprolactone modified hexaacrylate (KAYARAD DPCA-120, manufactured by Nippon Kayaku Co., Ltd., molecular weight of 1,947, 6 functional groups, molecular weight/the number of functional groups=325)] 10 parts Example 4

A photoreceptor of Example 5 is manufactured in the same manner as in Example 1 except that the radical polymerizable compound having one functional group with a charge transport structure contained in the liquid application for cross-linked surface layer is replaced with 10 parts of the illustrated compound No. 1.

Chemical formula 14

No. 1

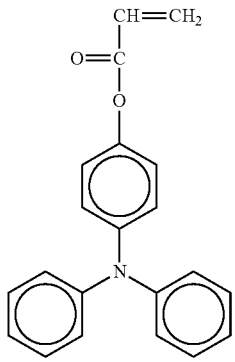

Example 5

A photoreceptor of Example 5 is manufactured in the same manner as in Example 1 except that the radical polymerizable compound having one functional group with a charge transport structure contained in the liquid application for cross-linked surface layer is replaced with 10 parts of the illustrated compound No. 53.

Chemical formula 15

No. 53

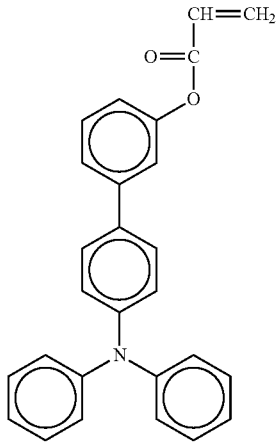

Example 6

A photoreceptor of Example 6 is manufactured in the same manner as in Example 1 except that the radical polymerizable compound having one functional group with a charge transport structure contained in the liquid application for cross-linked surface layer is replaced with 10 parts of the illustrated compound No. 127.

Chemical formula 16

No. 127

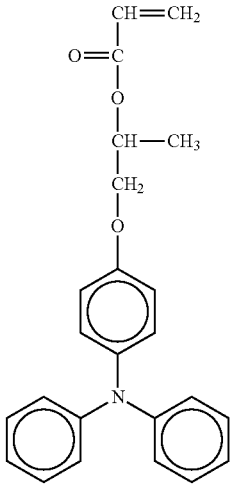

Example 7

A photoreceptor of Example 7 is manufactured in the same manner as in Example 1 except that the cross-linked surface layer is spray-applied in the atmosphere instead of the nitrogen atmosphere.

Example 8

A photoreceptor of Example 8 is manufactured in the same manner as in Example 1 except that the UV irradiation starts when the oxygen density in the booth is 5% or less while nitrogen gas is sprayed to the portion irradiated with UV light.

Example 9

A photoreceptor of Example 9 is manufactured in the same manner as in Example 1 except that the content of the tetrahydrofuran solution of 1% UV curing type leveling agent contained in the liquid application for cross-linked surface layer is changed to 1 part.

Example 10

A photoreceptor of Example 10 is manufactured in the same manner as in Example 1 except that the tetrahydrofuran solution of 1% UV curing type leveling agent contained in the liquid application for cross-linked surface layer is replaced with the following:

Tetrahydrofuran solution of 1% silicone oil (KF-50-100CS, manufactured by Shin-Etsu Chemical Co., Ltd.)

5 parts

Example 11

A photoreceptor of Example 11 is manufactured in the same manner as in Example 1 except that the tetrahydrofuran solution of 1% UV curing type leveling agent contained in the liquid application for cross-linked surface layer is replaced with the following: Tetrahydrofuran solution of 1% silicone oil (KF-50-100CS, manufactured by Shin-Etsu Chemical Co., Ltd.

1 part

Example 12

An undercoating layer, a charge generation layer, and a charge transport layer are sequentially laminated on an aluminum mad substrate in the same manner as in Example 1.

The liquid application for cross-linked surface layer having the following recipe is spray-applied to the charge transfer layer in the nitrogen atmosphere and left in the nitrogen atmosphere for 10 minutes followed by drying by finger touch. Thereafter, the resultant is heated at 150° C. for 30 minutes in an oven in which nitrogen gas is introduced into the booth for replacement such that the oxygen density is 2% or less to obtain a surface layer having a thickness of 5 μm. Thus, a photoreceptor is manufactured.

| | |
|---|---|
| Polyol (copolymer of styrene - acryl formed by styrene, methylmethacrylate, and hydroxyethylmethacrylate) (polyol = LZR-170, solid portion 41% by weight, manufactured by Fujikura Kasei Co., Ltd.) | 20 parts |
| Charge transport material having hydroxyl group (CTP-4) | 20 parts |
| Isocyanate (adduct of polyol of trilene diisocyanate)(isocyanate = Coronate L, solid portion 75%, manufactured by Nippon Polyurethane Industry Co., Ltd.) | 38 parts |
| Tetrahydrofuran solution of 1% silicone oil (KF-50-100CS, manufactured by Shin-Etsu Chemical Co., Ltd. | 5 parts |
| Cyclohexanone | 50 parts |
| Tetrahydrofuran | 200 parts |

Example 13

A photoreceptor of Example 13 is manufactured in the same manner as in Example 12 except that the content of polyol (LZR-170) is changed to 20 parts, CTP-4 is replaced with 20 parts of CTP-2, and the content of isocyanate (Coronate L) is changed to 46 parts.

Comparative Example 1

A photoreceptor of Comparative Example 1 is manufactured in the same manner as in Example 1 except that the cross-linked surface layer is spray-applied in the atmosphere instead of the nitrogen atmosphere, followed by drying by finger touch, and no nitrogen gas is introduced in the booth at UV irradiation (i.e., irradiation of UV light is conducted in the atmosphere).

Comparative Example 2

A photoreceptor of Comparative Example 2 is manufactured in the same manner as in Example 1 except that no nitrogen gas is introduced in the booth at UV irradiation (i.e., irradiation of UV light is conducted in the atmosphere).

Comparative Example 3

A photoreceptor of Comparative Example 1 is manufactured in the same manner as in Example 1 except that the cross-linked surface layer is spray-applied in the atmosphere instead of the nitrogen atmosphere, followed by drying by finger touch, the nitrogen gas is sprayed to the portion irradiated with UV light such that the oxygen density in the booth is left uncontrolled.

Comparative Example 4

A photoreceptor of Comparative Example 4 is manufactured in the same manner as in Example 1 except that the content of the tetrahydrofuran solution of 1% UV curing type leveling agent contained in the liquid application for cross-linked surface layer is changed to 0.1 parts.

Comparative Example 5

A photoreceptor of Comparative Example 5 is manufactured in the same manner as in Example 1 except that the content of the tetrahydrofuran solution of 1% UV curing type leveling agent contained in the liquid application for cross-linked surface layer is changed to 20 parts.

A1, A2, B1, and B2 are calculated for each of the thus obtained photoreceptors.

Furthermore, these photoreceptors are installed on the black station of a full color printer remodeled based on Ricoh Pro C900, manufactured by Ricoh Co., Ltd. and evaluated in the following conditions with regard to image blur.

Evaluation on Image Blur

A test chart of black color is continuously printed on 5,000 sheets in the environment of 27° C. and 85% RH and thereafter, the image forming apparatus is powered off.

After 24 hours, the image forming apparatus is powered on and a solid half tone image of black color of 1,200 dpi and 2 by 2 is output to evaluate image blur (thinned or missing image).

The results are shown in Table 3.

TABLE 3

| | Oxygen atom content ratio | | Silicon atom content ratio | | \|(A1 − B1) − (A2 − | | Image |
|---|---|---|---|---|---|---|---|
| | A1 | A2 | B1 | B2 | B2)\| | X | blur |
| Ex. 1 | 19.98 | 13.46 | 6.31 | 2.91 | 3.12 | 11 | G |
| Ex. 2 | 19.73 | 14.39 | 5.92 | 2.55 | 1.97 | 10 | E |
| Ex. 3 | 20.01 | 14.11 | 4.87 | 2.21 | 3.24 | 8 | G |
| Ex. 4 | 21.32 | 16.35 | 5.02 | 2.44 | 2.39 | 10 | E |
| Ex. 5 | 19.66 | 15.14 | 6.22 | 3.07 | 1.37 | 11 | E |
| Ex. 6 | 22.56 | 17.84 | 5.89 | 2.76 | 1.59 | 15 | E |
| Ex. 7 | 22.24 | 15.59 | 5.81 | 2.46 | 3.3 | 11 | G |
| Ex. 8 | 22.84 | 14.56 | 5.95 | 2.31 | 4.64 | 9 | F |
| Ex. 9 | 18.55 | 14.96 | 3.21 | 1.26 | 1.64 | 10 | E |
| Ex. 10 | 19.87 | 15.66 | 5.92 | 2.75 | 1.04 | 4 | E |
| Ex. 11 | 20.01 | 14.87 | 3.57 | 1.03 | 2.63 | 5 | E |
| Ex. 12 | 19.33 | 16.42 | 4.88 | 2.26 | 0.29 | 4 | E |
| Ex. 13 | 20.34 | 16.97 | 5.37 | 2.51 | 0.51 | 5 | E |
| Comp. 1 | 24.24 | 14.13 | 6.12 | 3.01 | 7.00 | 9 | B |
| Comp. 2 | 23.85 | 14.71 | 5.64 | 2.53 | 6.03 | 10 | B |
| Comp. 3 | 24.06 | 13.88 | 5.62 | 2.41 | 6.97 | 11 | B |
| Comp. 4 | 18.44 | 14.72 | 0.63 | 0.11 | 3.20 | 4 | — (*1) |
| Comp. 5 | 27.38 | 21.01 | 12.01 | 6.56 | 0.92 | ≧30 (*2) | B |

Ex. = Example

Comp. = Comparative Example (*1): Not evaluated because cleaning blade turned inward or outward (*2): After sputtering 30 times by C60, the surface is dug until the depth point o 30 nm along the perpendicular direction but the silicon atom content ratio does not decrease to ½ of that of the surface.

The evaluation criteria are as follows:

E (Excellent): No image blur occurs

G (Good): Slight image blur observed just below charger causing no practical problem F (Fair): Slight image blur observed just below charger and in the peripheral direction on the rear side of the image forming apparatus causing no practical problem B (Bad): Image blur observed just below charger, and almost entirely in the peripheral direction on the rear side of the image forming apparatus As seen in the results of Table 3, image blur hardly occurs after the image forming apparatus structured of any one of the latent image bearing members of Examples 1 to 11 outputs images on 5,000 sheets while applying the lubricant to the latent image bearing member and then is left for 24 hours in a high temperature and high moisture environment.

To the contrary, the latent image bearing member of any one of Comparative Examples 1 to 3 having a value of the left member of Relationship (I) greater than 5.0, image blur significantly occurs in the same condition.

A thinkable mechanism of this is that, since oxygen is present in a great amount at the ends of the functional groups that inhibit cross-linking of the surface of the latent image bearing member, this function as absorption sites of materials causing image blur.

In addition, in Comparative Example 4, which has a B1 value less than 1, the cleaning blade in contact with the latent image bearing member against the rotation direction thereof turns reversely and fails to continue printing images on the 5,000 sheets. Therefore, the evaluation is not made for Comparative Example 4.

This is thought to be because the surface lubricity of the latent image bearing member before zinc stearate is not sufficiently applied because the content of the leveling agent is too small, thereby increasing the abrasion force between the latent image bearing member and the cleaning blade.

Image blur is observed in Comparative Example 5 because the silicon atom content ratio at a point of 30 nm dug from the surface latent image bearing member along the perpendicular direction from the surface of the latent image bearing member to the electroconductive substrate after 30 time sputtering by C60 is not reduced to 1/2 of the silicon atom content ratio at the surface of the latent image bearing member.

This is thought to be because the content of the curable leveling agent is excessive so that the siloxane unit is present at a deep point along the perpendicular direction from the surface of the latent image bearing member to the electroconductive substrate, which inhibits cross-linking, resulting in occurrence of image blur.

As described above, according to the present invention, an image forming apparatus is provided which includes a latent image bearing member that bears a latent electrostatic image, a charging device that charges the surface of the latent image bearing member, a latent image formation device that forms the latent electrostatic image on the latent image bearing member, a development device that develops the latent electrostatic image with a toner or a development agent to obtain a developed image on the downstream side of the charging device relative to the rotation direction of the latent image bearing member, a transfer device that transfers the developed image formed on the latent image bearing member to a transfer body, and a lubricant supplying device that supplies a lubricant to the surface of the latent image bearing member on the downstream side of the transfer device and on the upstream side of the charging device relative to the rotation direction of the latent image bearing member. The latent image bearing member includes a photosensitive layer on an electroconductive substrate. The surface of the photosensitive layer contains at least a silicone based compound and is a cross-linked surface layer formed by curing a polymerizable compound having a charge transport structure. The latent image bearing satisfies the following relationships of Relationship (I), Relationship (II) and Relationship (III):

$$|(A1-B1)-(A2-B2)|\leqq 5.0 \quad \text{Relationship (I)}$$

$$B1\geqq 1 \text{ (atomic \%)} \quad \text{Relationship (II)}$$

$$1 \text{ (nm)}\leqq X\leqq 30 \text{ (nm)} \quad \text{Relationship (III)},$$

where, according to XPS analysis, A1 represents an oxygen atom content ratio in the cross-linked surface layer, B1 represents a silicon atom content ratio therein, A2 represents an oxygen atom content ratio in a surface obtained by digging through the cross-linked surface layer along a direction perpendicular to the surface of the latent image bearing member to the electroconductive substrate to a depth point X where the silicon atom content ratio of B1 decreases to not greater than B1×0.5, and B2 represents the silicone atom content ratio in the surface at the depth point X. Thus, the image forming apparatus has an extremely improved durability and stably produces quality images free of image blur even in a high temperature and high moisture environment for an extended period of time.

This document claims priority and contains subject matter related to Japanese Patent Application No. 2009-171947, filed on Jul. 23, 2010, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus, comprising:

a latent image bearing member that bears a latent electrostatic image, comprising a photosensitive layer on an electroconductive substrate, the photosensitive layer having a surface comprising a silicone-based compound and being a cross-linked surface layer formed by curing a polymerizable compound having a charge transport structure;

a charging device that charges a surface of the latent image bearing member;

a latent electrostatic image formation device that forms a latent electrostatic image on a surface of the latent image bearing member;

a development device that develops the latent electrostatic image with a toner or a development agent to obtain a developed image, disposed downstream of the charging device relative to a rotation direction of the latent image bearing member;

a transfer device that transfers the developed image formed on the surface of the latent image bearing member to a transfer medium; and a lubricant supplying device that supplies a lubricant to the surface of the latent image bearing member, disposed downstream of the transfer device and upstream of the charging device relative to the rotation direction of the latent image bearing member, the latent image bearing member satisfying the following relationships of Relationship (I), Relationship (II) and Relationship (III):

$$|(A1-B1)-(A2-B2)|\leqq 5.0 \quad \text{Relationship (I)}$$

$$B1\geqq 1 \text{ (atomic \%)} \quad \text{Relationship (II)}$$

$$1 \text{ (nm)}\leqq X\leqq 30 \text{ (nm)} \quad \text{Relationship (III)},$$

wherein, according to XPS analysis:

A1 represents an oxygen atom content ratio in the cross-linked surface layer;

B1 represents a silicon atom content ratio therein;

A2 represents an oxygen atom content ratio in a surface obtained by digging through the cross-linked surface layer along a direction perpendicular to the surface of the latent image bearing member to the electroconductive substrate to a depth point X where the silicon atom content ratio of B1 decreases to not greater than B1×0.5; and B2 represents the silicone atom content ratio in the surface at the depth point X.

2. The image forming apparatus according to claim 1, wherein the silicone based compound is a polysiloxane-based compound.

3. The image forming apparatus according to claim 1, wherein the cross-linked surface is formed by curing a radical polymerizable monomer having three or more functional groups without a charge transport structure, and a radical polymerizable compound having one functional group with a charge transport structure.

4. The image forming apparatus according to claim 3, wherein the functional groups of the radical polymerizable monomer having three or more functional groups without a charge transport structure are at least one of an acryloyloxy group and a methacryloyloxy group.

5. The image forming apparatus according to claim 3, wherein a ratio (molecular weight/number of functional groups) of a molecular weight to a number of functional groups of the radical polymerizable monomer having three or more functional groups without a charge transport structure is 250 or less.

6. The image forming apparatus according to claim 3, wherein the functional group of the radical polymerizable compound having one functional group with a charge transport structure is an acryloyloxy group or a methacryloyloxy group.

7. The image forming apparatus according to claim 3, wherein the charge transport structure of the radical polymerizable compound having one functional group with a charge transport structure is a triaryl amine structure.

8. The image forming apparatus according to claim 3, wherein the radical polymerizable compound having one functional group with a charge transport structure comprises a compound represented by a Chemical Structure 1 or 2;

Chemical Structure 1

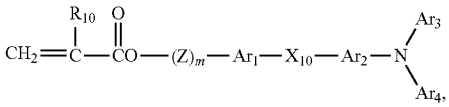

Chemical Structure 2

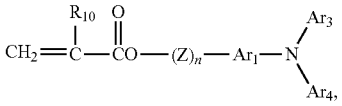

wherein:

$R_{10}$ represents hydrogen atom, a halogen atom, a substituted or non-substituted alkyl group, a substituted or non-substituted aralky group, a substituted or non-substituted aryl group, a cyano group, a nitro group, an alkoxy group, —$COOR_{11}$;

$R_{11}$ represents hydrogen atom, a halogen atom, a substituted or non-substituted alkyl group, a substituted or non-substituted aralkyl group or a substituted or non-substituted aryl group), a halogenated carbonyl group or $CONR_{12}R_{13}$;

$R_{12}$ and $R_{13}$ independently represent hydrogen atom, a halogen atom, a substituted or non-substituted alkyl group, a substituted or non-substituted aralkyl group or a substituted or non-substituted aryl group;

$Ar_1$ and $Ar_2$ independently represent a substituted or non-substituted arylene group;

$Ar_3$ and $Ar_4$ independently represent a substituted or non-substituted aryl group;

X represents a single bond, a substituted or non-substituted alkylene group, a substituted or non-substituted cycloalkylene group, a substituted or non-substituted alkylene ether group, oxygen atom, sulfur atom, or vinylene group;

Z represents a substituted or non-substituted alkylene group, a substituted or non-substituted alkylene ether group or an alkyleneoxy carbonyl group; and m, and n represent an integer of from 0 to 3.

9. The image forming apparatus according to claim 3, wherein the radical polymerizable compound having one functional group with a charge transport structure comprises a compound represented by the following Chemical Structure 3:

Chemical Structure 3

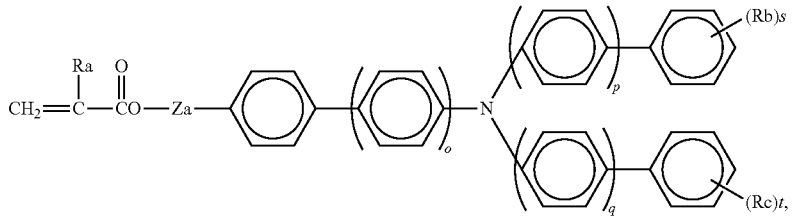

wherein:

o, p, q, each, independently, represent 0 or 1;

s and t each, independently, represent 0 or an integer of from 1 to 3;

Ra represents hydrogen atom or methyl group;

Rb and Rc, each, independently, represent an alkyl group (excluding hydrogen atom) having 1 to 6 carbon atoms; and Za represents a single bond, methylene group, ethylene group, —$CH_2CH_2O$—, —$CHCH_3CH_2O$—, or —$C_6H_5CH_2CH_2$—.

10. The image forming apparatus according to claim 1, wherein the lubricant comprises an aliphatic metal salt.

11. The image forming apparatus according to claim 10, wherein the aliphatic metal salt is formed by at least one aliphatic acid selected from the group consisting of stearic acid, palmitic acid, milistic acid, and oleic acid, and at least one metal selected from the group consisting of zinc, aluminum, calcium, magnesium, iron, and lithium.

12. The image forming apparatus according to claim 10, wherein the aliphatic metal salt is a solidified solid aliphatic metal salt installed on the lubricant supplying device.

13. The image forming apparatus according to claim 1, wherein multiple color toner images are sequentially overlapped to form a color image.

14. The image forming apparatus according to claim 1, comprising a tandem system in which multiple image formation elements are provided, each of which integrates the latent image bearing member, the latent electrostatic image formation device, the development device, and the transfer device in a single unit.

15. The image forming apparatus according to claim 1, further comprising:

an intermediate transfer body onto which the developed image formed on the latent image bearing member is primarily transferred; and a secondary transfer device that secondarily transfers the development image borne on the intermediate transfer body to the transfer medium, wherein multiple developed images of multiple colors are sequentially overlapped on the intermediate transfer body to form a color image, which is secondarily transferred to the transfer medium all at once.

* * * * *